US010293231B2

(12) United States Patent
Breeden, III et al.

(10) Patent No.: US 10,293,231 B2
(45) Date of Patent: May 21, 2019

(54) WEIGHTED GOLF CLUB GRIP

(71) Applicant: Winston Products, LLC, Cleveland, OH (US)

(72) Inventors: Winston H. Breeden, III, Chagrin Falls, OH (US); Nick D. Giannatti, Hudson, OH (US); David Drabousky, Twinsburg, OH (US)

(73) Assignee: WINSTON PRODUCTS LLC, Cleveland, OH (US)

( * ) Notice: Subject to any disclaimer, the term of this patent is extended or adjusted under 35 U.S.C. 154(b) by 0 days.

(21) Appl. No.: 15/824,668

(22) Filed: Nov. 28, 2017

(65) Prior Publication Data

US 2018/0147463 A1 May 31, 2018

Related U.S. Application Data

(60) Provisional application No. 62/426,731, filed on Nov. 28, 2016, provisional application No. 62/481,447, filed on Apr. 4, 2017, provisional application No. 62/483,073, filed on Apr. 7, 2017, provisional application No. 62/502,252, filed on May 5, 2017, provisional application No. 62/503,168, filed on May 8, 2017, provisional application No. 62/535,095, filed on Jul. 20, 2017.

(51) Int. Cl.

| | |
|---|---|
| ***A63B 53/14*** | (2015.01) |
| ***A63B 60/24*** | (2015.01) |
| *A63B 60/16* | (2015.01) |

(52) U.S. Cl.
CPC ..... *A63B 60/24* (2015.10); *A63B 53/14* (2013.01); *A63B 60/16* (2015.10)

(58) Field of Classification Search
CPC ..... A63B 60/24; A63B 53/14; A63B 60/16
See application file for complete search history.

(56) References Cited

U.S. PATENT DOCUMENTS

| | | | | |
|---|---|---|---|---|
| 3,173,689 | A | 3/1965 | Serblin | |
| 3,837,647 | A | 9/1974 | Jacques | |
| 4,600,195 | A | 7/1986 | Hunter | |
| 4,979,743 | A * | 12/1990 | Sears | A63B 53/007 473/204 |
| 4,988,102 | A | 1/1991 | Reisner | |
| 5,152,527 | A | 10/1992 | Mather et al. | |
| 5,569,097 | A | 10/1996 | Veux et al. | |
| 5,632,691 | A | 5/1997 | Hannon et al. | |
| 5,855,525 | A | 1/1999 | Turner | |
| 6,358,157 | B1 | 3/2002 | Sorenson | |
| 6,626,768 | B2 * | 9/2003 | Roelke | A63B 53/14 473/296 |
| 6,890,265 | B2 | 5/2005 | Enlow | |
| 7,175,538 | B2 | 2/2007 | Miller | |
| 7,399,235 | B2 * | 7/2008 | Gill | A01K 87/08 473/297 |

(Continued)

*Primary Examiner* — Stephen L Blau
(74) *Attorney, Agent, or Firm* — Tucker Ellis LLP

(57) ABSTRACT

Provided is a golf club grip having a grip portion and a front portion adjacent the grip portion each having a bore for receiving a shaft of a golf club. The front portion is weighted to provide a weighted golf grip with the weight below the golfer's hands effectively increasing the weight of a head of the golf club. The golf club grip has a total weight and the front portion of the grip has a weight greater than or equal to thirty percent of the total weight.

19 Claims, 66 Drawing Sheets

(56) References Cited

U.S. PATENT DOCUMENTS

| | | | | |
|---|---|---|---|---|
| D602,546 | S | 10/2009 | Lin | |
| 7,798,912 | B2 * | 9/2010 | Kou | B29C 43/021 473/300 |
| 7,874,933 | B2 | 1/2011 | Chol | |
| 8,182,360 | B2 | 5/2012 | Cameron | |
| D676,910 | S | 2/2013 | Button et al. | |
| D686,288 | S | 7/2013 | Threbank | |
| 8,641,551 | B2 | 2/2014 | Johnson | |
| 8,702,530 | B2 | 4/2014 | Slaughter et al. | |
| 8,721,469 | B2 | 5/2014 | Snyder | |
| 8,888,606 | B2 | 11/2014 | Boccieri | |
| 8,932,145 | B2 * | 1/2015 | Hachiro | A63B 60/48 473/300 |
| 9,072,952 | B2 | 7/2015 | Chu et al. | |
| 9,211,456 | B2 | 12/2015 | Barksdale et al. | |
| 2001/0039215 | A1 | 11/2001 | Buchanan | |
| 2002/0147056 | A1 * | 10/2002 | Sukenik | A63B 53/14 473/300 |
| 2014/0206471 | A1 | 7/2014 | Jertson et al. | |
| 2016/0074721 | A1 | 3/2016 | Knutson et al. | |
| 2016/0082325 | A1 | 3/2016 | Barksdale et al. | |

* cited by examiner

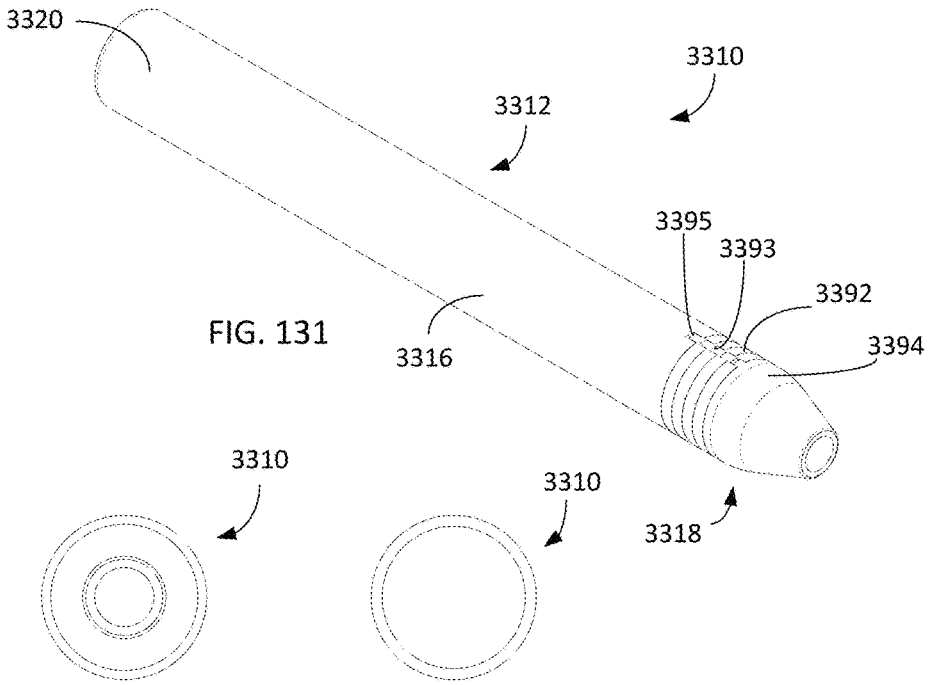
FIG. 131
FIG. 132
FIG. 133
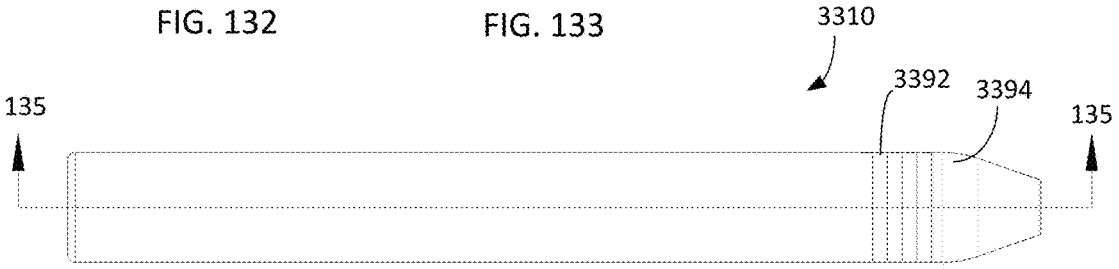
FIG. 134
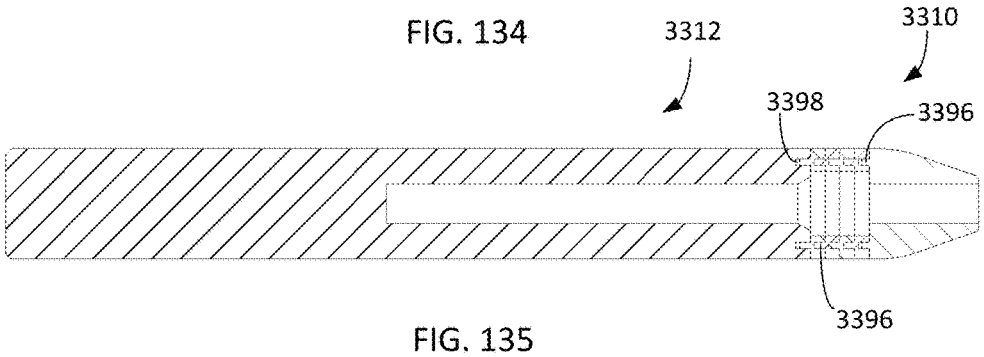
FIG. 135

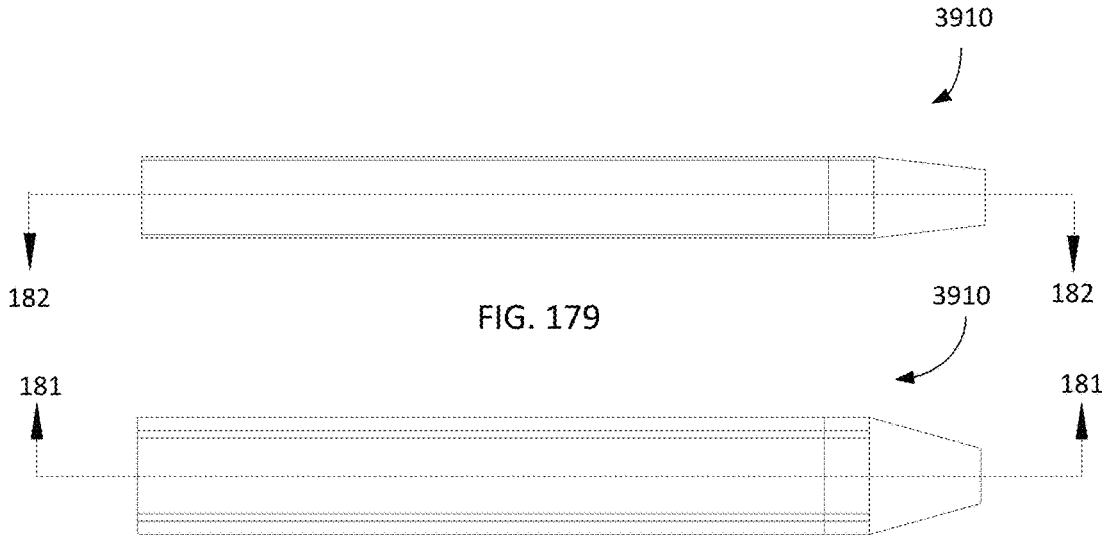
FIG. 179
FIG. 180
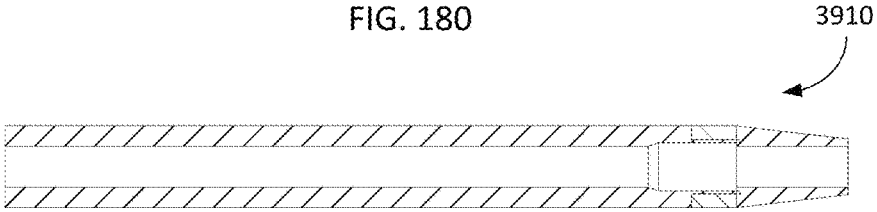
FIG. 181
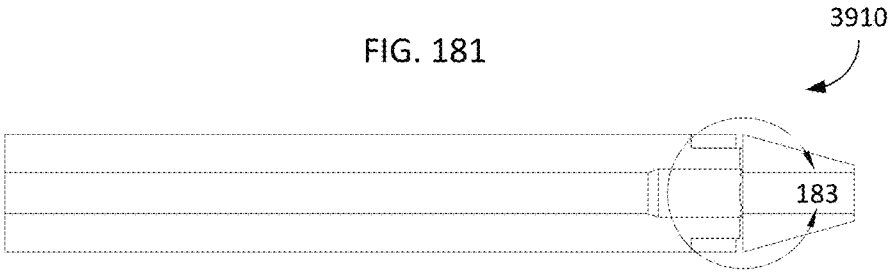
FIG. 182
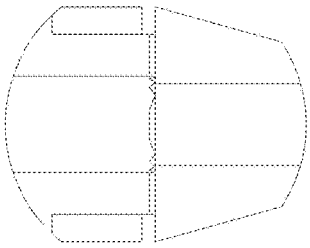
FIG. 183

WEIGHTED GOLF CLUB GRIP

RELATED APPLICATIONS

This application claims the benefit of U.S. Provisional Application No. 62/426,731 filed Nov. 28, 2016, U.S. Provisional Application No. 62/481,447 filed Apr. 4, 2017, U.S. Provisional Application No. 62/483,073 filed Apr. 7, 2017, U.S. Provisional Application No. 62/502,252 filed May 5, 2017, U.S. Provisional Application No. 62/503,168 filed May 8, 2017, U.S. Provisional Application No. 62/535,095 filed Jul. 20, 2017, which are hereby incorporated herein by reference.

FIELD OF INVENTION

The present invention relates generally to a grip, and more particularly to a weighted golf club grip for a putter.

BACKGROUND

Golf club grips, and in particular putter grips can be provided in a variety of shapes and sizes. The putter grips are installed onto shafts of golf clubs and secured in any suitable manner. A golfer can use a variety of grip placements when positioning her hands on the putter grip, such as traditional, left-hand low, saw, and claw.

SUMMARY OF INVENTION

The present application provides a golf club grip having a grip portion and a front portion adjacent the grip portion each having a bore for receiving a shaft of a golf club. The front portion is weighted to provide a weighted golf grip with the weight below the golfer's hands effectively increasing the weight of a head of the golf club. The golf club grip has a total weight and the front portion of the grip has a weight greater than or equal to thirty percent of the total weight.

In an embodiment, a grip for a golf club is provided that includes a grip portion having first and second ends and a bore extending longitudinally through the grip portion for receiving a shaft of the golf club at the first end, a back portion adjacent to the second end of the grip portion, and a front portion adjacent to the grip portion at the first end, the front portion having first and second ends and a bore extending longitudinally through the front portion such that the shaft of the golf club is configured to extend through the bore and into the bore of the grip portion, wherein a total weight of the grip is a first weight, and wherein the front portion is a second weight that is greater than or equal to thirty percent of the first weight.

In yet another embodiment, a grip for a golf club is provided that includes a grip portion defining an area for hands of a golfer to grip during use, and a front portion between the grip portion and a head of the golf club, wherein the grip portion and front portion define a length of the grip, wherein the length includes a lower third, an upper third, and a middle third between the lower third and the upper third, where the lower third is between the head of the golf club and the middle and upper thirds, and wherein a weight of the lower third of the grip is greater than a combined weight of the middle and upper thirds of the grip.

In another embodiment, a grip for a golf club is provided that includes a grip portion having first and second ends and a bore extending longitudinally through the grip portion for receiving a shaft of the golf club, and a front portion at the first end of the grip portion such that when attached to the golf club the front portion is between the grip portion and a head of the golf club, the front portion having a bore extending longitudinally through the front portion and in communication with the bore of the grip portion, wherein a total weight of the grip is a first weight, and wherein the front portion is a second weight that is greater than or equal to thirty percent of the first weight.

In yet another embodiment, a grip for a golf club is provided that includes a grip portion defining an area for hands of a golfer to grip during use, and a front portion configured to be coupled to the grip portion between the grip portion and a head of the golf club, wherein a total weight of the grip is a first weight, and wherein the front portion is a second weight that is greater than or equal to thirty percent of the first weight thereby weighting the grip below the hands of the golfer.

In still another embodiment, a method for installing a weighted front portion onto a golf club having a golf club grip installed on a shaft of the club is provided, wherein the grip has a first weight and wherein the front portion has a second weight that is greater than or equal to the first weight. The method includes attaching the front portion to the grip between the grip and a head of the golf club.

In a further embodiment, a method for mitigating directional and acceleration inconsistencies in a putter swing is provided. The method includes trisecting a putter grip into a lower third, an upper third, and a middle third between the lower third and the upper third, where the upper third forms a butt end of a putter and the lower third is between a head of the putter and the middle and upper thirds, and incorporating a metallic weight into the lower third of the putter grip such that a weight of the lower third of the putter grip is greater than a combined weight of the middle and upper thirds.

The foregoing and other features of the application are described below with reference to the drawings.

BRIEF DESCRIPTION OF THE DRAWINGS

FIG. 131 is a perspective view of still another exemplary golf club grip.

FIG. 132 is a right side view of the grip FIG. 133 is a left side view of the grip.

FIG. 134 is a rear view of the grip.

FIG. 135 is a cross-sectional view taken about line 135-135 in FIG. 134.

FIG. 167 is a cross-sectional view of the grip.

FIG. 168 is a right side view of the grip.

FIG. 169 is a left side view of the grip.

FIG. 170 is a top view of the grip.

FIG. 171 is a front view of the grip.

FIG. 172 is a rear view of the grip.

FIG. 173 is a cross-sectional view taken about line 173-1673 in FIG. 172.

FIG. 174 is an enlarged view of detail 174 in FIG. 173.

FIG. 175 is a perspective view of a further exemplary golf club grip.

FIG. 176 is a cross-sectional view taken about line 176-176 in FIG. 175.

FIG. 177 is a right side view of the grip.

FIG. 178 is a left side view of the grip.

FIG. 179 is a top view of the grip.

FIG. 180 is a rear view of the grip.

FIG. 181 is a cross-sectional view taken about line 181-181 in FIG. 180.

FIG. 182 is a cross-sectional view taken about line 182-182 in FIG. 179.

FIG. 183 is an enlarged view of detail 183 in FIG. 182.

Figure 184:
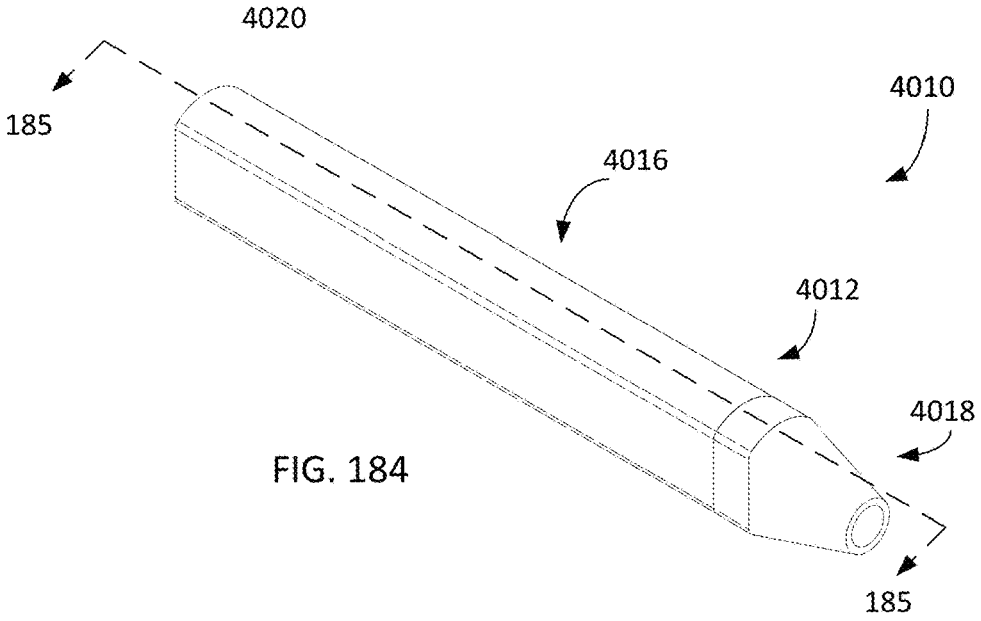

FIG. 184 is a perspective view of another exemplary golf club grip.

Figure 185:
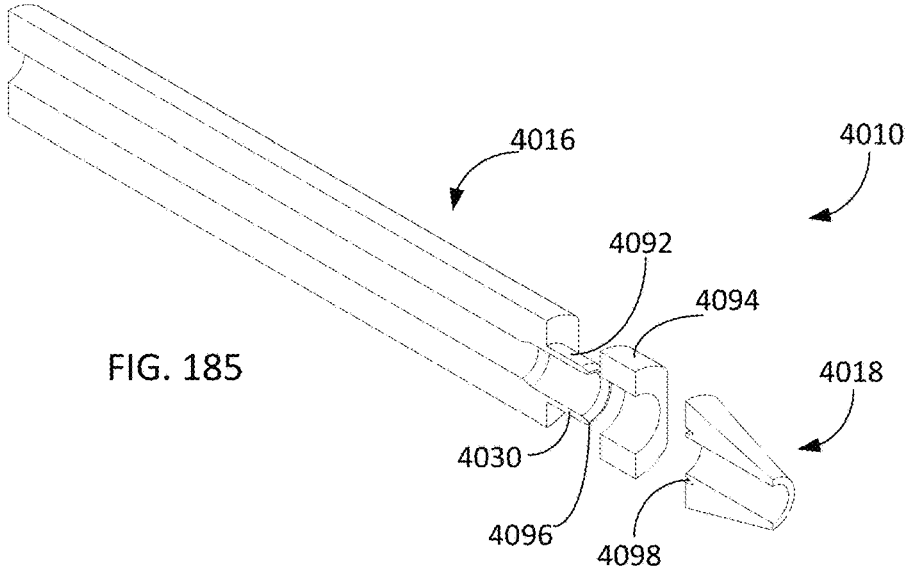

FIG. 185 is a cross-sectional view taken about line 185-185 in FIG. 184.

Figure 186:
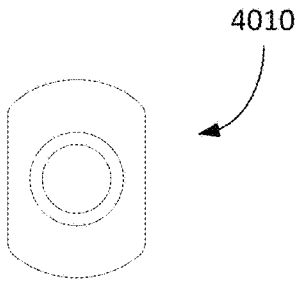

FIG. 186 is a right side view of the grip.

Figure 187:
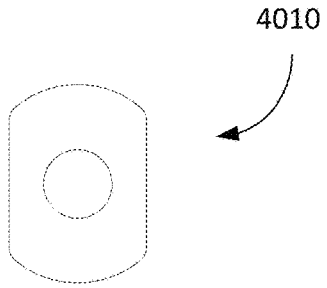

FIG. 187 is a left side view of the grip.

Figure 188:
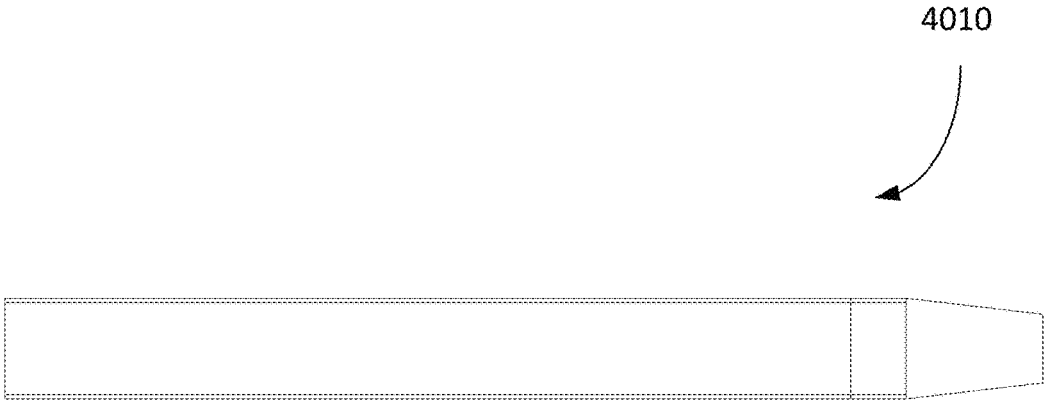

FIG. 188 is a top view of the grip.

Figure 189:
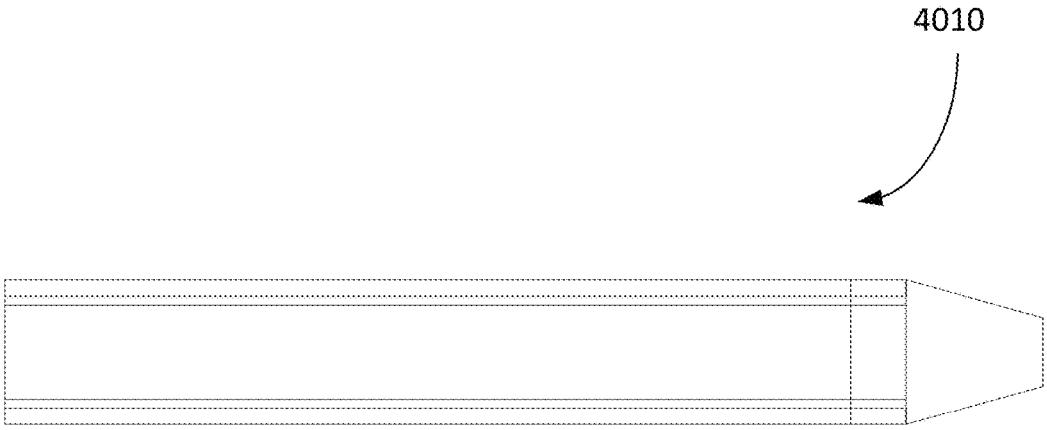

FIG. 189 is a rear view of the grip.

Figure 190:
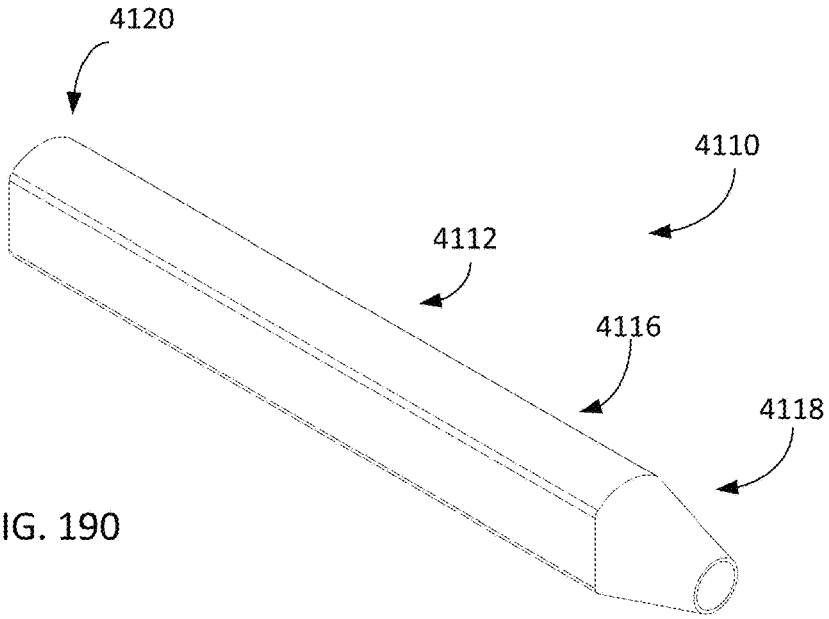

FIG. 190 is a perspective view of yet another exemplary golf club grip.

Figure 191:
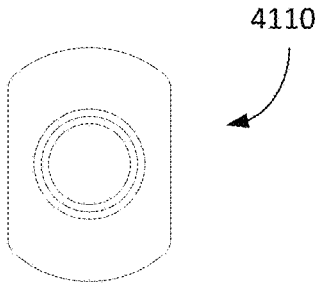

FIG. 191 is a right side view of the grip.

Figure 192:
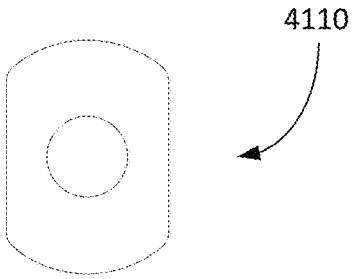

FIG. 192 is a left side view of the grip.

Figure 193:
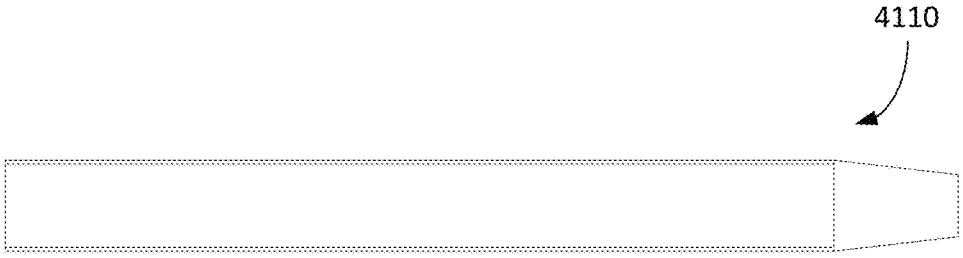

FIG. 193 is a top view of the grip.

Figure 194:
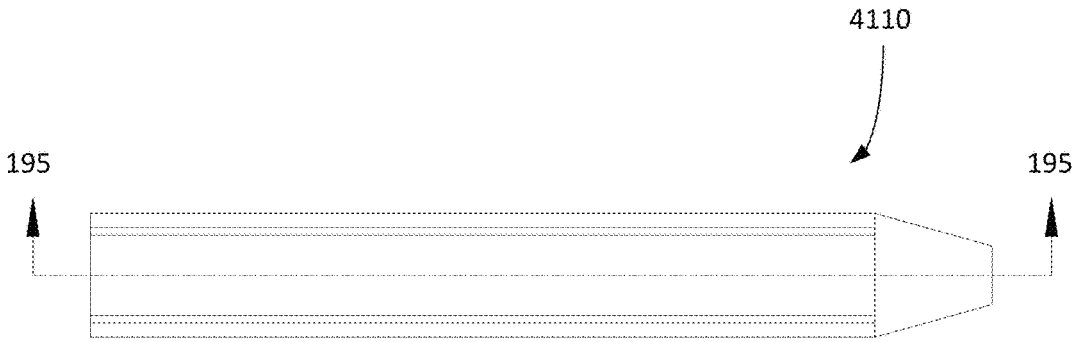

FIG. 194 is a rear view of the grip.

Figure 195:
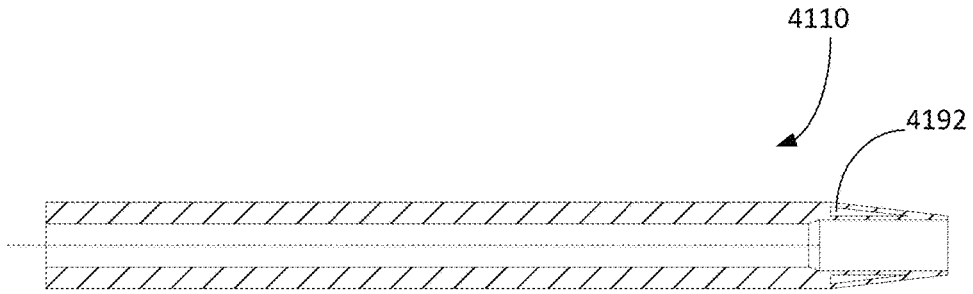

FIG. 195 is a cross-sectional view taken about line 195-195 in FIG. 194.

Figure 196:
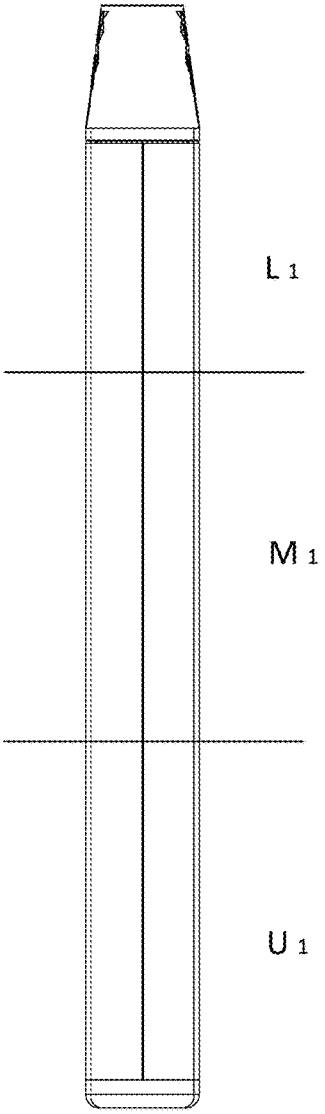

FIG. 196 is a top view of an exemplary grip.

Figure 197:
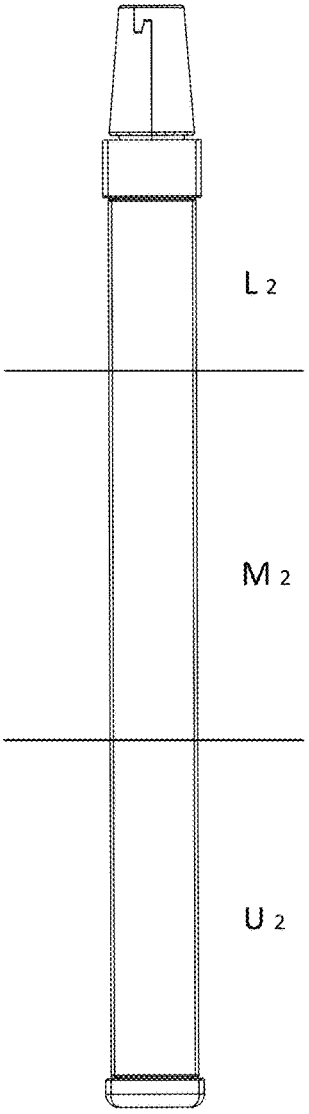

FIG. 197 is a top view of another exemplary grip.

Figure 198:
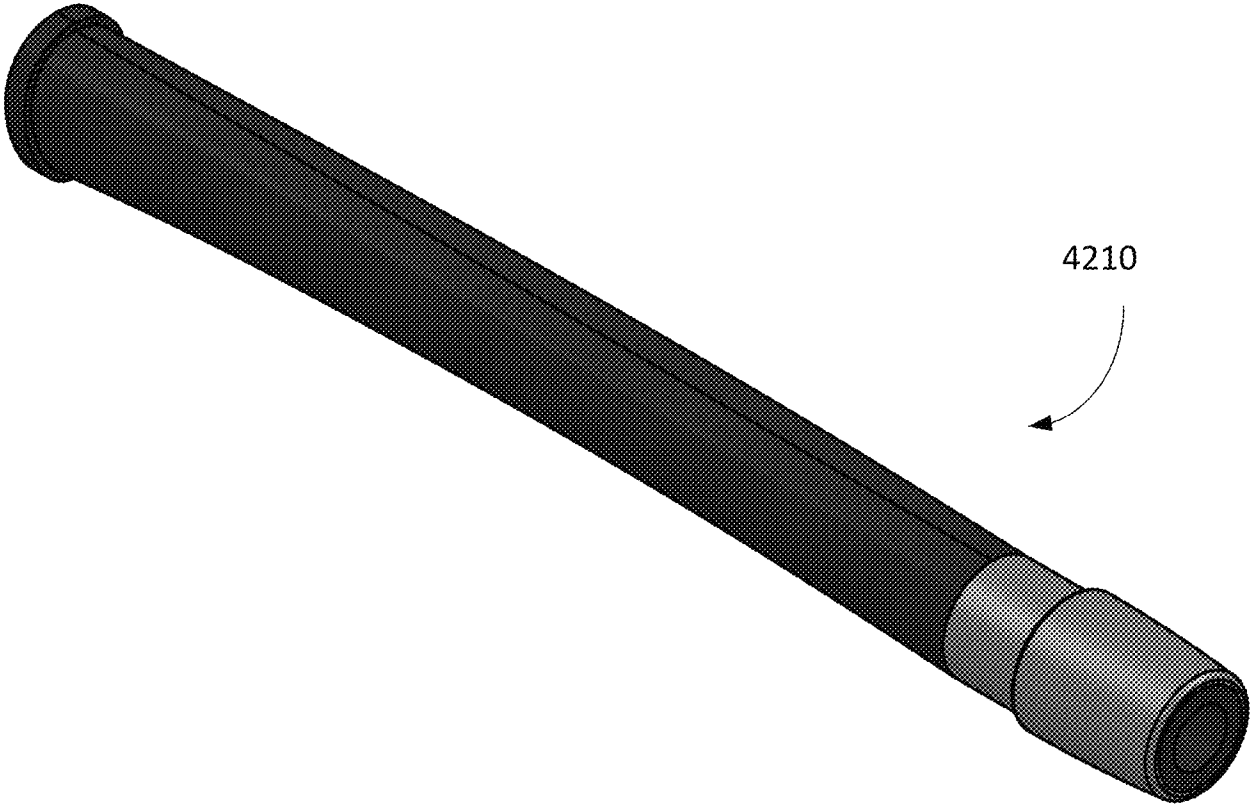

FIG. 198 is a perspective view of still another exemplary grip.

Figure 199:
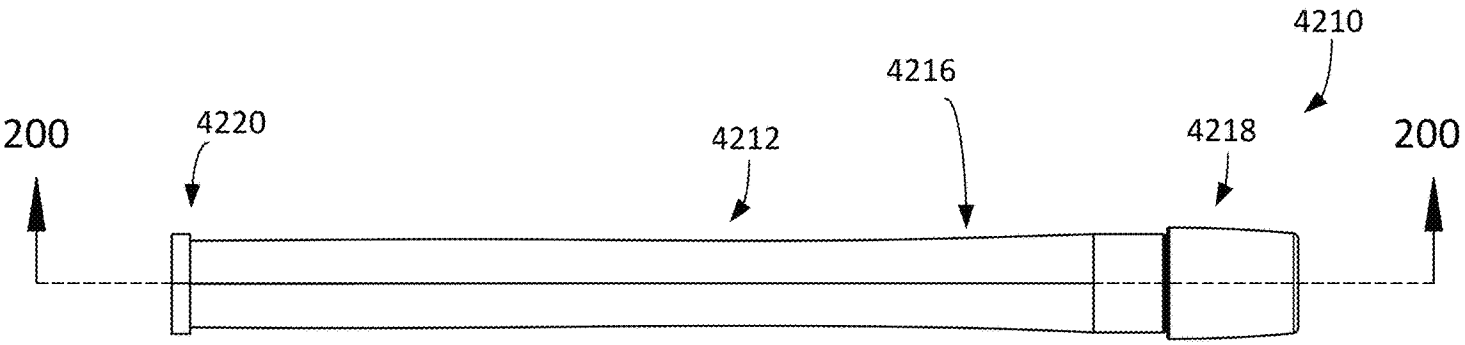

FIG. 199 is top view of the grip.

Figure 200:
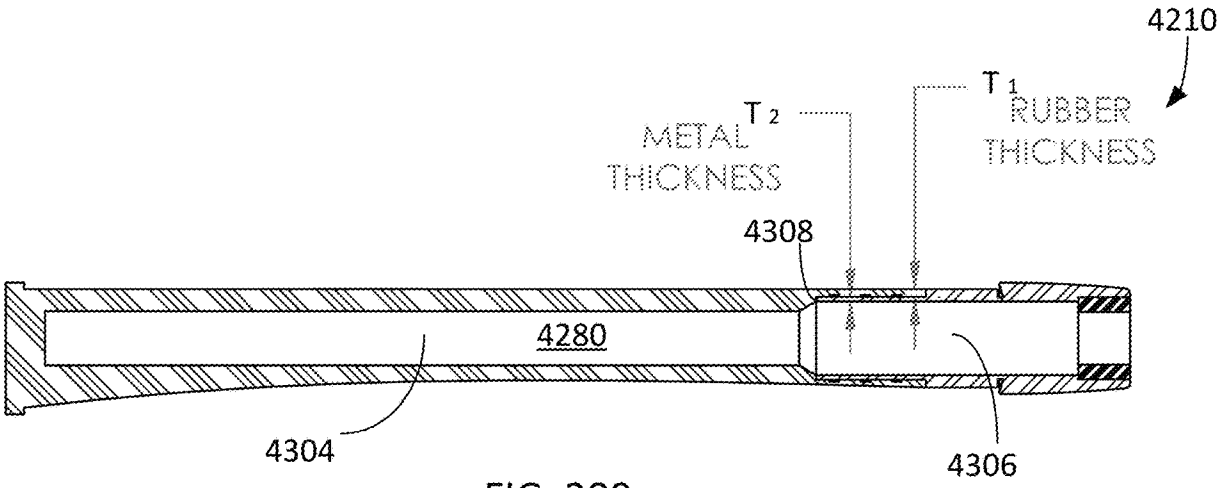

FIG. 200 is a cross-sectional view taken about line 200-200 in FIG. 199.

Figure 201:
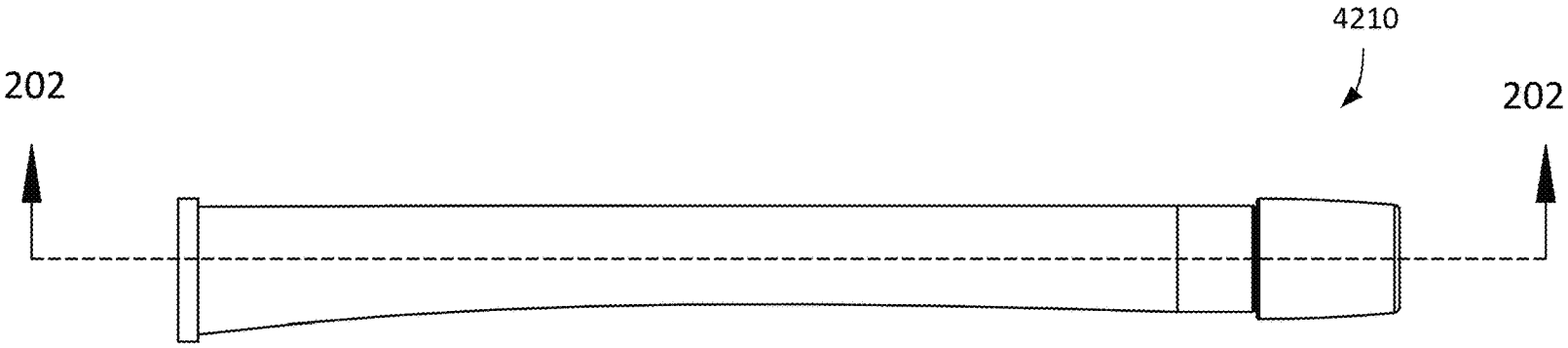

FIG. 201 is a rear view of the grip.

Figure 202:
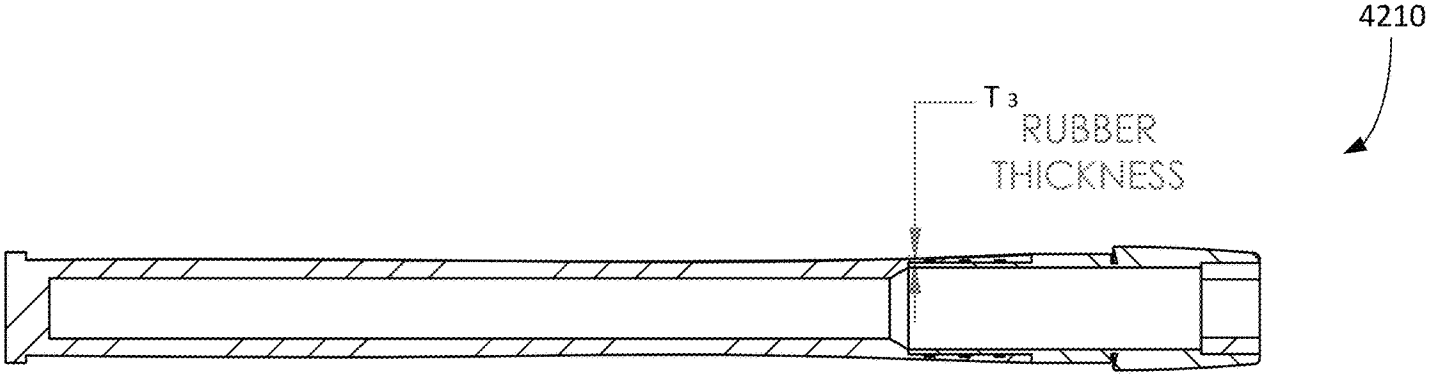

FIG. 202 is a cross-sectional view taken about line 202-202 in FIG. 201.

Figure 203:
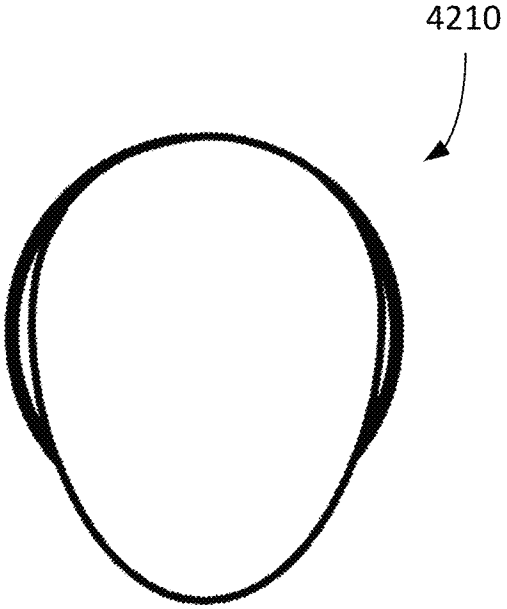

FIG. 203 is a left side view of the grip.

Figure 204:
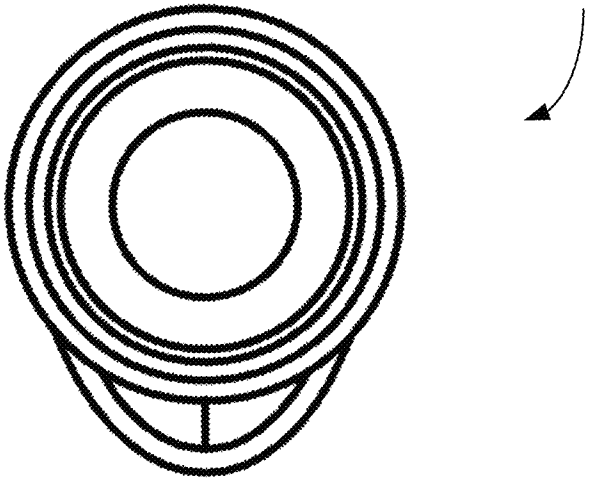

FIG. 204 is a right side view of the grip.

Figure 205:
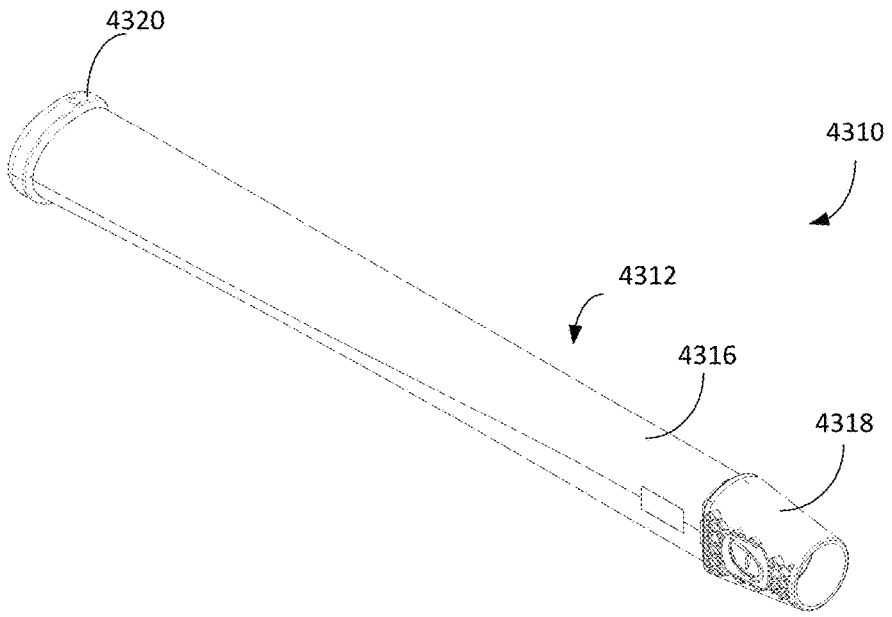

FIG. 205 is a perspective view of still another exemplary grip.

Figure 206:
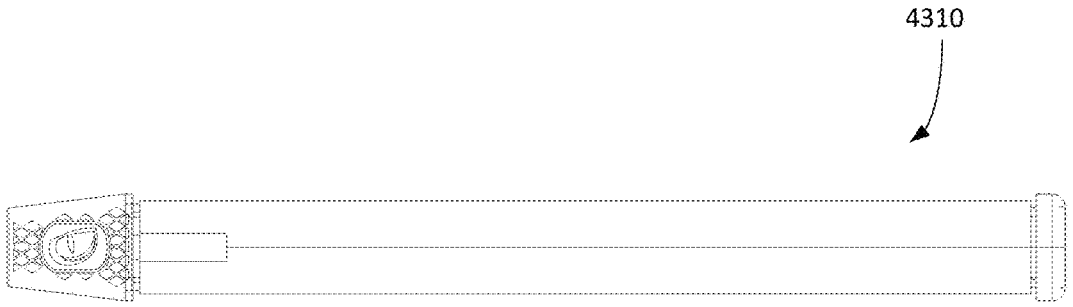

FIG. 206 is a front view of the grip.

Figure 207:
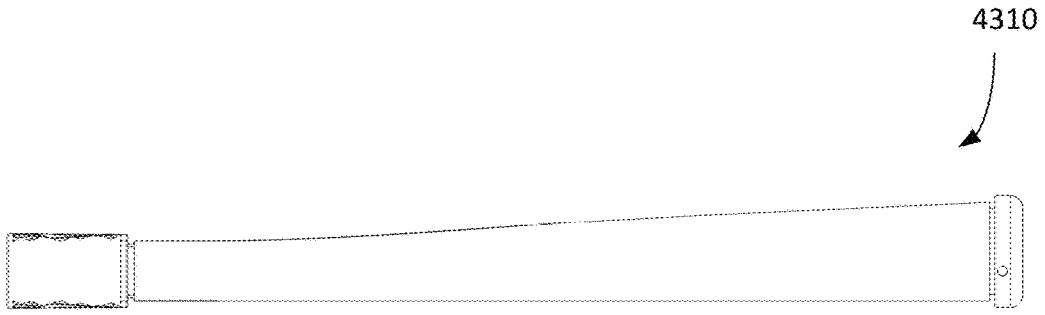

FIG. 207 is a top view of the grip.

Figure 208:
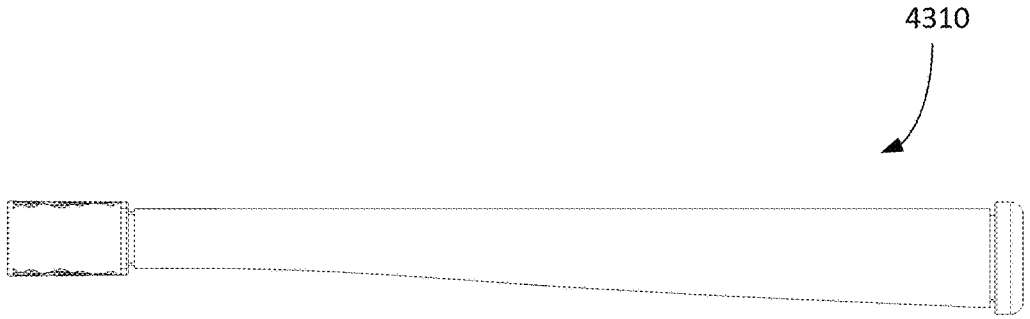

FIG. 208 is a bottom view of the grip.

Figure 209:
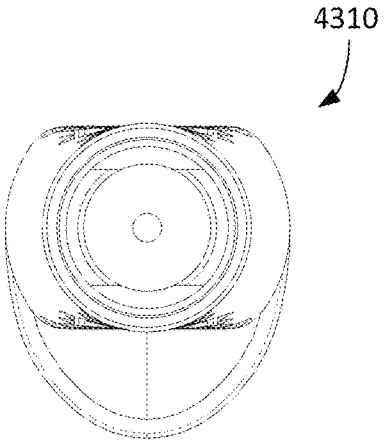

FIG. 209 is a right side view of the grip.

Figure 210:
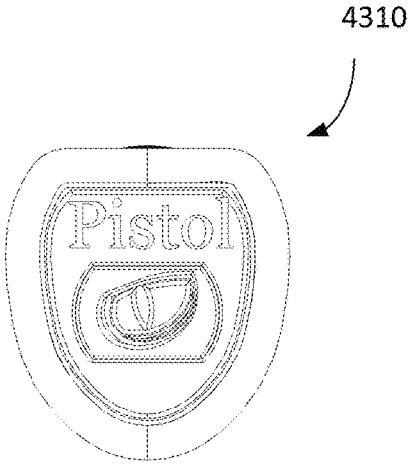

FIG. 210 is a left side view of the grip.

Figure 211:
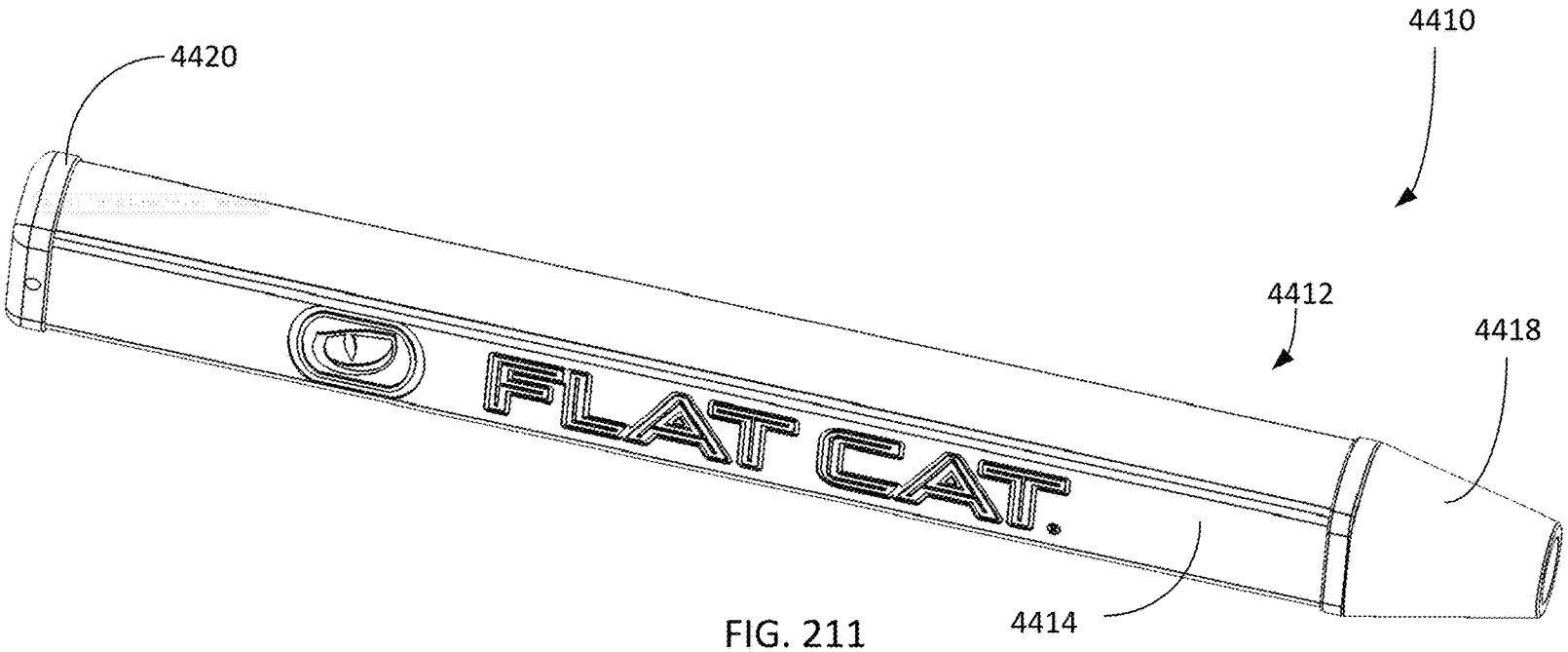

FIG. 211 is a perspective view of yet another exemplary grip.

Figure 212:
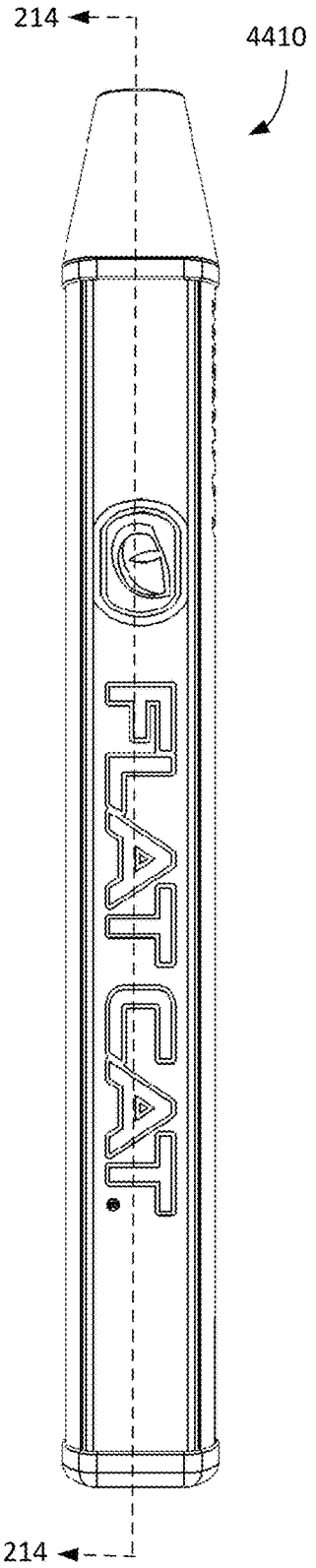

FIG. 212 is a rear view of the grip.

Figure 213:
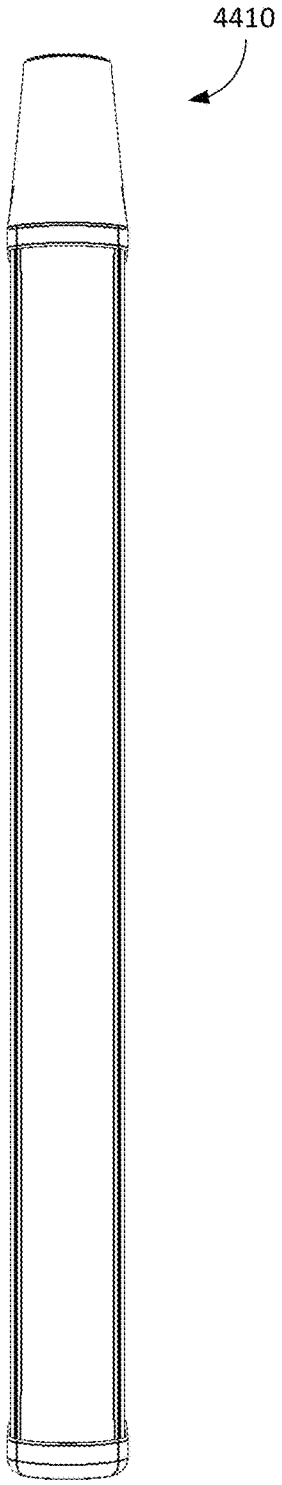

FIG. 213 is a bottom view of the grip.

Figure 214:
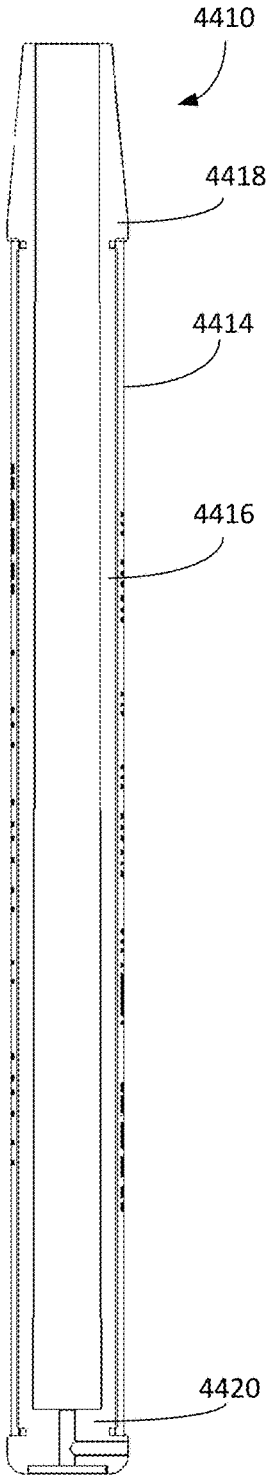

FIG. 214 is a cross-sectional view of the grip taken about line 214-214 in FIG. 212.

DETAILED DESCRIPTION

The principles of the present application relate to a grip for a golf club, such as a putter, and thus will be described below in this context. It will be appreciated that the principles of the application may be applicable to grips for other activities, such as baseball, tennis, etc.

Turning now to FIGS. 1-17, a golf club grip is shown generally at reference numeral 10. The grip includes a body 12 and a wrap 14 surrounding a portion of the body. Alternatively, it will be appreciated that grip 10 may be formed as one piece. The body 12 includes a grip portion 16 providing an area for a golfer to grip, a front portion 18 and a back portion 20. The grip portion 16 and back portion 20 can be formed as one piece and of any suitable material such as EVA foam injected into a mold, and the front portion 18 is formed as a separate piece that attaches to the grip portion 16. Alternatively, the grip portion 16, back portion 20, and the front portion 18 can be formed as one piece, such as in a mold or as separate pieces molded together. Alternatively, the grip portion 16, front portion 18, and back portion 20 may be formed as separate pieces.

As shown in FIGS. 3-7, the grip portion 16 has first and second ends 30 and 32 and a pair of longitudinally extending parallel flat sides 34 and 36 each joined to a pair of longitudinally extending curved sides 38 and 40. The grip portion 16 when viewed from an end view is substantially obround or double D shaped such that it has two parallel lines of equal length and two arcs on each end whose chords are either a full diameter or less than a full diameter.

The front portion 18, which is shown as and hereinafter referred to as a taper portion 18 and shown substantially conical in shape but which may have any suitable shape such as a shape with a constant diameter along its length, is adjacent the first end 30 of the grip portion 16 and includes first and second ends 60 and 62. The taper portion 18 tapers away from the grip portion 16 from the first end 30 to the first end 60. The back portion 20 is adjacent the second end 32 of the grip portion 16 and includes first and second ends 66 and 68. The end view of the taper portion 18 and the back portion 20 are also substantially obround or double D shaped.

The taper portion 18 has a shoulder 70 that abuts the first end of the grip portion 16 and, at its outer surface, has a cross-sectional area that is greater than a cross-sectional area of the grip portion 16. Similarly, the back portion 20 at its first end 66 has a cross-sectional area that is greater than the cross-sectional area of the grip portion 16. In this way, when the wrap 14 is installed on the body 12 to surround the grip portion 16, an outer surface of the wrap 14 is substantially flush with the second end 62 of the taper portion 18 and the first end 66 of the back portion 20. The wrap can be secured around the grip portion 16 in any suitable manner, such as by stitching or may be one-piece and slid onto the body 12.

Figure 3:
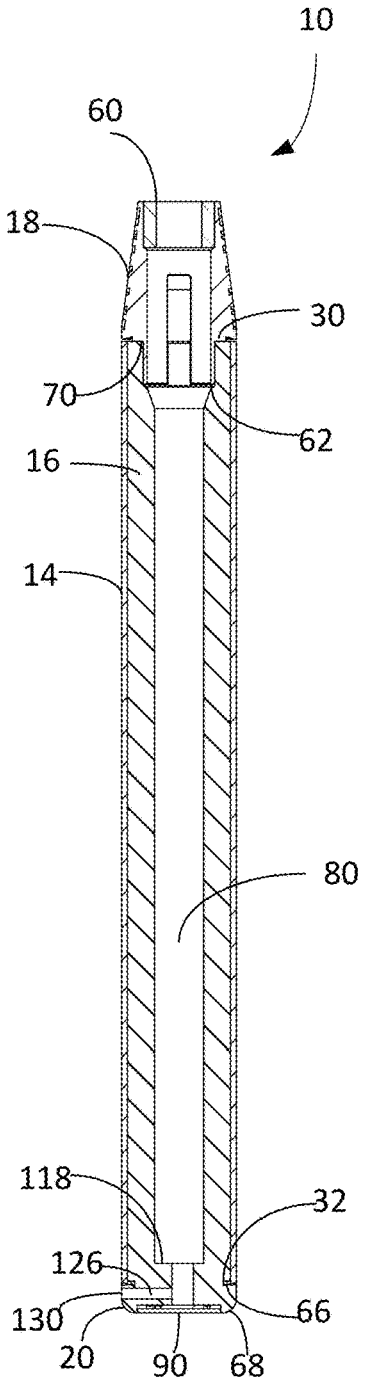
FIG. 3 is a cross-sectional view of the grip taken about line 3-3 in FIG. 2.
Figure 4:
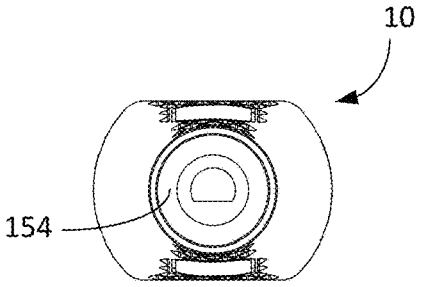
FIG. 4 is a right side view of the grip.
Figure 5:
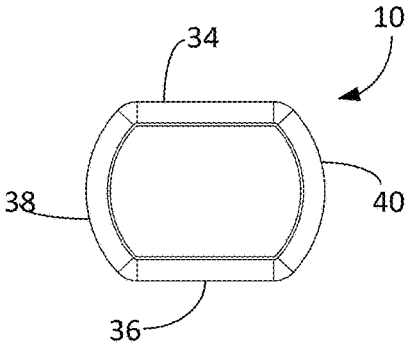
FIG. 5 is a left side view of the grip.
Figure 6:
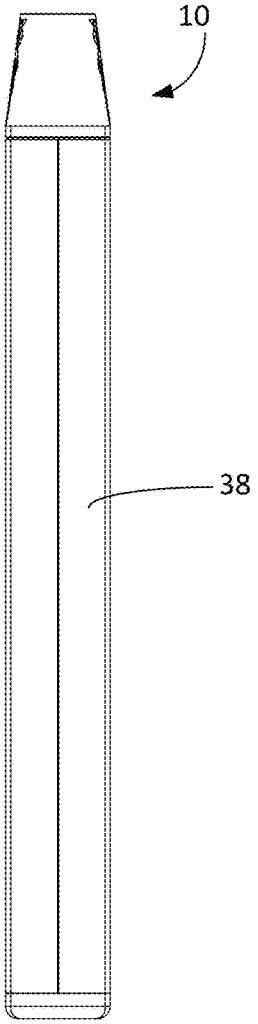
FIG. 6 is a bottom view of the grip.
Figure 7:
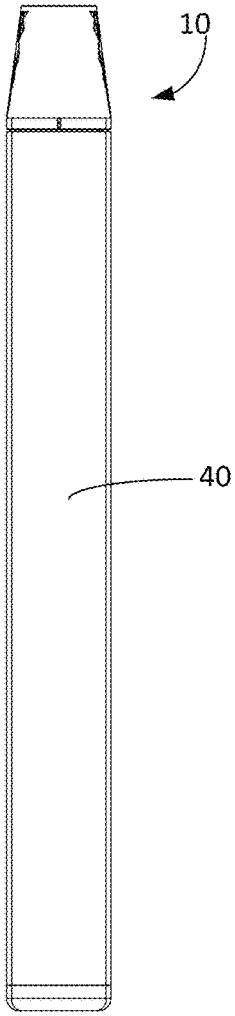
FIG. 7 is a top view of the grip.
Figure 8:
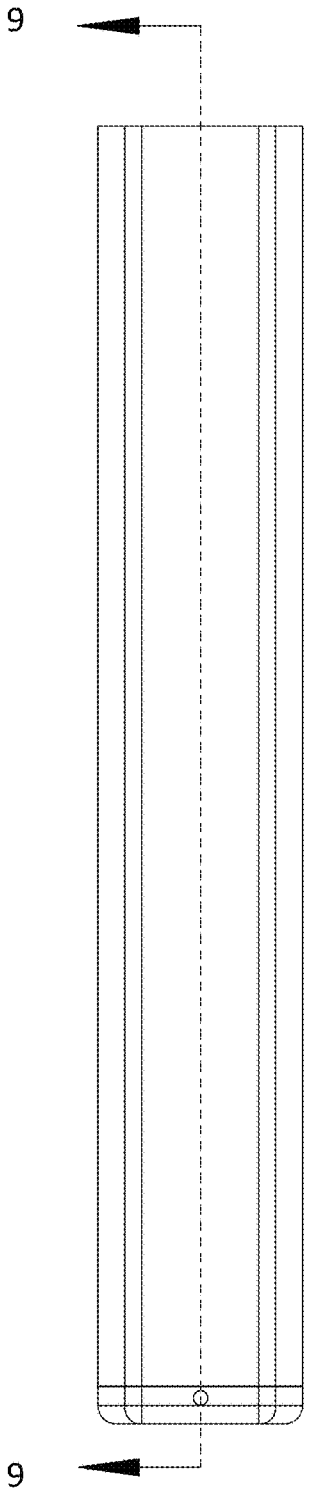
FIG. 8 is a rear view of a grip portion and a back portion of the grip.
Figure 9:
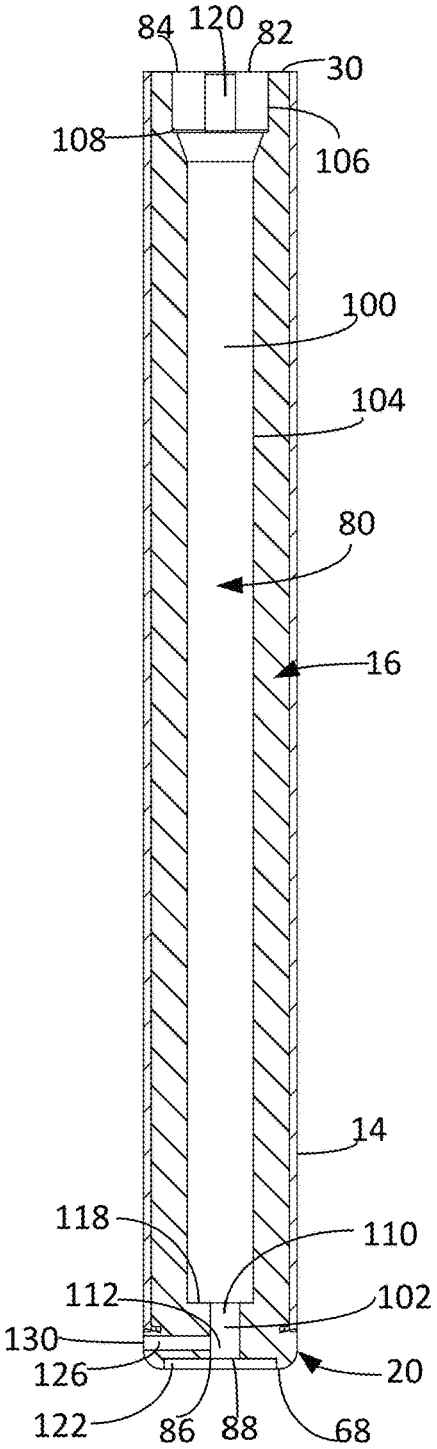
FIG. 9 is a cross-sectional view taken about line 9-9 in FIG. 8.

As shown in FIG. 9, the grip portion 16 and back portion 20 have a bore 80 or axial passage within the portions and extending the length of the portions. The bore has a first end 82 that opens to an opening 84 at the first end 30 of the grip portion 16, and a second end 86 that is closed. For example, the bore 80 opens to an opening 88 at the second end 68 of the back portion 20 as shown in FIG. 9 and is closed by a plug 90 as shown in FIG. 3 and discussed in detail below.

The bore 80 includes a first bore 100 or axial passage extending longitudinally through the grip portion 16 for receiving the shaft 52 of the golf club 50 and a portion of the taper portion 18 and a second bore 102 or axial passage in communication with the first bore 100, having a diameter less than that of the first bore 100, and extending longitudinally through a part of the grip portion 16 and the back portion 20. The first bore 100 includes a first diameter portion 104 substantially equal to a diameter of the shaft 52 and a second diameter portion 106 larger than the first diameter portion 104 for receiving a portion of the taper portion 18 as discussed below. The first bore 100 has a shoulder 108 between the first and second diameter portions 104 and 106 that is abutted by the portion of the taper portion, and as illustrated, the first bore 100 has a chamfer between the second diameter portion 106 and the first diameter portion 104. The second bore 102 includes a grip bore portion 110 within the grip portion 16 and an end bore portion 112 within the back portion 20.

Figure 10:
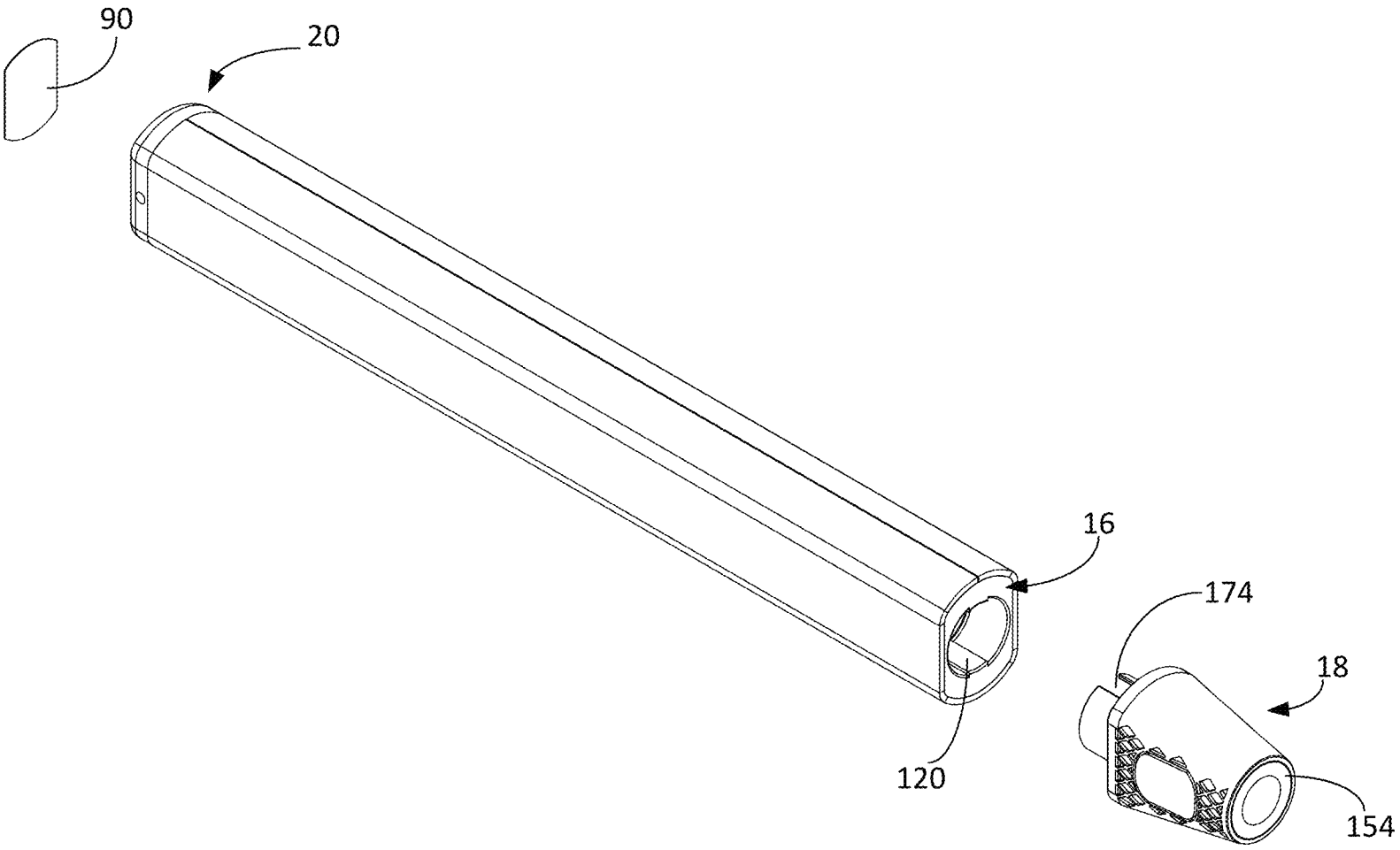
FIG. 10 is a perspective view of the grip and back portion of the grip separated from a front portion of the grip.

A shoulder 118 is provided in the first diameter portion 104 of the first bore 100 near the second end 32 of the grip portion 16 that defines an end of the first bore 100 and serves as a stop for an end of the shaft 52 of the golf club 50. As shown in FIG. 10, a pair of opposing radially inwardly extending projections 120 are provided in the second diameter portion 106 for engaging respective slots 174 in the taper portion 18 to align the taper portion. A counterbore 122 is provided in the back portion 20 at the second end 68 in communication with the second bore 102, and in particular the end bore portion 112 of the second bore 102. The counterbore 122 and the end bore portion 112 receive the plug 90 that closes the second bore 102 to prevent fluid from escaping the back portion 20. The plug 90 has a geometry that matches a geometry of the counterbore 122 to close the counterbore. As illustrated, the counterbore 122 is substantially obround or double D shaped. Alternatively, the second bore 102 could extend out to the second end 68 and the counterbore eliminated, or the grip could be closed at the second end 68 and the plug 90 eliminated.

To allow fluid to escape the back portion 20 as the shaft 52 of putter 50 is advanced into the bore 80, the back portion 20 includes a vent passage 126 in communication with the end bore portion 112. The vent passage 126 opens to an opening 130 and extends through a side wall 128 (FIG. 2) of the back portion 20 into the end bore portion 112, and as illustrated, the vent passage 126 is substantially perpendicular to the end bore portion 112. By providing the vent passage 126 in the side wall 128 of the grip 10 rather than through the end 68 of grip coaxial with the bore 102, the plug 90 may be provided with an uninterrupted area for indicia, the opening 130 is easier to cover with a finger than when at end of a club, and spray through the opening 130 is not directed at the installer.

Figure 11:
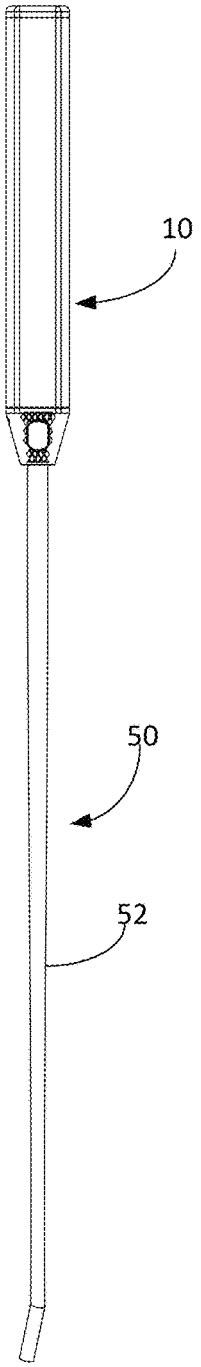
FIG. 11 is a front view of a golf club having the grip attached thereto.
Figure 12:
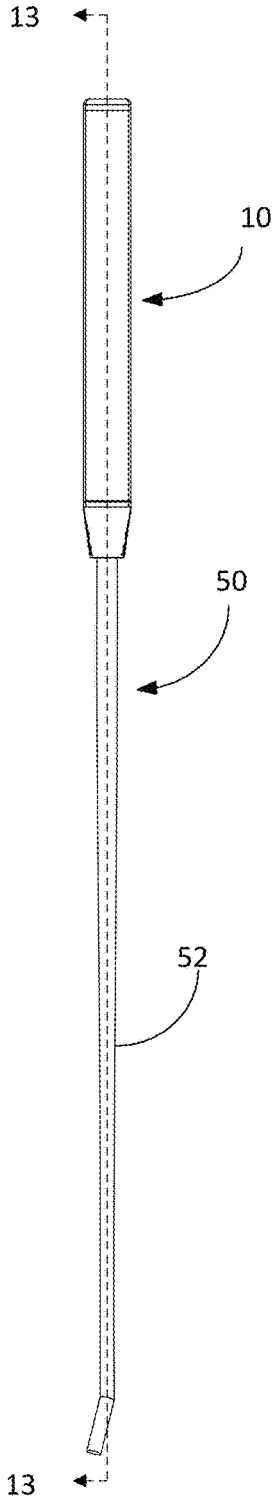
FIG. 12 is a top view of the golf club.
Figure 13:
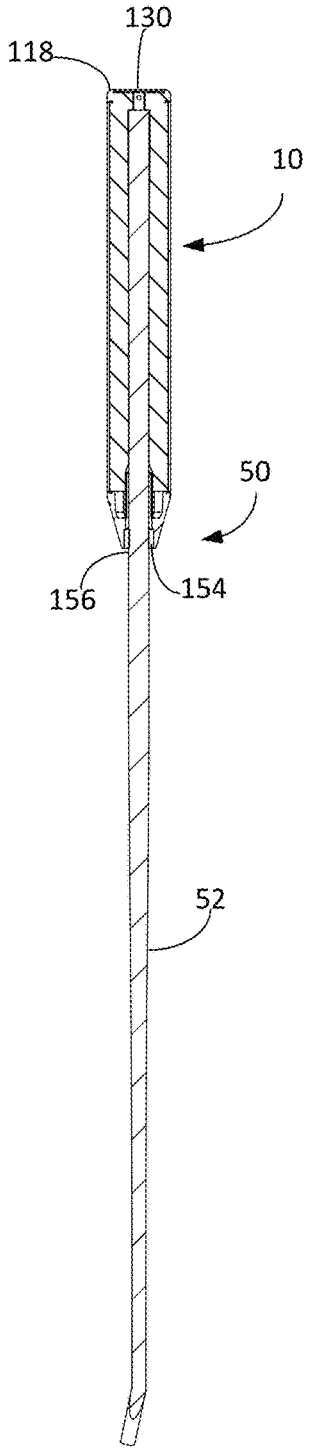
FIG. 13 is a cross-sectional view taken about line 13-13 in FIG. 12.
Figure 14:
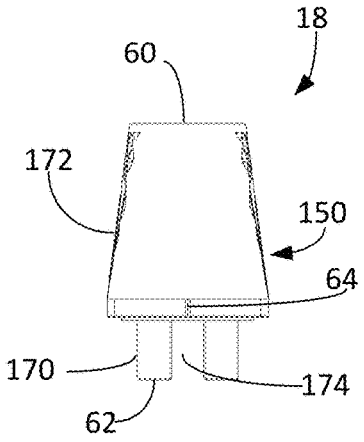
FIG. 14 is a top view of the front portion.
Figure 15:
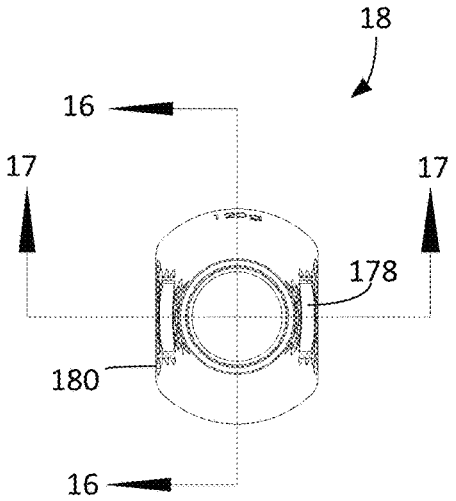
FIG. 15 is a right side view of the top portion.
Figure 16:
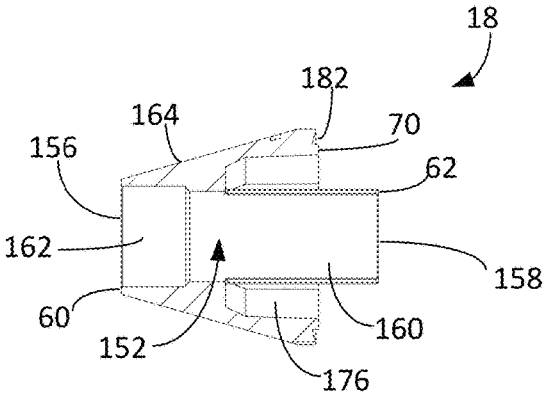
FIG. 16 is a cross-sectional view taken about line 16-16 in FIG. 15.
Figure 17:
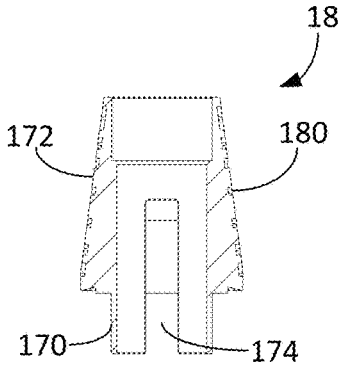
FIG. 17 is a cross-sectional view taken about line 17-17 in FIG. 15.
Figure 18:
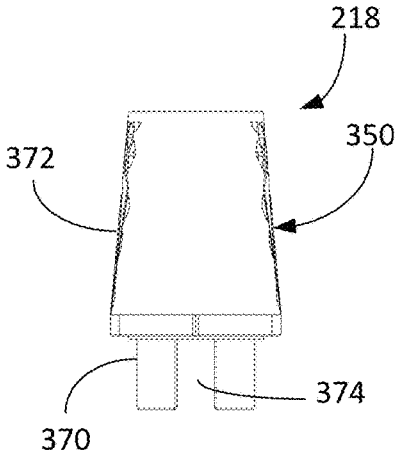
FIG. 18 is a top view of another front portion.
Figure 19:
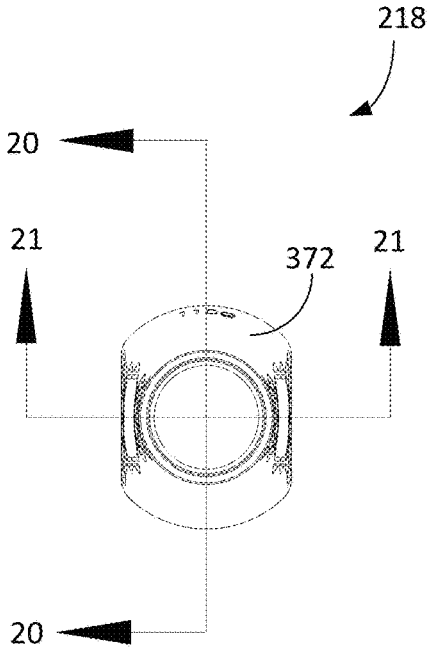
FIG. 19 is a right side view of the top portion.
Figure 20:
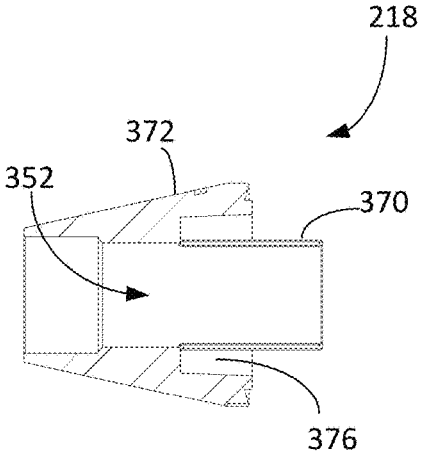
FIG. 20 is a cross-sectional view taken about line 20-20 in FIG. 19.
Figure 21:
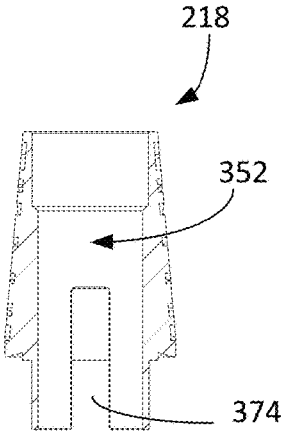
FIG. 21 is a cross-sectional view taken about line 21-21 in FIG. 19.
Figure 22:
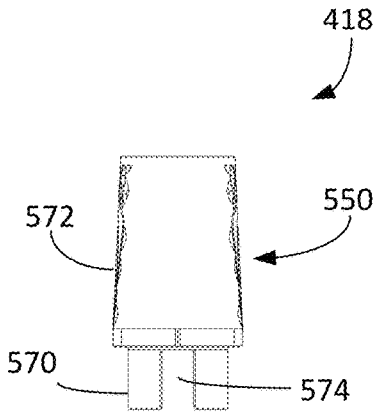
FIG. 22 is a top view of still another front portion.
Figure 23:
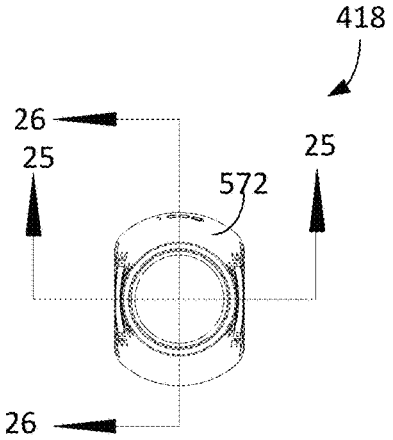
FIG. 23 is a right side view of the top portion.
Figure 24:
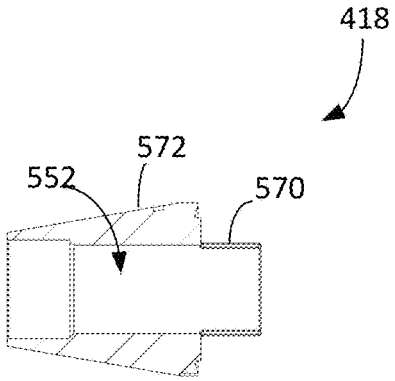
FIG. 24 is a cross-sectional view taken about line 24-24 in FIG. 23.
Figure 25:
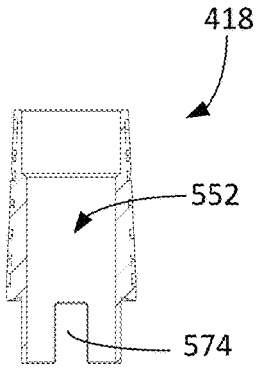
FIG. 25 is a cross-sectional view taken about line 25-25 in FIG. 23.
Figure 26:
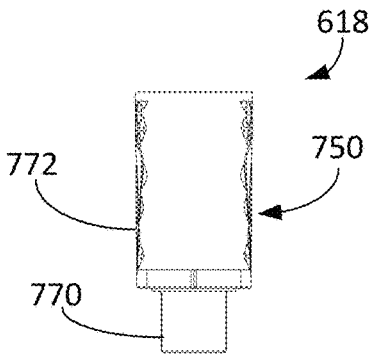
FIG. 26 is a top view of yet another front portion.
Figure 27:
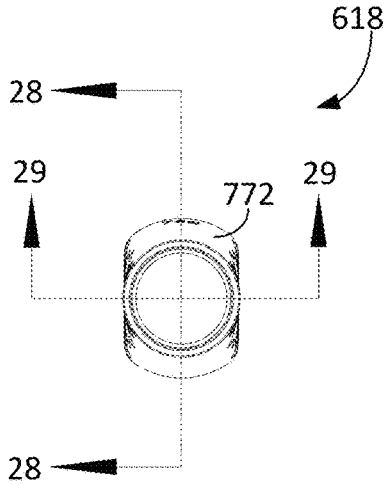
FIG. 27 is a right side view of the top portion.
Figure 28:
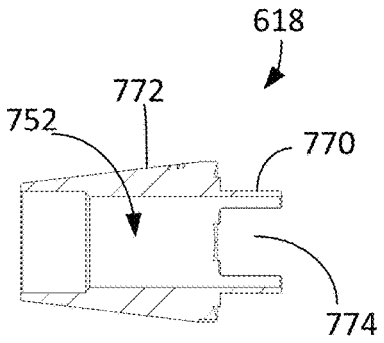
FIG. 28 is a cross-sectional view taken about line 28-28 in FIG. 27.
Figure 29:
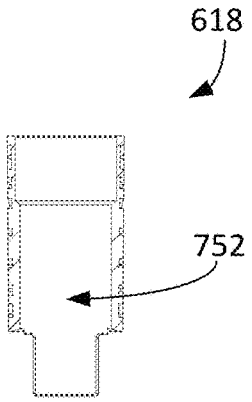
FIG. 29 is a cross-sectional view taken about line 29-29 in FIG. 27.
Figure 30:
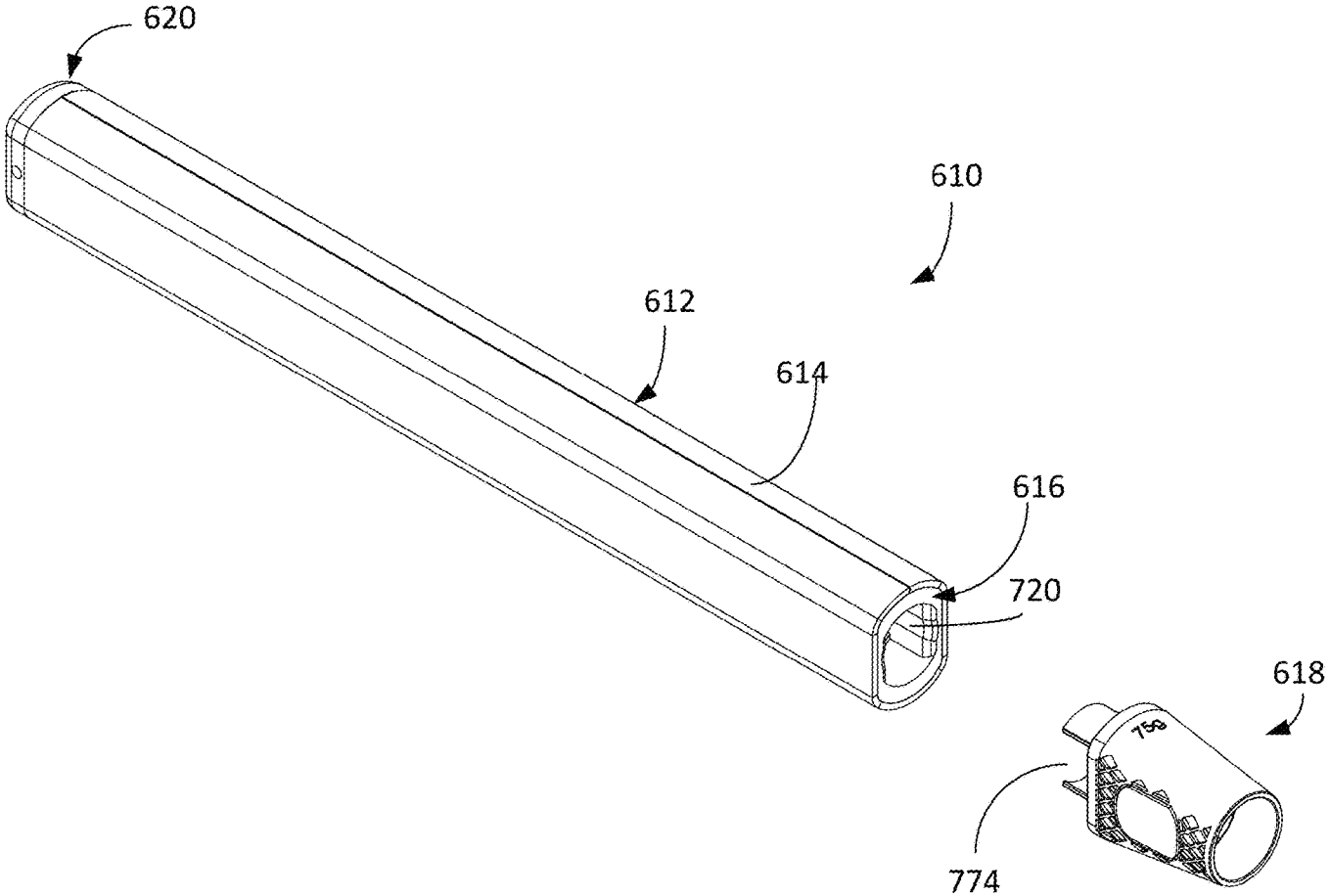
FIG. 30 is a perspective view of a golf club grip including the front portion of FIG. 26.

Referring additionally to FIGS. 11-13, to install the grip 10 onto the putter 50, a two sided tape is adhered to an end of the shaft 52 and then a solvent is applied to the tape and injected into an opening 156 in the taper portion 18. The openings 156 and 130 are then covered and the grip 10 shaken to coat the bores with solvent. The shaft 52 is then advanced through the opening 156 longitudinally through a bore 152 of the taper portion 18 and the first bore 100 until an end of the shaft 52 abuts the shoulder 118. As the shaft 52 is advanced, excess solvent and air pass through the first and second bores 100 and 102 and exits the grip 10 via the opening 130 of the vent passage 126. The grip 10 is also aligned on the putter 50, for example using an alignment device 64 on the taper portion 18. The grip can be installed such that the flat sides 34 and 36 are parallel to a face of the golf club, for example for golfers that use a standard grip, or the flat sides 34 and 36 can be perpendicular to the face of the golf club, for example for golfers that use alternative grip styles.

The grip can be weighed, for example as discussed in detail below, to mitigate inconsistencies in a putter swing, such as minimizing directional and acceleration inconsistencies. The grip can be trisected into a lower third, a middle third, and an upper third, where the upper third forms a butt end of a putter and the lower third is between the head of the putter and the middle and upper thirds. The weight, such as a metallic weight, can be imported into the lower third such that a weight of the lower third of the putter grip is greater than or equal to eighty percent of a combined weight of the middle and upper thirds. In another embodiment, the weight of the lower third is greater than or equal to the combined weight. The putter grip can include a grip with an integral front portion or a front portion attached to a grip portion.

Figure 1:
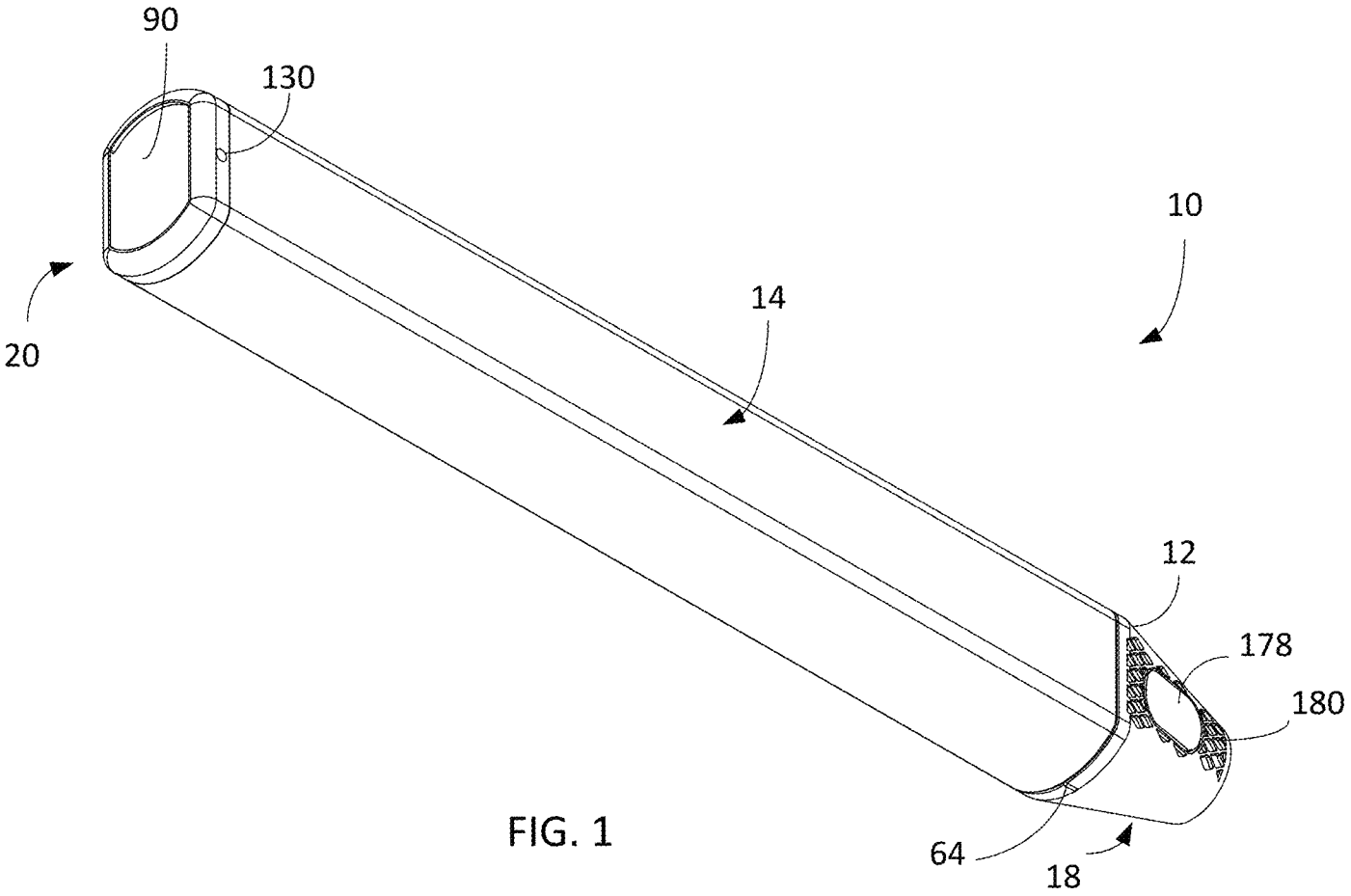
FIG. 1 is a perspective view of an exemplary golf club grip.
Figure 2:
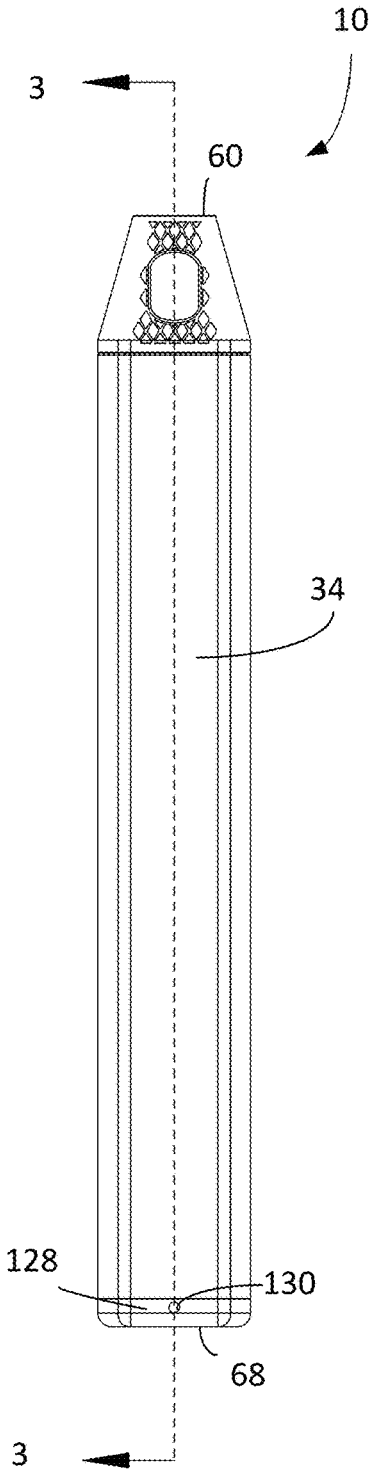
FIG. 2 is a rear view of the grip.

Referring now to FIGS. 13-17 in addition to FIGS. 1-3, the taper portion 18 will be discussed in detail. The taper portion 18 is weighted to provide a weighted golf grip with the weight below the golfer's hands effectively increasing the weight of a head of the golf club thereby giving the golf club a heavier feel to smooth the golfer's stroke and improve performance. If the weight is too light the above advantage will not be realized and if the weight is too heavy the club will have too much inertia and the golfer will lose control of the club. The grip 10 has a total weight, and the taper portion 18 has a weight that is greater than or equal to thirty percent of the total weight of the grip 10, and in an embodiment has a weight that is greater than or equal to fifty percent of the total weight of the grip 10. In another embodiment the taper portion 18 is between fifty to sixty percent of the total weight. In an embodiment, the weight of the taper portion is greater than or equal to seventy-five grams. In another embodiment, the weight of the taper portion is greater than or equal to one hundred grams. In another embodiment, the weight of the taper portion is greater than or equal to one hundred ten grams.

The taper portion 18 includes a body 150 defining a bore 152 or axial passage extending the length of the taper portion 18 and a spacer 154 disposed in the bore 152. The weighting of the taper portion 18 is provided by the material of the body 150, which may be any suitable material, such as a suitable metal. The spacer 154 is configured to abut an outer surface of the shaft 52 and may be made of a compressible material, such as foam, that is tight against the shaft to seal to the shaft 52 to prevent fluid and/or debris from entering the bore 152 as shown in FIG. 13. The spacer 154 may be coupled to the body 150 in any suitable manner, such as by an adhesive.

The bore 152 opens to an opening 156 at the first end 60 of the taper portion 18 and to an opening 158 at the second end 62. The bore 152 includes a first diameter portion 160 and a second diameter portion 162 larger than the first diameter portion 160 in which the spacer 154 is disposed. The bore 152 also includes a shoulder 164 between the first and second diameter portions 160 and 162 that is abutted by an end of the spacer 154, and as illustrated, the bore 152 has a chamfer down from the second diameter portion 162 to the first diameter portion 160.

The body 150 includes a first portion 170 disposed in the second diameter portion 106 of the grip portion 16 and a second portion 172 integral with the first portion 170 having the shoulder 70 that abuts an end face of the grip portion 16 at the first end 30 and tapers away from the first end 30. The first portion 170 has an end face at the second end 62 of the taper portion 16 that abuts the shoulder 108 in the bore 100, and a pair of slots 174 extending longitudinally from the second end 62 towards the first end 60, and in the illustrated embodiment the slots 174 extend into the second portion 172. The slots 174 engage or receive the respective projections 120 to align the taper portion 18 with the grip portion 16. The slots 174 may extend through the first portion 170 into the first diameter portion 160 of the bore 152 and can be adjusted in length to vary the weight of the grip 10. Additionally or alternatively, the second portion 172 can include one or more cut-outs 176 for adjusting the weight of the grip 10. The second portion 172 can also include an area 178 on one or more sides for indicia, such as a logo, and can includes patterns 180 etched into its surface.

To assemble the grip 10, the first portion 170 of the body 150 is inserted into the second diameter portion 106 of the grip portion, with the slots 174 aligned with the projections 120, and secured in a suitable manner, such as an adhesive applied to the first portion 170 prior to insertion. The wrap 14 can then be installed on the body 12 to surround the grip portion 16, and an end of the wrap 14 can be tucked between a space formed between the end face of the grip portion 16 at the first end 30 and a circumferential notch 182 in the shoulder 70 of the second portion 172.

Turning now to FIGS. 18-21, an exemplary embodiment of the front portion is shown at 218. The front portion 218 is substantially the same as the above-referenced front portion 18, and consequently the same reference numerals but indexed by 200 are used to denote structures corresponding to similar structures in the front portions. In addition, the foregoing description of the front portion 18 is equally applicable to the front portion 218, except as noted below and illustrated in the figures.

The front portion 218 includes a body 350 defining a bore 352 or axial passage extending the length of the front portion 218 and a spacer (not shown) disposed in the bore 352. The body 350 includes a first portion 370 configured to be disposed in the second diameter portion 106 of the grip portion 16 and a second portion 372 integral with the first portion 370. The first portion 370 has a pair of slots 374 extending longitudinally, and in the illustrated embodiment the slots 374 extend into the second portion 372, and the second portion 372 includes one or more cut-outs 376. The slots 374 have an axial length less than that of the slots 174 and the cut-outs 376 have an axial length less than that of the cut-outs 176. The front portion 218 is smaller and lighter than the front portion 18, and it will be appreciated that the grip portion 16 used with the front portion 218 will be correspondingly sized such that the above weight ratios are realized.

Turning now to FIGS. 22-25, an exemplary embodiment of the front portion is shown at 418. The front portion 418 is substantially the same as the above-referenced front portion 18, and consequently the same reference numerals but indexed by 400 are used to denote structures corresponding to similar structures in the front portions. In addition, the foregoing description of the front portion 18 is equally applicable to the front portion 418, except as noted below and illustrated in the figures.

The front portion 418 includes a body 550 defining a bore 552 or axial passage extending the length of the front portion 418 and a spacer (not shown) disposed in the bore 552. The body 550 includes a first portion 570 configured to be disposed in the second diameter portion 106 of the grip portion 16 and a second portion 572 integral with the first portion 570. The first portion 570 has a pair of slots 574 extending longitudinally and does not include cut-outs. The slots 574 have an axial length less than that of the slots 174. The front portion 418 is smaller and lighter than the front portions 18 and 218, and it will be appreciated that the grip portion 16 used with the front portion 418 will be correspondingly sized such that the above weight ratios are realized.

Turning now to FIGS. 26-30, an exemplary embodiment of the golf club grip is shown at 610. The golf club grip 610 is substantially the same as the above-referenced golf club grip 10, and consequently the same reference numerals but indexed by 600 are used to denote structures corresponding to similar structures in the grips. In addition, the foregoing description of the golf club grip 10 is equally applicable to the golf club grip 610, except as noted below and illustrated in the figures.

The grip 610 includes a body 612 and a wrap 614 surrounding the body 612. The body 612 includes a grip portion 616, a front portion 618, and a back portion 620. The grip portion 616 and back portion 620 can be formed as one piece, and the front portion 618 is formed as a separate piece that attaches to the grip portion 616.

The front portion 618 includes a body 750 defining a bore 752 or axial passage extending the length of the front portion 618 and a spacer (not shown) disposed in the bore 752. The body 750 includes a first portion 770 configured to be disposed in the second diameter portion 106 of the grip portion 16 and a second portion 772 integral with the first portion 770. The first portion 770 has a pair of slots 774 extending longitudinally and does not include cut-outs. The slots 774 engage or receive the respective opposing radially inwardly extending projections 720 to align the front portion 618 with the grip portion 616. The front portion 618 is smaller and lighter than the front portions 18, 218, and 418, and it will be appreciated that the grip portion 16 used with the front portion 618 will be correspondingly sized such that the above weight ratios are realized.

Figure 31:
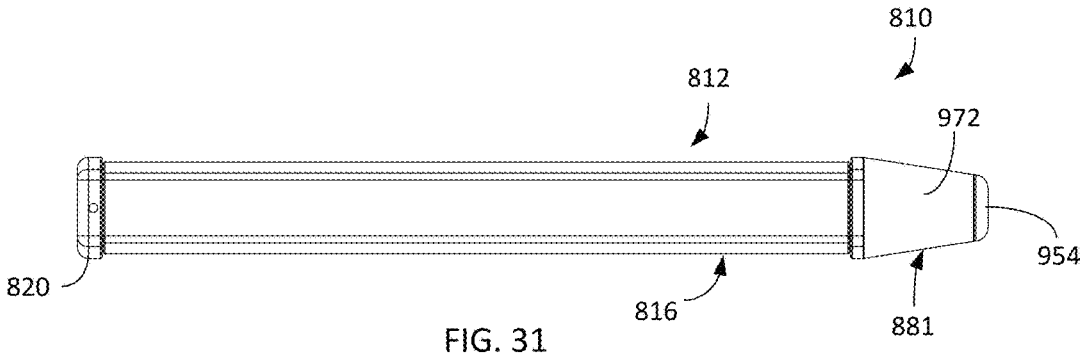
FIG. 31 is a rear view of another exemplary golf club grip.
Figure 32:
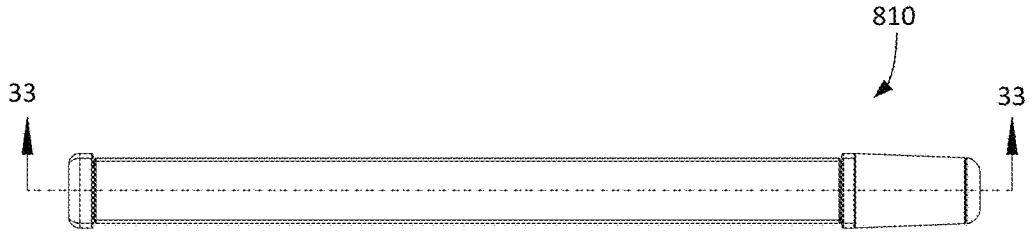
FIG. 32 is a top view of the grip.
Figure 33:
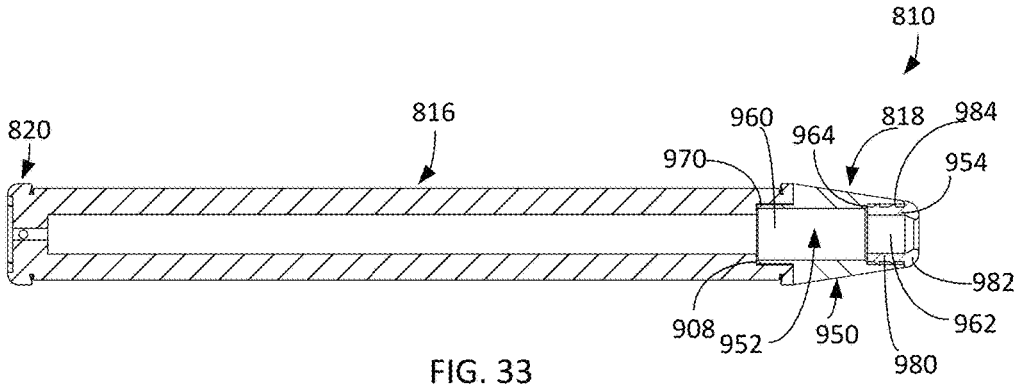
FIG. 33 is a cross-sectional view taken about line 33-33 in FIG. 32.
Figure 34:
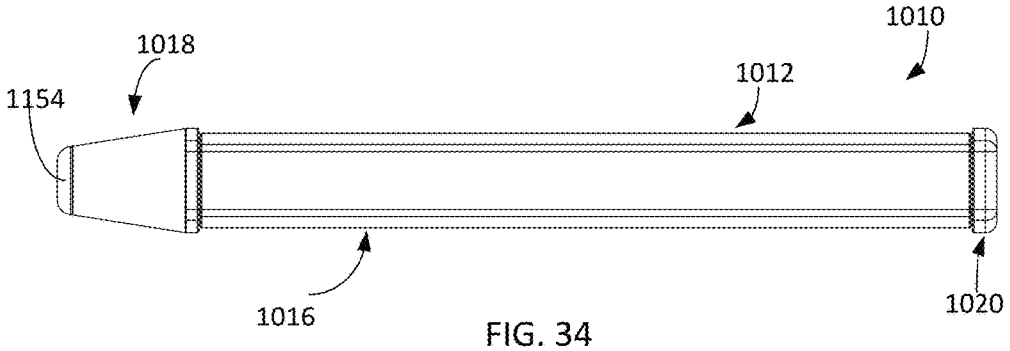
FIG. 34 is a front view of yet another exemplary golf club grip.
Figure 35:
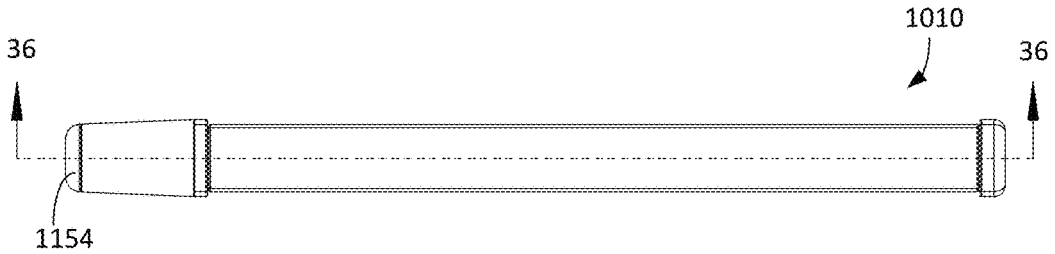
FIG. 35 is a top view of the grip.
Figure 36:
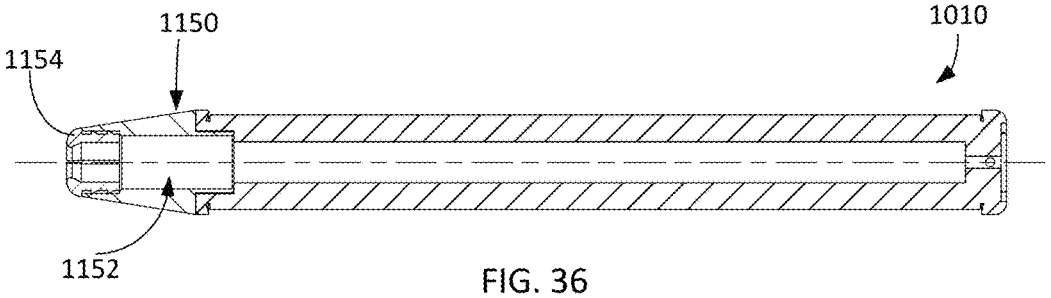
FIG. 36 is a cross-sectional view taken about line 36-36 in FIG. 35
Figure 37:
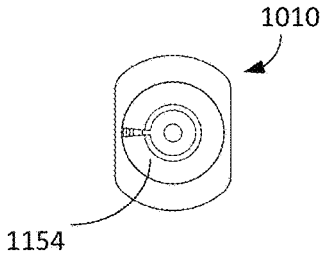
FIG. 37 is a right side view of the grip.
Figure 38:
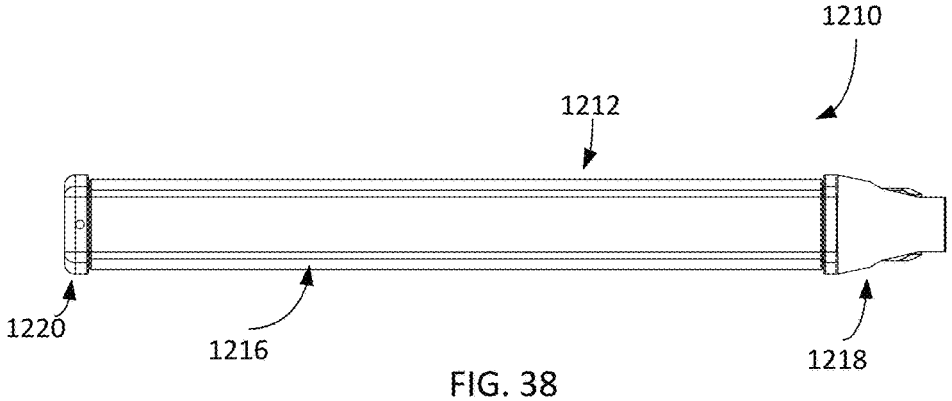
FIG. 38 is a rear view of still another exemplary golf club grip.
Figure 39:
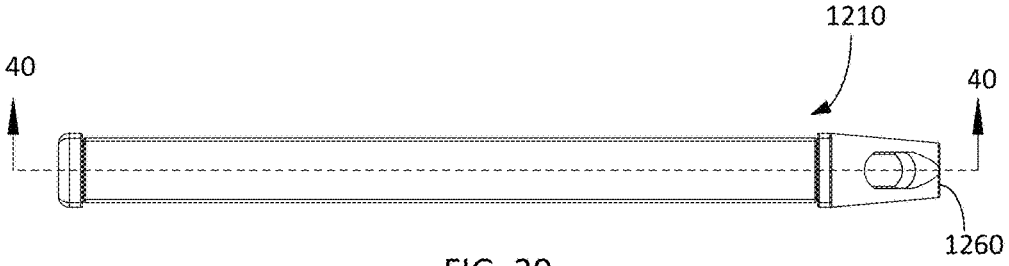
FIG. 39 is a top view of the grip.

Turning now to FIGS. 31-33, an exemplary embodiment of the golf club grip is shown at 810. The golf club grip 810 is substantially the same as the above-referenced golf club grip 10, and consequently the same reference numerals but indexed by 800 are used to denote structures corresponding to similar structures in the grips. In addition, the foregoing description of the golf club grip 10 is equally applicable to the golf club grip 810, except as noted below and illustrated in the figures.

The grip 810 includes a body 812 and a wrap (not shown) configured to surround the body 812. The body 812 includes a grip portion 816, a front portion 818, and a back portion 820. The grip portion 816 and back portion 820 can be formed as one piece, and the front portion 818 is formed as a separate piece that attaches to the grip portion 816.

The front portion 818 is weighted to provide a weighted golf grip with the weight below the golfer's hands. The front portion 818 includes a body 950 defining a bore 952 or axial passage extending the length of the front portion 818 and a spacer 954 disposed in the bore 952. The weighting of the front portion 818 is provided by the material of the body 950, which may be any suitable material, such as a suitable metal. The spacer 954 is configured to abut an outer surface of the shaft 52 and may be a suitable seal, such as an O-ring that seals to the shaft 52. The spacer 954 has a first portion 980 disposed in a second diameter portion 962 of the bore 952 and a second portion 982 that abuts an end face of the front portion 918 at the first end of the front portion and extends past the first end. The spacer 954 may be coupled to the body 950 in any suitable manner, such as one or more barbs 984 that engage the second diameter portion 962. The spacer 954 can be installed on the shaft 52 prior to the body 812, and after the body 812 is attached to the shaft 52, the spacer 954 is attached to the body 950. It will be appreciated that the spacer 954 could be attached to the body 812 prior to being installed on the shaft 52.

The bore 952 includes a first diameter portion 960 and the second diameter portion 962 larger than the first diameter portion 960. The bore 952 also includes a shoulder 964 between the first and second diameter portions 960 and 962 that is abutted by an end of the spacer 954.

The body 950 includes a first portion 970 disposed in a second diameter portion 906 of the grip portion 816 and a second portion 972 integral with the first portion 970 that abuts an end face of the grip portion 816 at the first end 830 and tapers away from the first end 830. The first portion 970 has an end face that abuts a shoulder 908 at the second end of the front portion 818 and may optionally include one or more slots similar to slots 174 extending longitudinally and/or one or more cut-outs similar to cut-outs 176.

Turning now to FIGS. 34-37, an exemplary embodiment of the golf club grip is shown at 1010. The golf club grip 1010 is substantially the same as the above-referenced golf club grip 810, and consequently the same reference numerals but indexed by 200 are used to denote structures corresponding to similar structures in the grips. In addition, the foregoing description of the golf club grip 810 is equally applicable to the golf club grip 1010, except as noted below and illustrated in the figures.

The grip 1010 includes a body 1012 and a wrap (not shown) configured to surround the body 1012. The body 1012 includes a grip portion 1016, a front portion 1018, and a back portion 1020. The front portion 1018 is weighted to provide a weighted golf grip with the weight below the golfer's hands. The front portion 1018 includes a body 1150 defining a bore 1152 or axial passage extending the length of the front portion 1018 and a spacer 1154 disposed in the bore 1152. The spacer 1154 is configured to abut an outer surface of the shaft 52 and may be a suitable seal, such as a split O-ring that seals to the shaft 52 and may be attached to the body 1150 before or after installation on the shaft 52.

Turning now to FIGS. 38-41, an exemplary embodiment of the golf club grip is shown at 1210. The golf club grip 1210 is substantially the same as the above-referenced golf club grip 10, and consequently the same reference numerals but indexed by 1200 are used to denote structures corresponding to similar structures in the grips. In addition, the foregoing description of the golf club grip 10 is equally applicable to the golf club grip 1210, except as noted below and illustrated in the figures.

The grip 1210 includes a body 1212 and a wrap (not shown) configured to surround the body 1212. The body 1212 includes a grip portion 1216, a front portion 1218, and a back portion 1220. The grip portion 1216, front portion 1218, and back portion 1220 can be formed as one piece and of any suitable material such as EVA foam injected into a mold.

The front portion 1218 includes one or more slots 1242 extending therethrough, and in the illustrated embodiment a pair of slots 1242 extending longitudinally through the front portion 1218 and into the grip portion 1216. The slots can be molded into the grip 1210 or cut into the grip after molding. The slots 1242 are each configured to receive one or more weights 1244 that weight the grip 1210 such that the weight of the part of the grip 1210 below the golfers hands, and in particular the portion of the grip portion 1216 and front portion 1218 where the weights 1244 are disposed, is greater than or equal to thirty percent of the total weight of the grip. In another embodiment the weight is greater than or equal to fifty percent of the total weight. The weights 1244 may be made of suitable material, such as metal, and may be secured in the slots 1242 in any suitable manner, such as adhesive, or alternatively may be removable form the slots 1242 to remove weight from the grip or allow for weights 1244 having various weights to be used. In an embodiment the weights 1244 may have the same weight as one another and in another embodiment they may have different weights. In an embodiment, the combined weight of the weights 1244 is greater than or equal to seventy-five grams. In another embodiment the combined weight of the weights 1244 is greater than or equal to one hundred grams. In another embodiment the combined weight of the weights 1244 is greater than or equal to one hundred ten grams.

Figure 40:
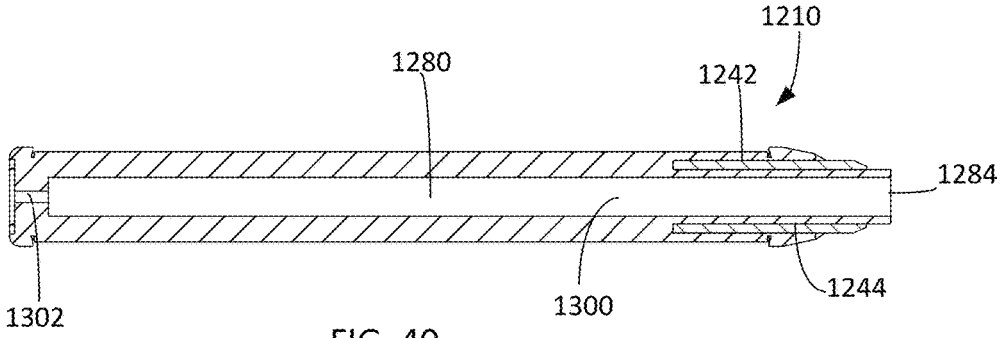
FIG. 40 is a cross-sectional view taken about line 40-40 in FIG. 39.
Figure 41:
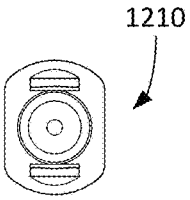
FIG. 41 is a right side view of the grip.
Figure 42:
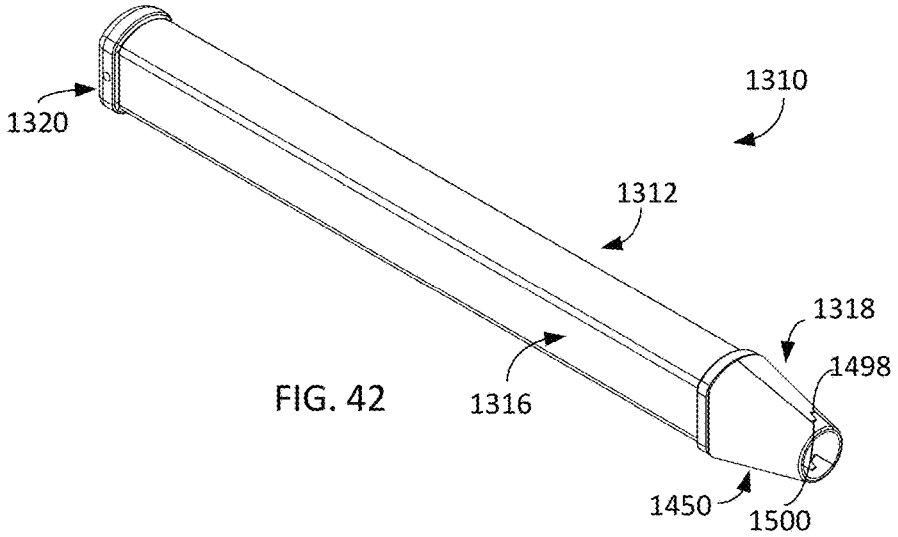
FIG. 42 is a perspective view of a further exemplary golf club grip.
Figure 43:
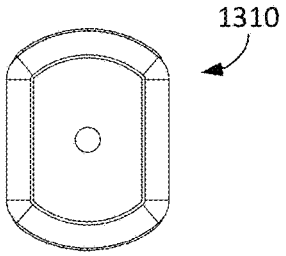
FIG. 43 is a left side view of the grip.
Figure 44:
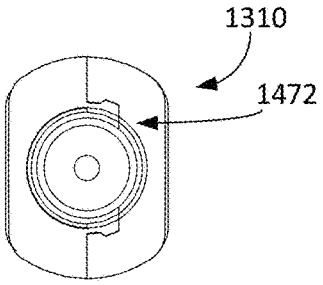
FIG. 44 is a right side view of the grip.
Figure 45:
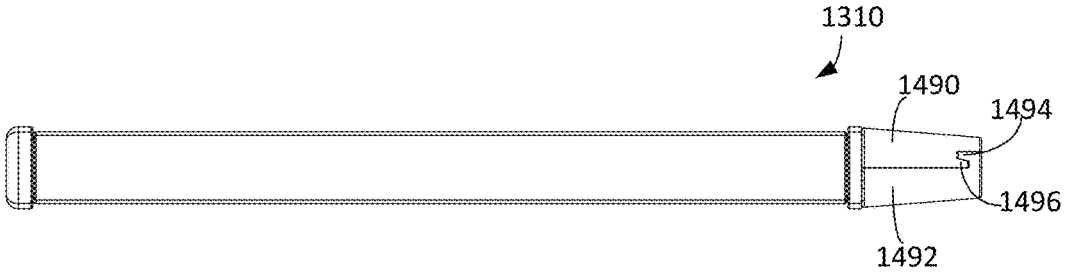
FIG. 45 is a top view of the grip.

As shown in FIG. 40, the body 1212 includes a bore 1280 or axial passage within the body 1212 and extending the length of the body 1212. The bore has a first end that opens to an opening 1284 at the first end 1260 of the front portion 1218, and a second end that is closed by a plug. The bore 1280 includes a first bore 1300 or axial passage extending longitudinally through the grip portion 1216 and front portion 1218 for receiving the shaft 52, and a second bore 1302 or axial passage extending longitudinally through a part of the grip portion 1216 and the back portion 1220.

Turning now to FIGS. 42-45, an exemplary embodiment of the golf club grip is shown at 1310. The golf club grip 1310 is substantially the same as the above-referenced golf club grip 10, and consequently the same reference numerals but indexed by 1300 are used to denote structures corresponding to similar structures in the grips. In addition, the foregoing description of the golf club grip 10 is equally applicable to the golf club grip 1310, except as noted below and illustrated in the figures.

The grip 1310 includes a body 1312 and a wrap (not shown) configured to surround the body 1312. The body 1312 includes a grip portion 1316, a front portion 1318, and a back portion 1320. The grip portion 1316 and back portion 1320 can be formed as one piece, and the front portion 1318 is formed as a separate piece that attaches to the grip portion 1316.

The front portion 1318 is weighted to provide a weighted golf grip with the weight below the golfer's hands. The front portion 1318 includes a body 1450 defining a bore 1452 or axial passage extending the length of the front portion 1318 and a spacer (not shown) disposed in the bore 1452.

The body 1450 includes first and second halves 1490 and 1492 each having one or more projections 1494 and 1496 respectively and slots 1498 and 1500 respectively that correspond to the slots and projections of the other to connect in a puzzle piece manner. Each of the first and second halves 1490 and 1492 has a first portion (not shown) disposed in the grip portion 1316 and a second portion 1472 integral with the first portion that abuts an end face of the grip portion 1316. The first portion of each of the first and second halves 1490 and 1492 may optionally include one or more slots similar to slots 174 extending longitudinally and/or one or more cut-outs similar to cut-outs 176.

Figure 46:
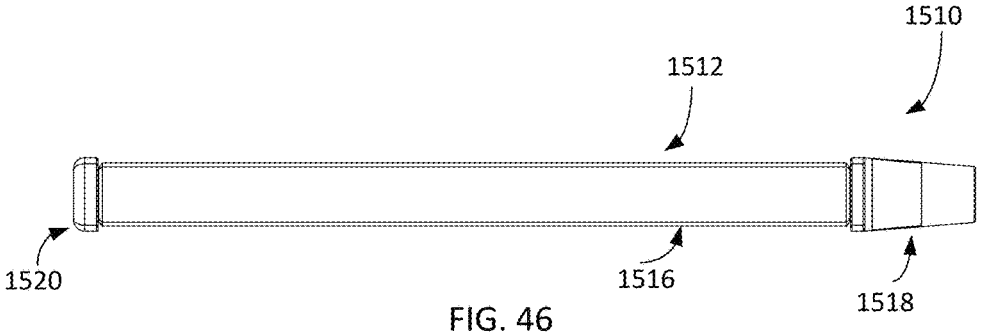
FIG. 46 is to view of another exemplary golf club grip.
Figure 47:
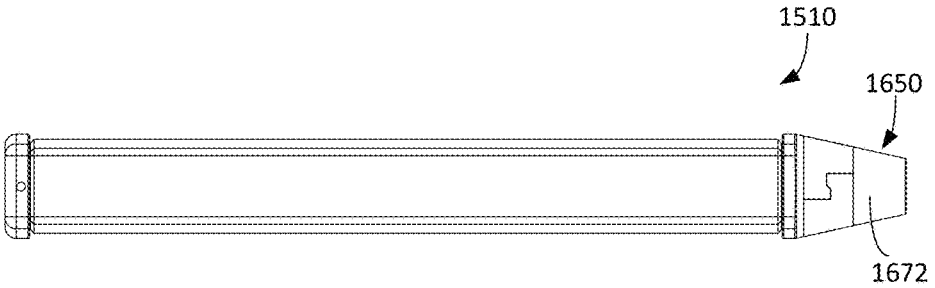
FIG. 47 is a rear view of the grip.
Figure 48:
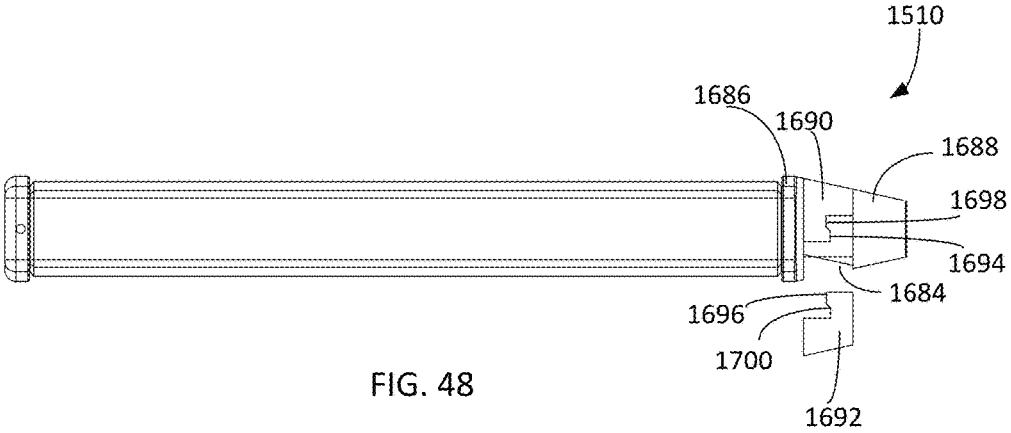
FIG. 48 is another rear view of the grip with a weight removed.
Figure 49:
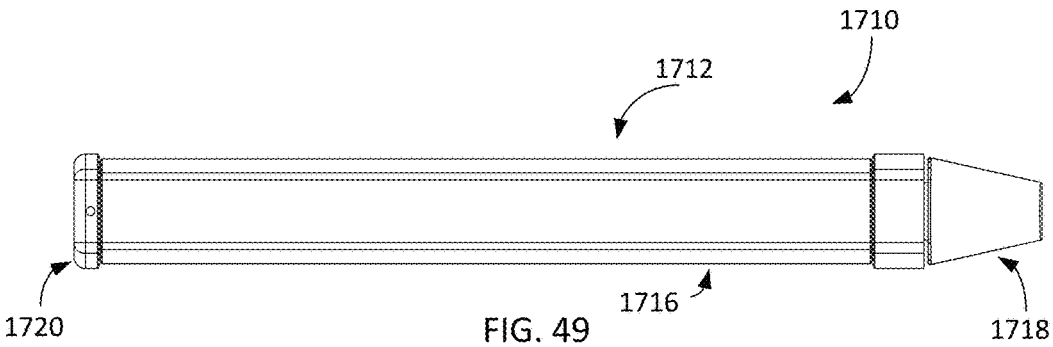
FIG. 49 is a rear view of yet another exemplary golf club grip.
Figure 50:
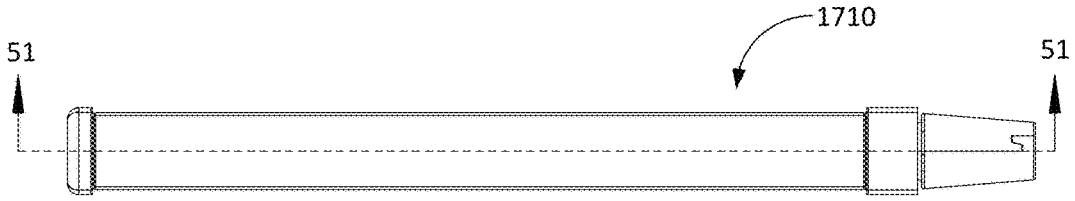
FIG. 50 is a top view of the grip.
Figure 51:
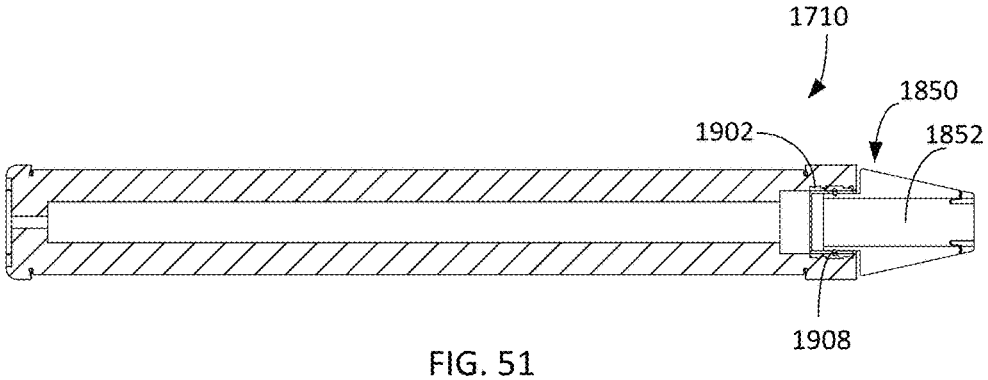
FIG. 51 is a cross-sectional view taken about line 51-51 in FIG. 50.
Figure 52:
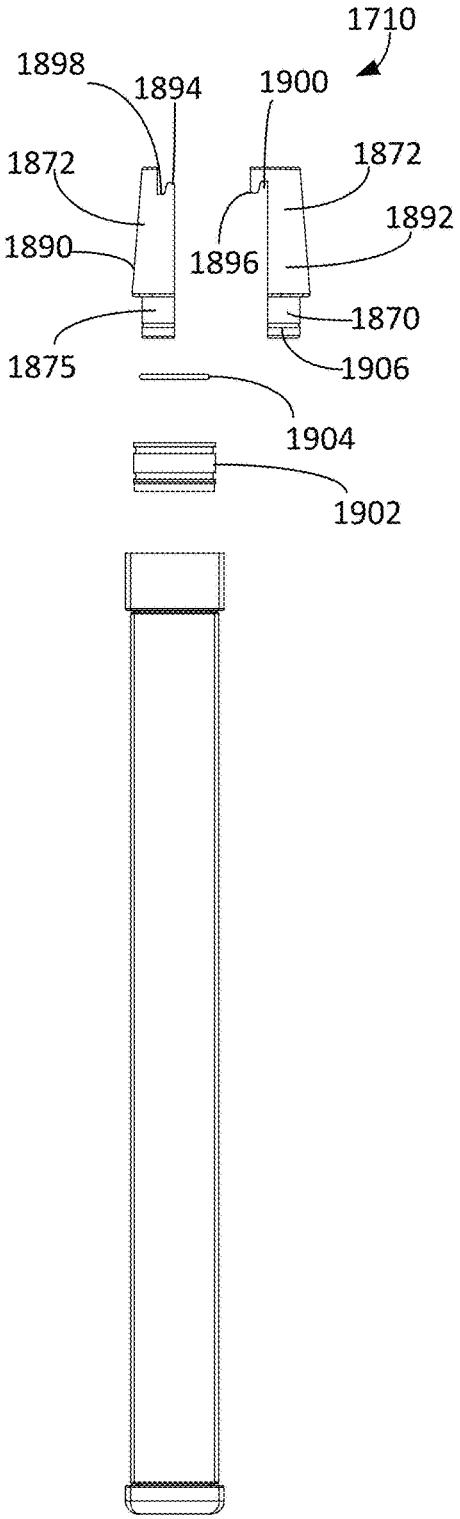
FIG. 52 is an exploded view of the grip.
Figure 53:
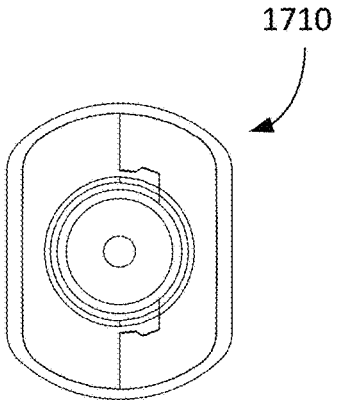
FIG. 53 is a right side view of the grip.
Figure 54:
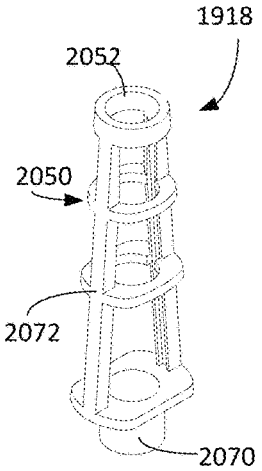
FIG. 54 is a perspective view of another exemplary front portion.
Figure 55:
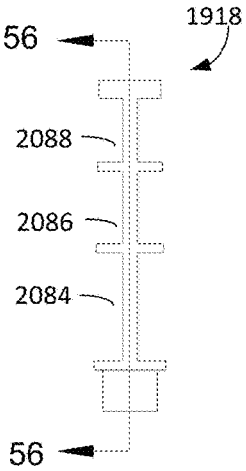
FIG. 55 is a top view of the grip.
Figure 56:
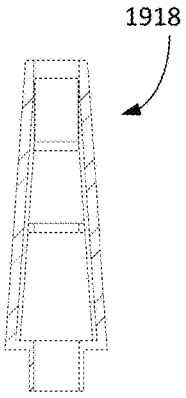
FIG. 56 is a cross-section view taken about line 56-56 in FIG. 55.
Figure 57:
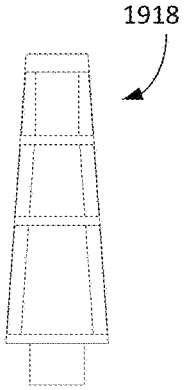
FIG. 57 is a rear view of the grip.

Turning now to FIGS. 46-48, an exemplary embodiment of the golf club grip is shown at 1510. The golf club grip 1510 is substantially the same as the above-referenced golf club grip 10, and consequently the same reference numerals but indexed by 1500 are used to denote structures corresponding to similar structures in the grips. In addition, the foregoing description of the golf club grip 10 is equally applicable to the golf club grip 1510, except as noted below and illustrated in the figures.

The grip 1510 includes a body 1512 and a wrap (not shown) configured to surround the body 1512. The body 1512 includes a grip portion 1516, a front portion 1518, and a back portion 1520. The grip portion 1516 and back portion 1520 can be formed as one piece, and the front portion 1518 is formed as a separate piece that attaches to the grip portion 1516.

The front portion 1518 is weighted to provide a weighted golf grip with the weight below the golfer's hands. The front portion 1518 includes a body 1650 defining a bore (not shown) or axial passage extending the length of the front portion 1518 and a spacer (not shown) disposed in the bore. The body 1650 includes a first portion (not shown) disposed in the grip portion 1516 and a second portion 1672 integral with the first portion that abuts an end face of the grip portion 1516. The first portion may optionally include one or more slots similar to slots 174 extending longitudinally and/or one or more cut-outs similar to cut-outs 176.

The second portion 1672 has a gap 1684 between first and second portions 1686 and 1688 of the second portion. The gap 1684 receives first and second weights 1690 and 1692 that snap together to add weight to the front portion 1518. The weights 1690 and 1692 each have one or more projections 1694 and 1696 respectively and slots 1698 and 1700 respectively that correspond to the slots and projections of the other to connect in a puzzle piece manner. The body 1650 is made of a suitable material, such as plastic, and the weights may be made of a suitable material, such as metal.

Turning now to FIGS. 49-53, an exemplary embodiment of the golf club grip is shown at 1710. The golf club grip 1710 is substantially the same as the above-referenced golf club grip 10, and consequently the same reference numerals but indexed by 1700 are used to denote structures corresponding to similar structures in the grips. In addition, the foregoing description of the golf club grip 10 is equally applicable to the golf club grip 1710, except as noted below and illustrated in the figures.

The grip 1710 includes a body 1712 and a wrap (not shown) configured to surround the body 1712. The body 1712 includes a grip portion 1716, a front portion 1718, and a back portion 1720. The grip portion 1716 and back portion 1720 can be formed as one piece, and the front portion 1718 is formed as a separate piece that attaches to the grip portion 1716.

The front portion 1718 is weighted to provide a weighted golf grip with the weight below the golfer's hands. The front portion 1718 includes a body 1850 defining a bore 1852 or axial passage extending the length of the front portion 1718. An optional spacer may be disposed in the bore 1852.

The body 1850 includes first and second halves 1890 and 1892 each having one or more projections 1894 and 1896 respectively and slots 1898 and 1900 respectively that correspond to the slots and projections of the other to connect in a puzzle piece manner. Each of the first and second halves 1890 and 1892 has a first portion 1870 disposed in the grip portion 1716 and a second portion 1872 integral with the first portion 1870 that abuts an end face of the grip portion 1716.

The front portion 1718 also includes an insert 1902 that is molded into the grip portion 1716, such as by overmolding, and a ring 1904, such as a snap ring that is received in a groove 1906 in an outer surface of the first and second halves 1890 and 1892 and a groove 1908 on an inner surface of the insert 1902. The ring 1904 holds the halves 1890 and 1892 within the grip portion 1716.

Turning now to FIGS. 54-59, an exemplary embodiment of the front portion is shown at 1918. The front portion 1918 is substantially the same as the above-referenced front portion 18, and consequently the same reference numerals but indexed by 1900 are used to denote structures corresponding to similar structures in the front portions. In addition, the foregoing description of the front portion 18 is equally applicable to the front portion 1918 except as noted below and illustrated in the figures.

Figure 58:
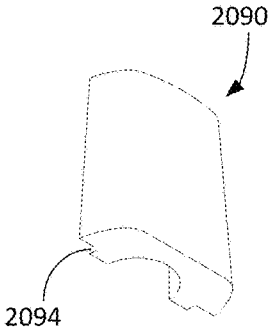
FIG. 58 is a perspective view of a weight.
Figure 59:
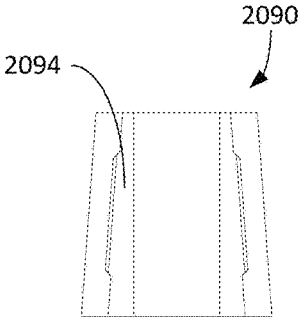
FIG. 59 is a front view of a weight.
Figure 60:
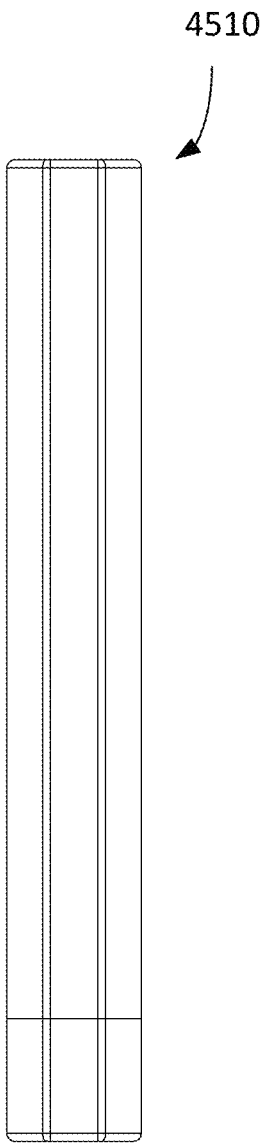
FIGS. 60-65 show another weighted golf club grip with a substantially round cross-section with a flat.
Figure 61:
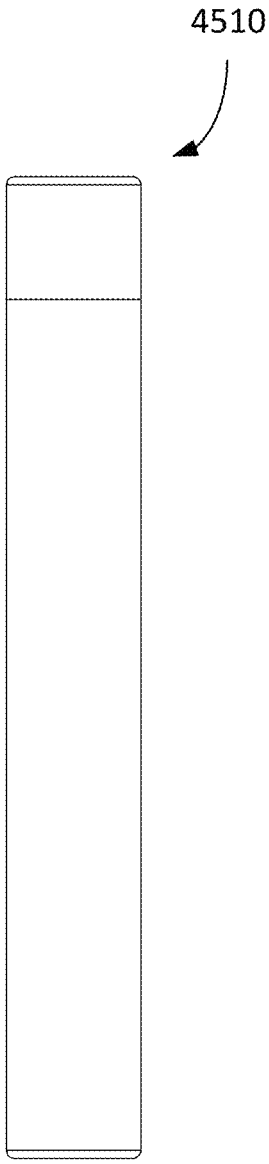
Figure 62:
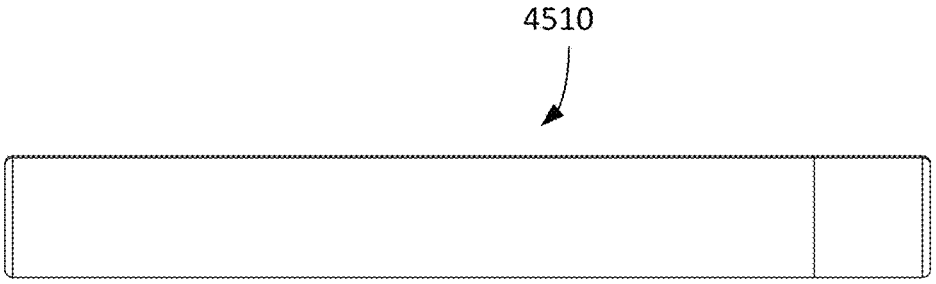
Figure 63:
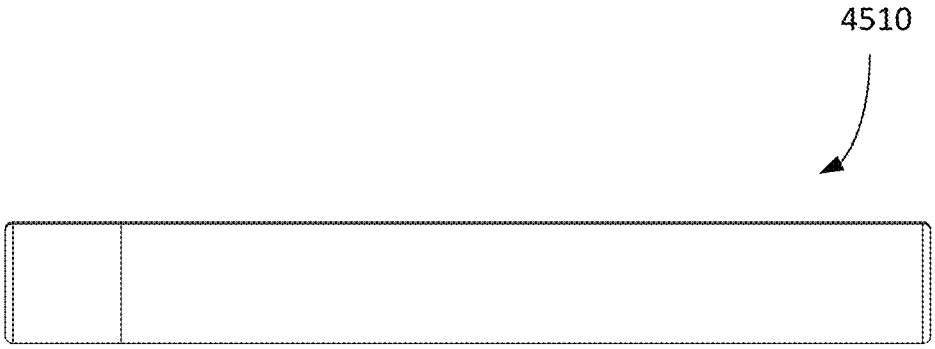
Figure 64:
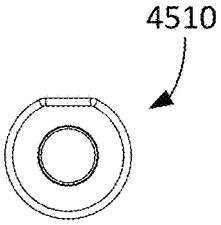
Figure 65:
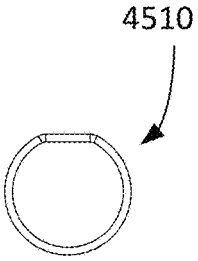
Figure 66:
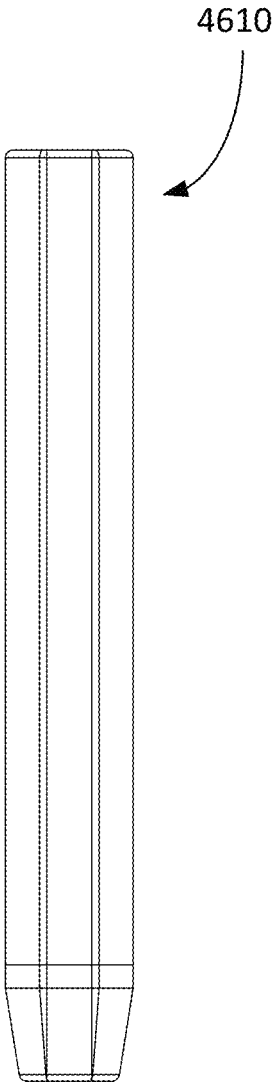
FIGS. 66-71 show still another weighted golf club grip with a substantially round cross-section with a flat and a tapering front portion.
Figure 67:
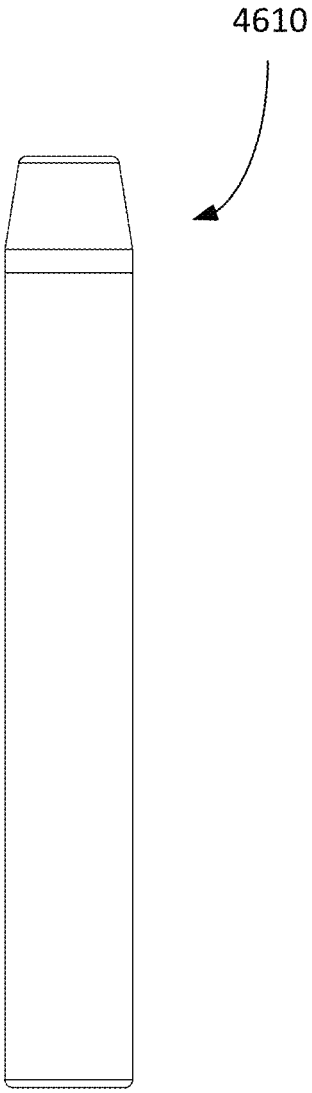
Figure 68:
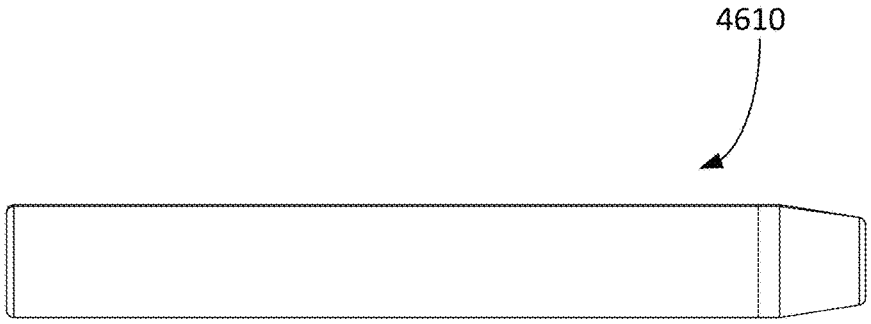
Figure 69:
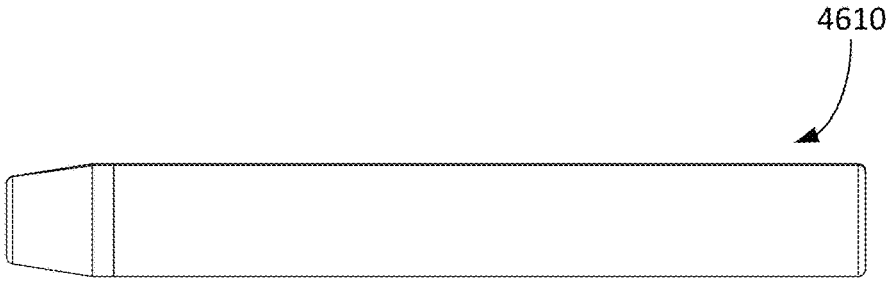
Figure 70:
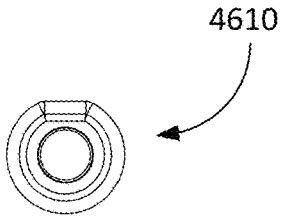
Figure 71:
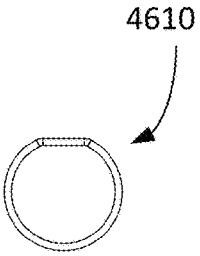
Figure 72:
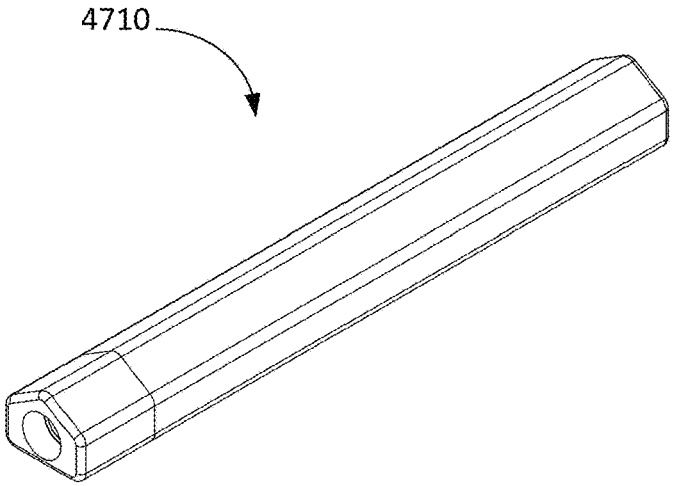
FIGS. 72-78 show yet another weighted golf club grip with an irregular pentagon cross-section.
Figure 73:
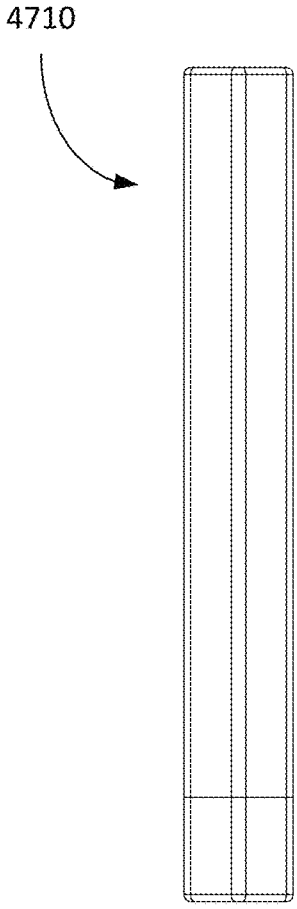
Figure 74:
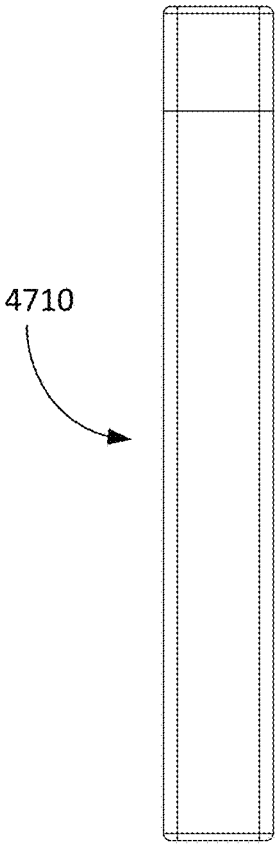
Figure 75:
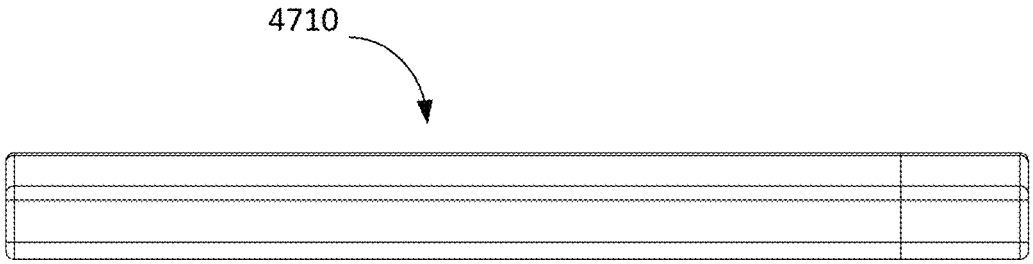
Figure 76:
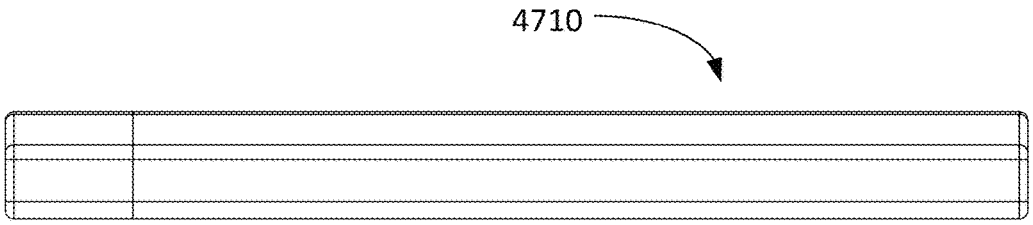
Figure 77:
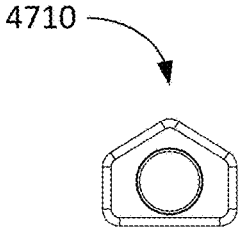
Figure 78:
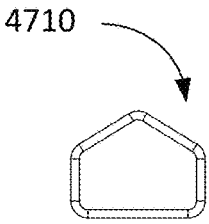
Figure 79:
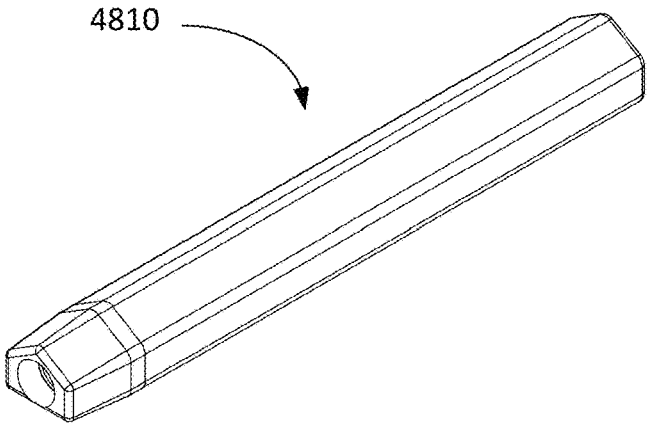
FIGS. 79-85 show a further weighted golf club grip with an irregular pentagon cross-section and a tapering front portion.
Figure 80:
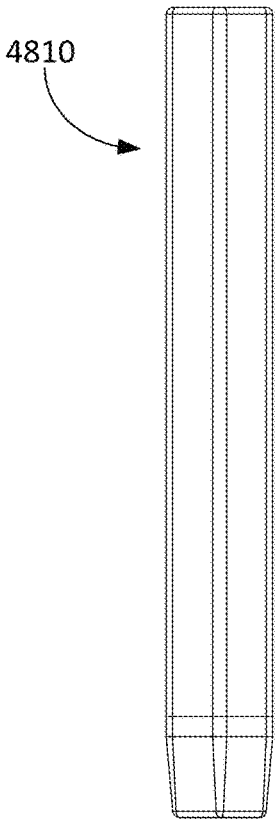
Figure 81:
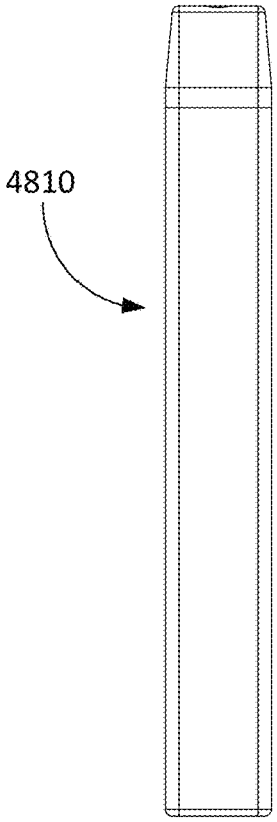
Figure 82:
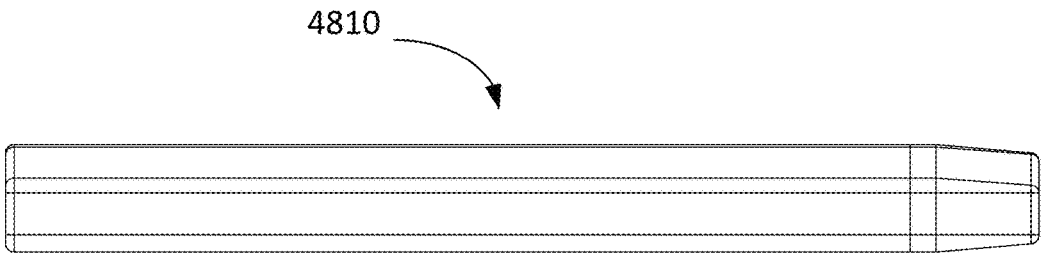
Figure 83:
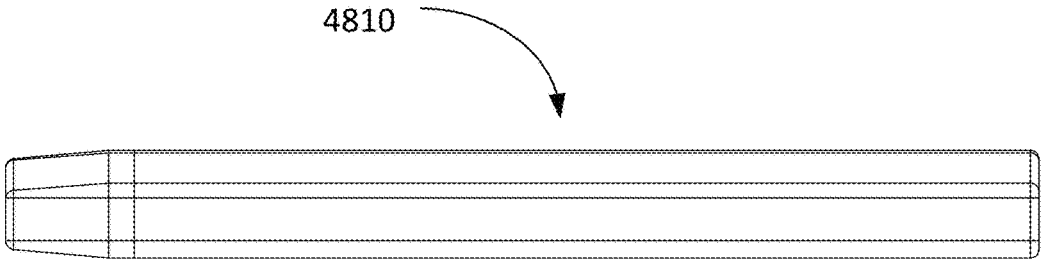
Figure 84:
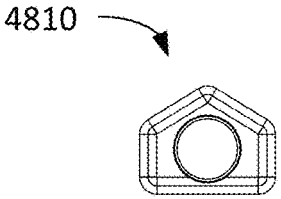
Figure 85:
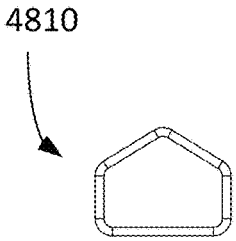
Figure 86:
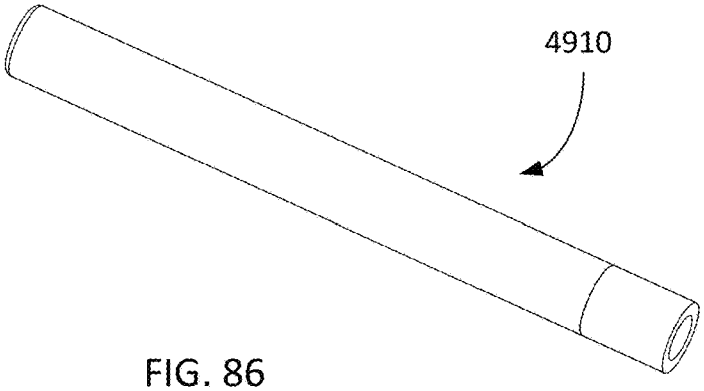
FIGS. 86-89 show another weighted golf club grip with a round cross-section.
Figure 87:
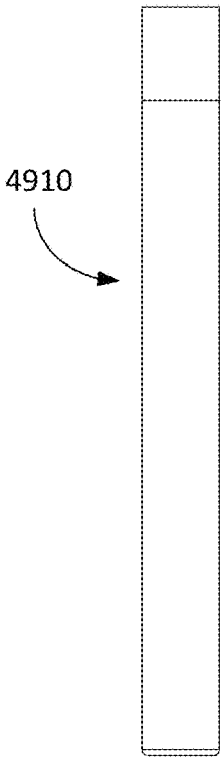
Figure 88:
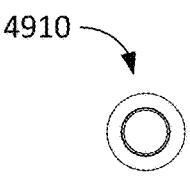
Figure 89:
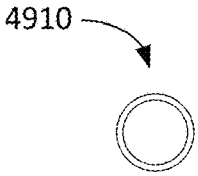
Figure 90:
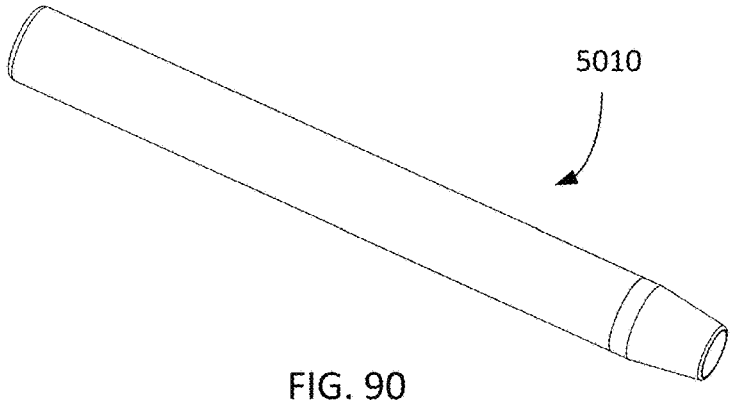
FIGS. 90-93 show yet another weighted golf club grip with a round cross-section and a tapering front portion.
Figure 91:
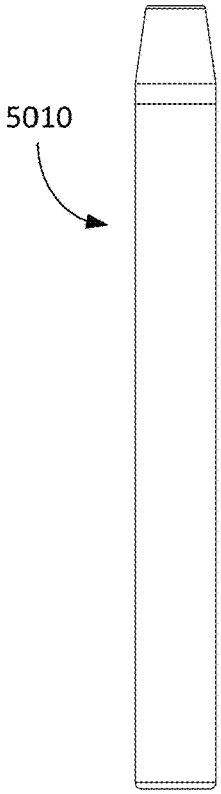
Figure 92:
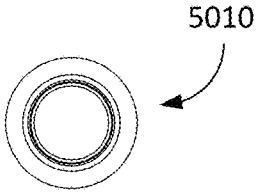
Figure 93:
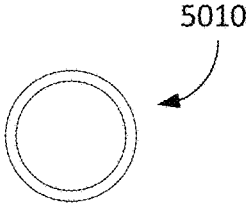
Figure 94:
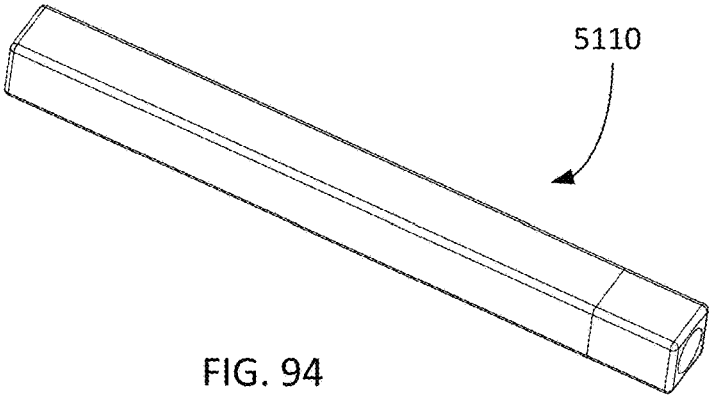
FIGS. 94-97 show still another weighted golf club grip with a square cross-section.
Figure 95:
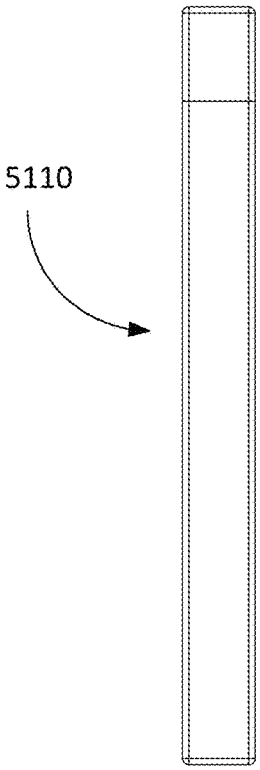
Figure 96:
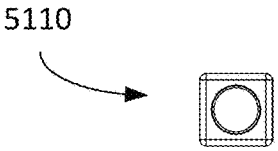
Figure 97:
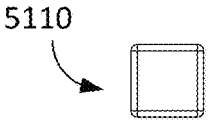
Figure 98:
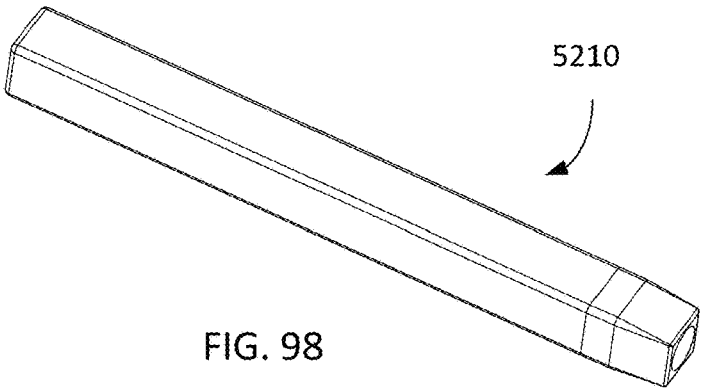
FIGS. 98-101 show a further weighted golf club grip with a square cross-section and a tapering front portion.
Figure 99:
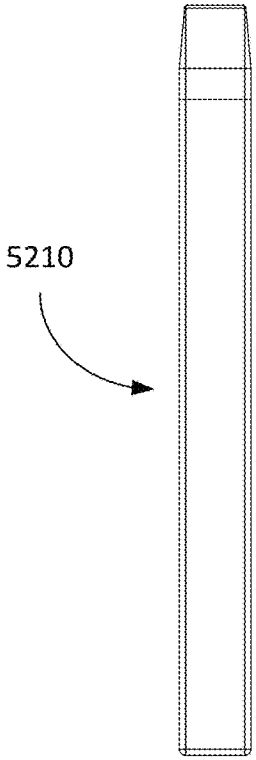
Figure 100:
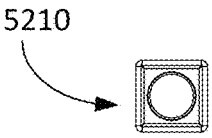
Figure 101:
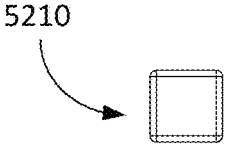
Figure 102:
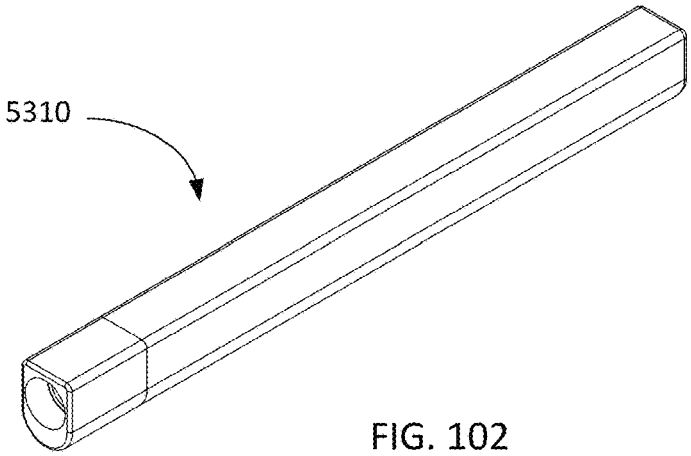
FIGS. 102-108 show a further weighted golf club grip with a tear drop cross-section.
Figure 103:
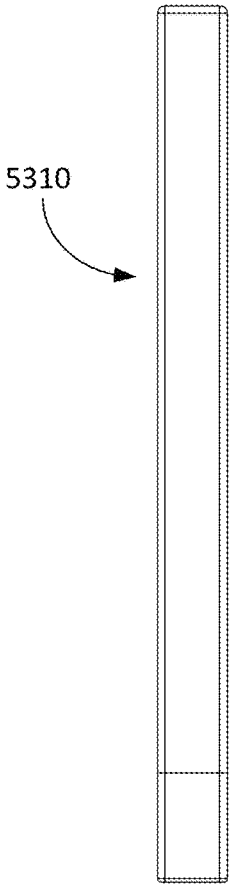
Figure 104:
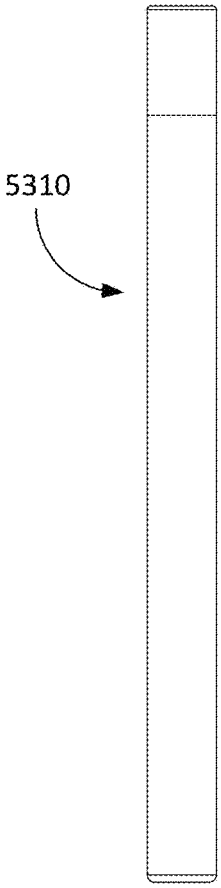
Figure 105:
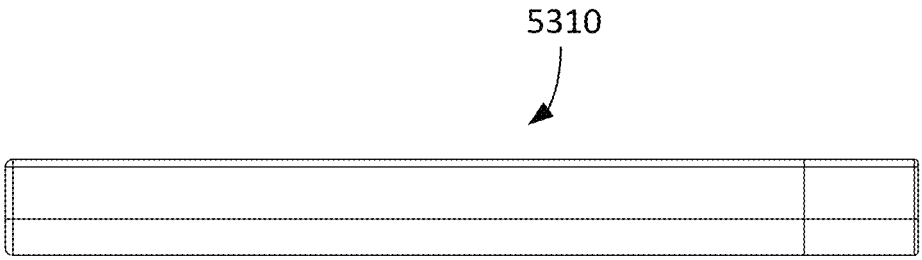
Figure 106:
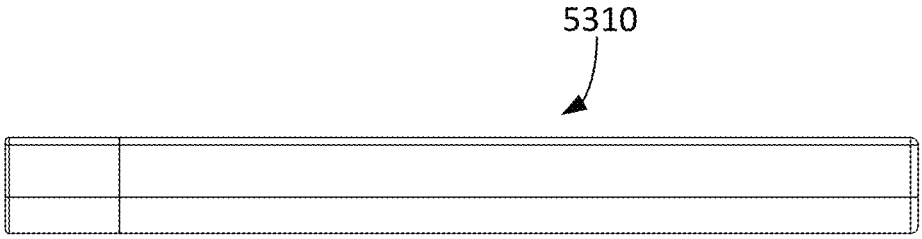
Figure 107:
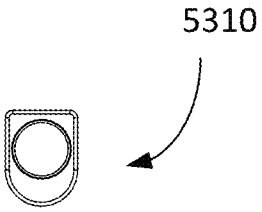
Figure 108:
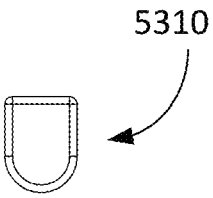
Figure 109:
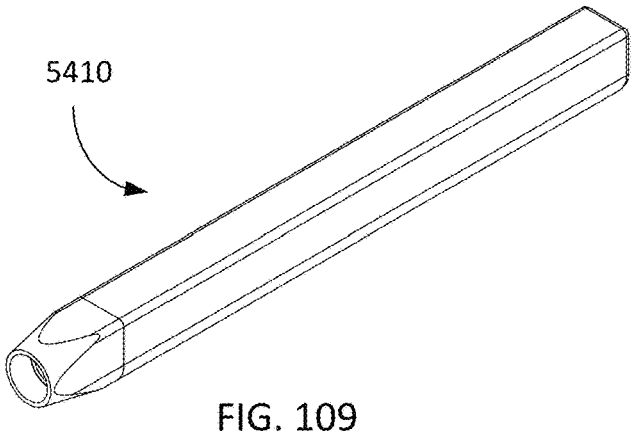
FIGS. 109-115 show a further weighted golf club grip with a tear drop cross-section and a tapering front portion.
Figure 110:
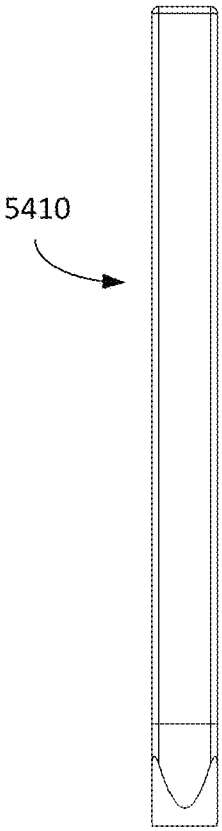
Figure 111:
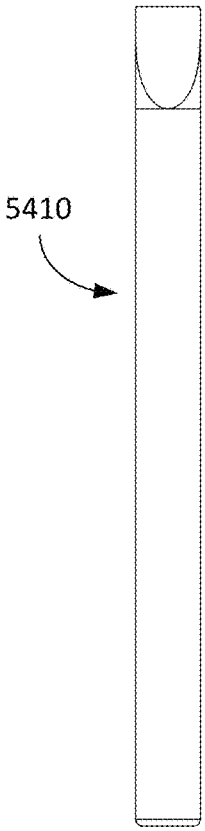
Figure 112:
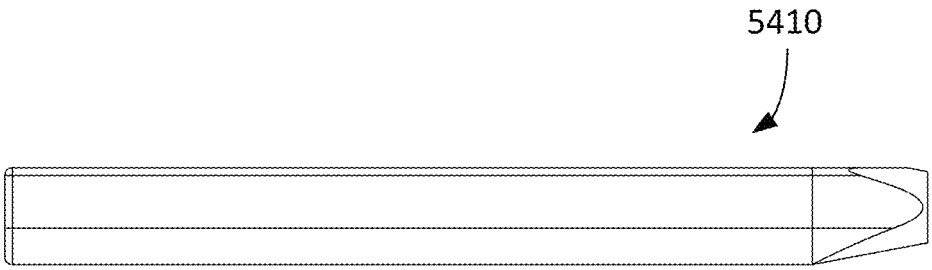
Figure 113:
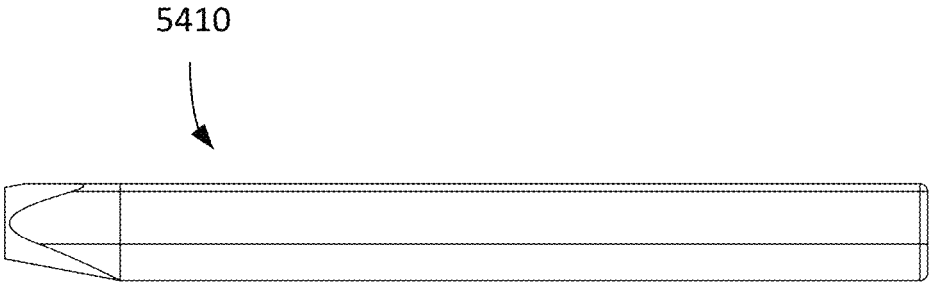
Figure 114:
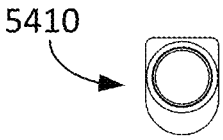
Figure 115:
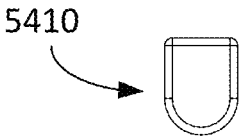
Figure 116:
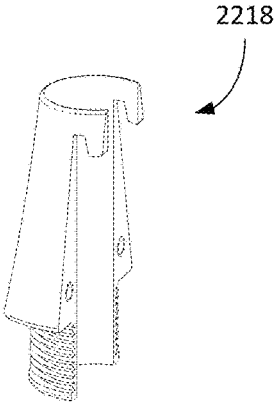
FIG. 116 is a perspective view of another exemplary front portion.
Figure 117:
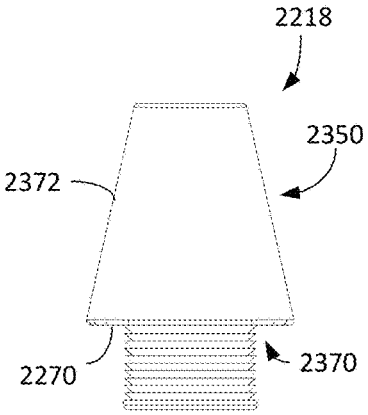
FIG. 117 is a top view of the front portion.
Figure 118:
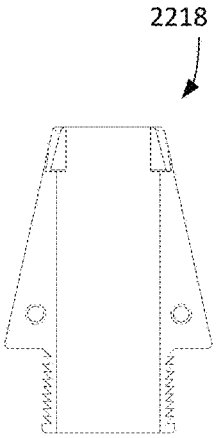
FIG. 118 is a bottom view of the front portion of FIG. 116.
Figure 119:
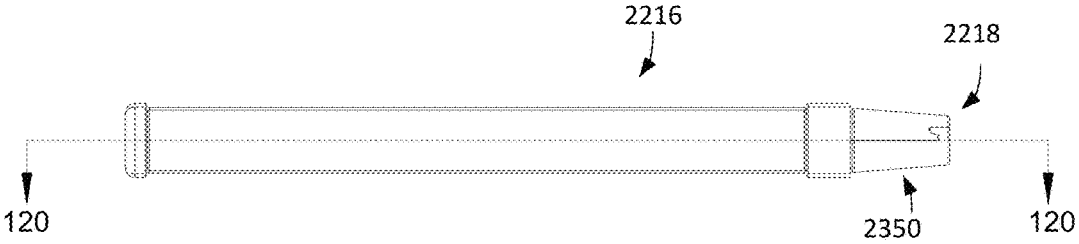
FIG. 119 is a top view of still another exemplary grip and front portion.
Figure 120:
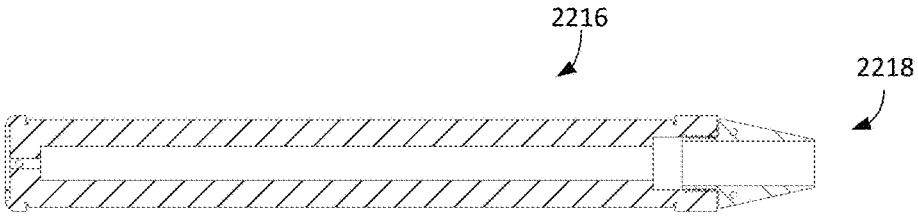
FIG. 120 is a cross-sectional view taken about line 120-120 in FIG. 119.

The front portion 1918 includes a body 2050 defining a bore 2052 or axial passage extending the length of the front portion 2018. The body 2050 includes a first portion 2070 disposed in the grip portion 16 and a second portion 2072 integral with the first portion 2070 and tapering away from the first end of the grip portion 16. As shown in FIGS. 54-57, the front portion 1918 includes one or more openings, and in the illustrated embodiment a pair of openings 2084, a pair of openings 2086, and a pair of openings 2088 in the second portion 2072. As shown in FIGS. 58 and 59, each opening 2084, 2086, and 2088 receives a respective weight 2090. The body 2050 may be made of a suitable material, such as plastic, and the weight 2090 may be made of a suitable material, such as metal. The weights 2090 snap into the respective openings 2084, 2086, and 2088 and close the bore 2052 from the environment on the sides of the second portion 2072. In an embodiment, the weights may be removable to vary the weight of the grip 1910. In certain embodiments, multiple weights can be used and may be of varying sizes and/or weights. For example, weight 2090 can fit into opening 2084, a smaller weight can fit into opening 2086, and an even smaller weight can fit into opening 2088, although it will be appreciated that the weights may be the same size and may have the same or different weight. The weight 2090 has one or more projections 2094 that snap into the respective opening (e.g. 2084).

Turning now to FIGS. 60-65, an exemplary embodiment of the golf club grip is shown at 4510, the golf club grip 4510 has a substantially round cross-section with a flat. The golf club grip 4510 is substantially the same as the above-referenced golf club grip 10, and consequently the same reference numerals but indexed by 4500 are used to denote structures corresponding to similar structures in the grips. In addition, the foregoing description of the golf club grip 10 is equally applicable to the golf club grip 4510, except as illustrated in the figures.

Turning now to FIGS. 66-71, an exemplary embodiment of the golf club grip is shown at 4610. The golf club grip 4610 has a substantially round cross-section with a flat and a tapering front portion. The golf club grip 4610 is substantially the same as the above-referenced golf club grip 10, and consequently the same reference numerals but indexed by 4600 are used to denote structures corresponding to similar structures in the grips. In addition, the foregoing description of the golf club grip 10 is equally applicable to the golf club grip 4610, except as illustrated in the figures.

Turning now to FIGS. 72-78, an exemplary embodiment of the golf club grip is shown at 4710. The golf club grip 4710 has an irregular pentagon cross-section. The golf club grip is substantially the same as the above-referenced golf club grip 10, and consequently the same reference numerals but indexed by 4700 are used to denote structures corresponding to similar structures in the grips. In addition, the foregoing description of the golf club grip 10 is equally applicable to the golf club grip 4710, except as illustrated in the figures.

Turning now to FIGS. 79-85, an exemplary embodiment of the golf club grip is shown at 4810. The golf club grip 4810 has an irregular pentagon cross-section and a tapering front portion. The golf club grip 4810 is substantially the same as the above-referenced golf club grip 10, and consequently the same reference numerals but indexed by 4800 are used to denote structures corresponding to similar structures in the grips. In addition, the foregoing description of the golf club grip 10 is equally applicable to the golf club grip 4810, except as illustrated in the figures.

Turning now to FIGS. 86-89, an exemplary embodiment of the golf club grip is shown at 4910. The golf club grip 4910 has a round cross-section. The golf club grip 4910 is substantially the same as the above-referenced golf club grip 10, and consequently the same reference numerals but indexed by 4900 are used to denote structures corresponding to similar structures in the grips. In addition, the foregoing description of the golf club grip 10 is equally applicable to the golf club grip 4910, except as illustrated in the figures.

Turning now to FIGS. 90-93, an exemplary embodiment of the golf club grip is shown at 5010. The golf club grip 5010 has a round cross-section and a tapering front portion. The golf club grip 5010 is substantially the same as the above-referenced golf club grip 10, and consequently the same reference numerals but indexed by 5000 are used to denote structures corresponding to similar structures in the grips. In addition, the foregoing description of the golf club grip 10 is equally applicable to the golf club grip 5010, except as illustrated in the figures.

Turning now to FIGS. 94-97, an exemplary embodiment of the golf club grip is shown at 5110. The golf club grip 5110 has a square cross-section. The golf club grip 5110 is substantially the same as the above-referenced golf club grip 10, and consequently the same reference numerals but indexed by 5100 are used to denote structures corresponding to similar structures in the grips. In addition, the foregoing description of the golf club grip 10 is equally applicable to the golf club grip 5110, except as illustrated in the figures.

Turning now to FIGS. 98-101, an exemplary embodiment of the golf club grip is shown at 5210. The golf club grip 5210 has a square cross-section and a tapering front portion. The golf club grip 5210 is substantially the same as the above-referenced golf club grip 10, and consequently the same reference numerals but indexed by 5200 are used to denote structures corresponding to similar structures in the grips. In addition, the foregoing description of the golf club grip 10 is equally applicable to the golf club grip 5210, except as illustrated in the figures.

Turning now to FIGS. 102-108, an exemplary embodiment of the golf club grip is shown at 5310. The golf club grip 5310 has a tear drop cross-section. The golf club grip 5310 is substantially the same as the above-referenced golf club grip 10, and consequently the same reference numerals but indexed by 5300 are used to denote structures corresponding to similar structures in the grips. In addition, the foregoing description of the golf club grip 10 is equally applicable to the golf club grip 5310, except as illustrated in the figures.

Turning now to FIGS. 109-115, an exemplary embodiment of the golf club grip is shown at 5410. The golf club grip 5410 has a tear drop cross-section and a tapering front portion. The golf club grip 5410 is substantially the same as the above-referenced golf club grip 10, and consequently the same reference numerals but indexed by 5400 are used to denote structures corresponding to similar structures in the grips. In addition, the foregoing description of the golf club grip 10 is equally applicable to the golf club grip 5410, except as illustrated in the figures.

Turning now to FIGS. 116-120, an exemplary embodiment of the front portion is shown at 2218. The front portion 2218 is substantially the same as the above-referenced front portion 18, and consequently the same reference numerals but indexed by 2200 are used to denote structures corresponding to similar structures in the front portions. In addition, the foregoing description of the front portion 18 is equally applicable to the front portion 2218 except as noted below and illustrated in the figures.

The front portion 2218 includes a body 2350 defining a bore 2352 or axial passage extending the length of the front portion 2218. The weighting of the front portion 2218 is provided by the material of the body 2350, which may be any suitable material, such as a suitable metal. The body 2350 includes a first portion 2370 disposed in a second diameter portion of the grip portion 2216 and a second portion 2372 integral with the first portion 2370 having a shoulder 2270 that abuts an end face of the grip portion 2216 at the first end. The first portion 2370 has barbs on its outer surface that are pushed into the second diameter portion to hold the front portion 2218 to the grip portion 2216. It will be appreciated that the barbs may also be provided on the above described front portions.

Figure 121:
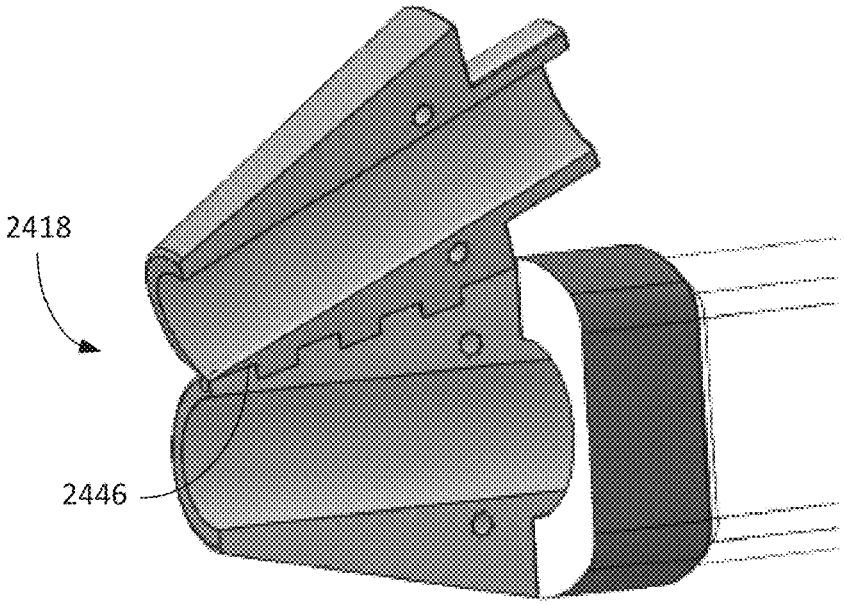
FIG. 121 is a perspective view of yet another exemplary front portion in an open configuration.
Figure 122:
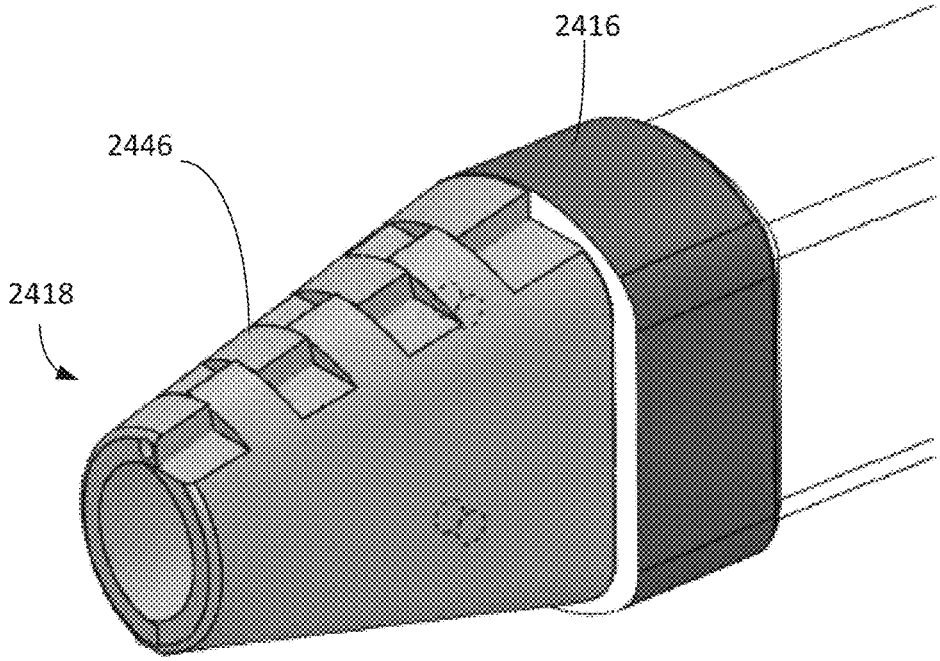
FIG. 122 is a perspective view of the front portion of FIG. 121 in a closed configuration.

Turning now to FIGS. 121 and 122, an exemplary embodiment of the front portion is shown at 2418. The front portion 2418 is substantially the same as the above-referenced front portion 18, and consequently the same reference numerals but indexed by 2400 are used to denote structures corresponding to similar structures in the front portions. In addition, the foregoing description of the front portion 18 is equally applicable to the front portion 2418 except as noted below and illustrated in the figures.

The front portion 2418 can be made of any suitable material, such as metal, and can have a hinge section 2446 connecting halves of the front portion 2418 allowing the front portion to be moved from an open configuration shown in FIG. 121 to a closed configuration shown in FIG. 122. In the open configuration the front portion can be positioned on a shaft of a golf club and then moved to the closed configuration to surround the shaft. The front portion can then be moved along the shaft until the front portion is received in the grip portion 2416 and secured in any suitable manner. In an embodiment the front portion can be removable, for example to use a differently weighted front portion, and slid away from the grip portion 2416 and moved to the open configuration. In an embodiment, the halves could be held closed by mechanical fasteners and positioned to abut the grip portion. Although FIG. 121 shows the front portion open and within the grip portion, this is for illustrative purposes only.

Figure 123:
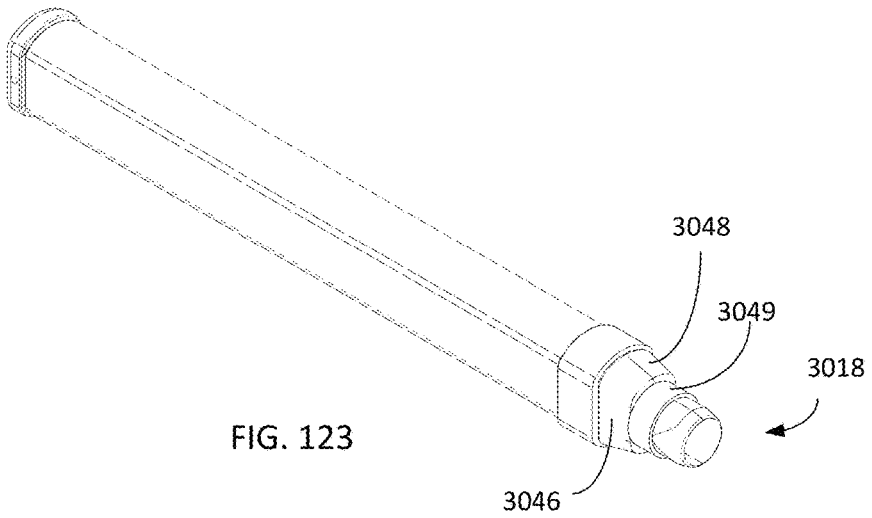
FIG. 123 is a perspective view of a further exemplary front portion and grip.
Figure 124:
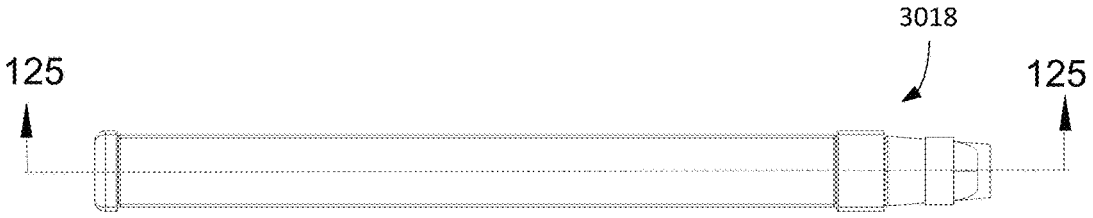
FIG. 124 is a top view of the front portion and grip.
Figure 125:
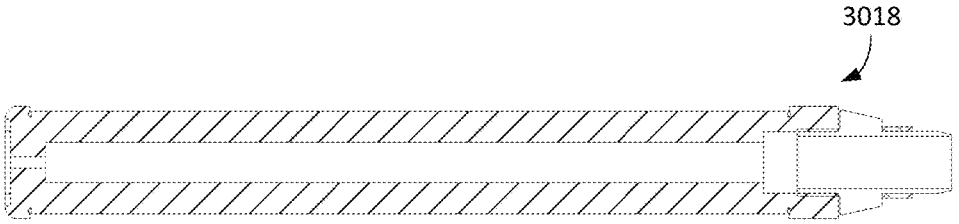
FIG. 125 is a cross-sectional view taken about line 125-125 in FIG. 124.

Turning now to FIGS. 123-125, an exemplary embodiment of the front portion is shown at 3018. The front portion 3018 is substantially the same as the above-referenced front portion 18, and consequently the same reference numerals but indexed by 3000 are used to denote structures corresponding to similar structures in the front portions. In addition, the foregoing description of the front portion 18 is equally applicable to the front portion 3018 except as noted below and illustrated in the figures.

The front portion 3018 includes weighted halves 3046 and 3048 that may be any suitable shape and made of a suitable material, such as metal. A sleeve 3049 surrounds the halves to hold them together. The sleeve may be any suitable shape, and in an embodiment is substantially cone shaped similar to the taper portion above.

Figure 126:
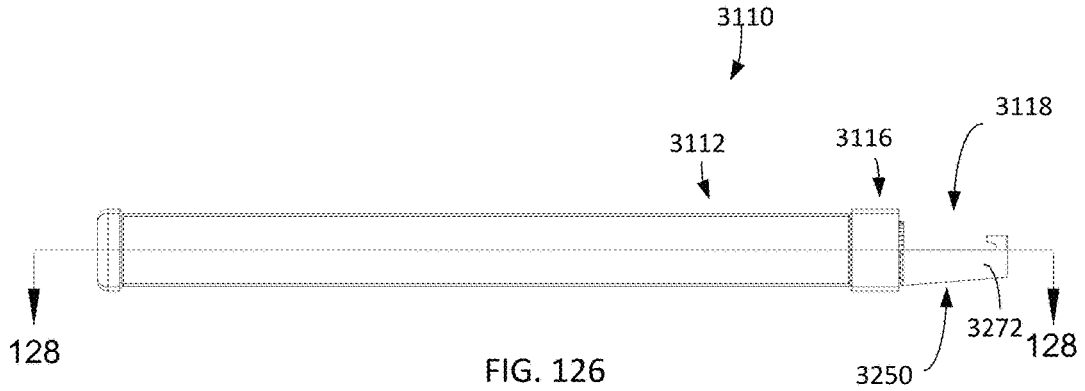
FIG. 126 is a top view of a further exemplary front portion and grip.
Figure 127:
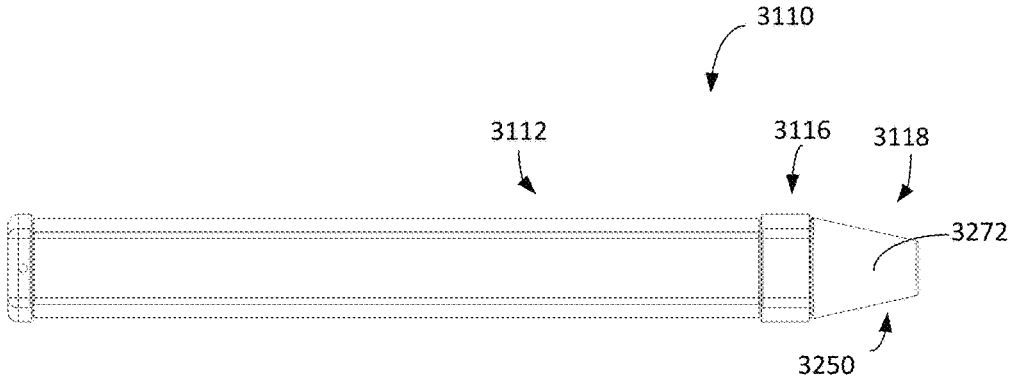
FIG. 127 is a rear view of the front portion and grip.
Figure 128:
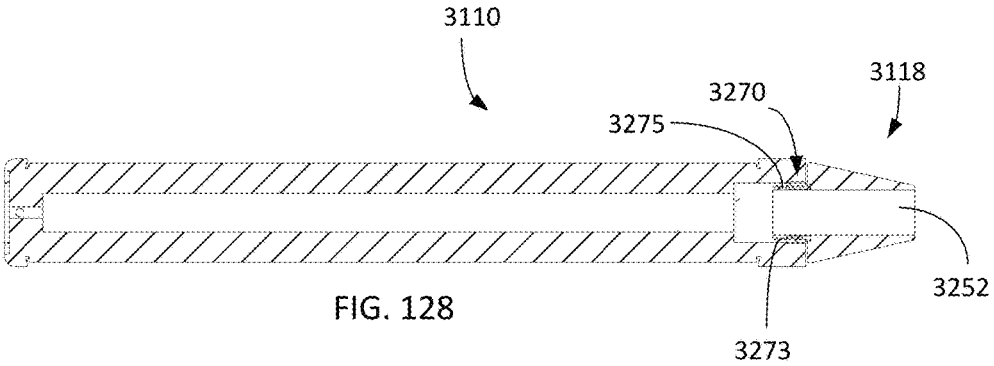
FIG. 128 is a cross-sectional view taken about line 128-128 in FIG. 126.

Turning now to FIGS. 126-128, an exemplary embodiment of the golf club grip is shown at 3110. The golf club grip 3110 is substantially the same as the above-referenced golf club grip 1310, and consequently the same reference numerals but indexed by 1800 are used to denote structures corresponding to similar structures in the grips. In addition, the foregoing description of the golf club grip 1310 is equally applicable to the golf club grip 3110, except as noted below and illustrated in the figures.

The grip 3110 includes a body 3112 including a grip portion 3116, a front portion 3118, and a back portion. The front portion 3118 is weighted to provide a weighted golf grip with the weight below the golfer's hands. The front portion 3118 includes a body 3250 defining a bore 3252 or axial passage extending the length of the front portion. The body 3250 includes a first portion 3270 configured to be disposed in the grip portion 3116 and a second portion 3272 integral with the first portion that abuts an end face of the grip portion. It will be appreciated that the body may include multiple second portions that connect to one another or a single portion. The first portion 3270 includes threads 3273 configured to mate with corresponding threads 3275 in the grip portion 3116. Alternatively, a quarter turn thread or a push and turn locking mechanism could be used.

Figure 129:
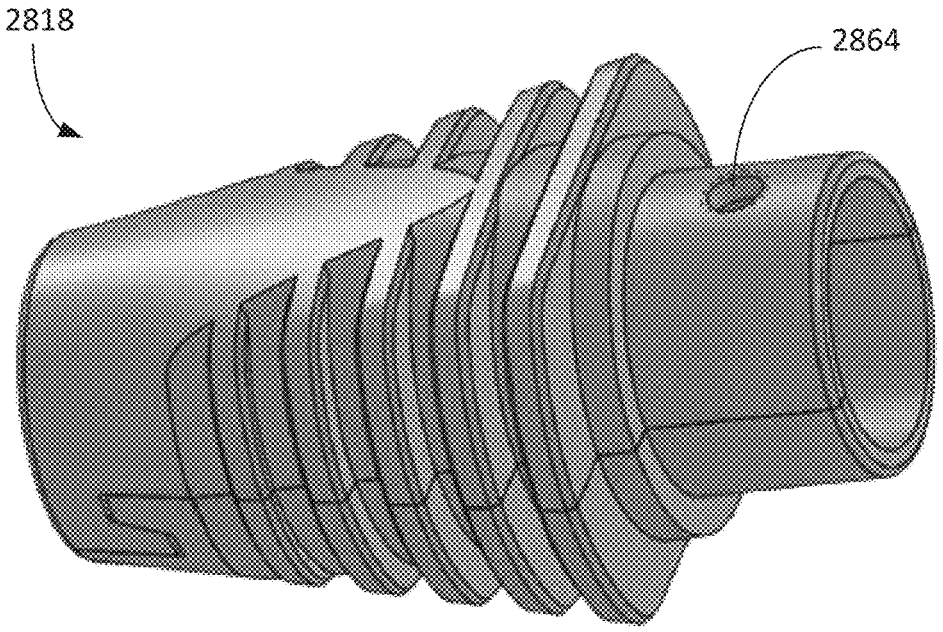
FIG. 129 is a perspective view of still another exemplary front portion.
Figure 130:
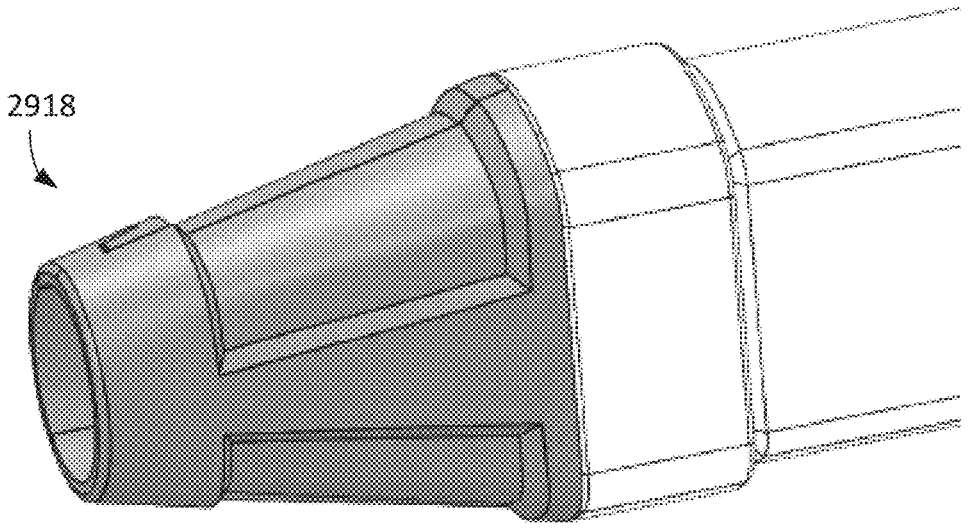
FIG. 130 is a perspective view of yet another exemplary front portion.
Figure 136:
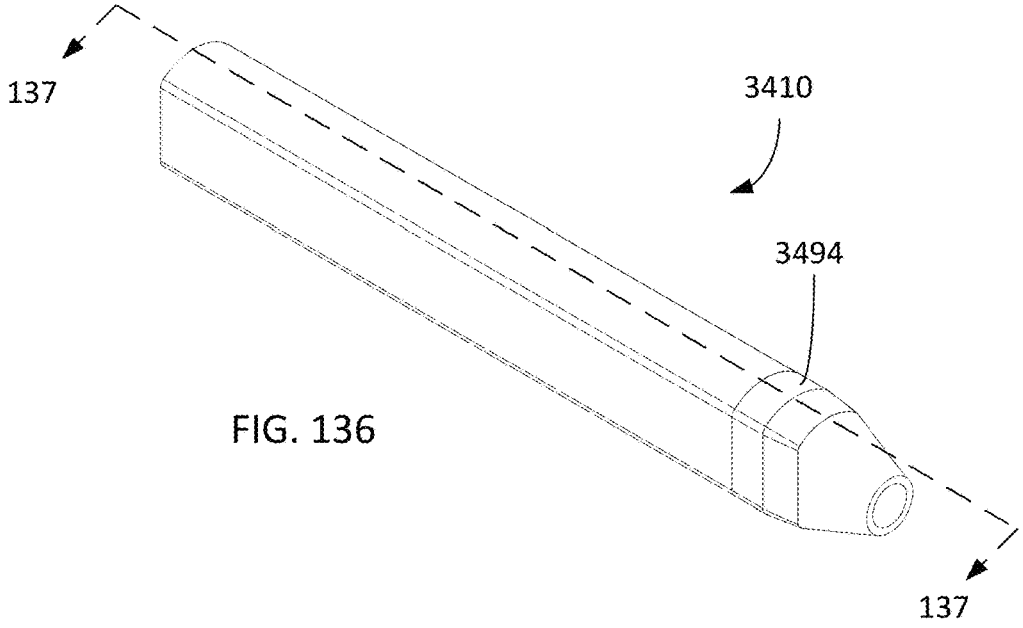
FIG. 136 is a perspective view of yet another exemplary golf club grip.
Figure 137:
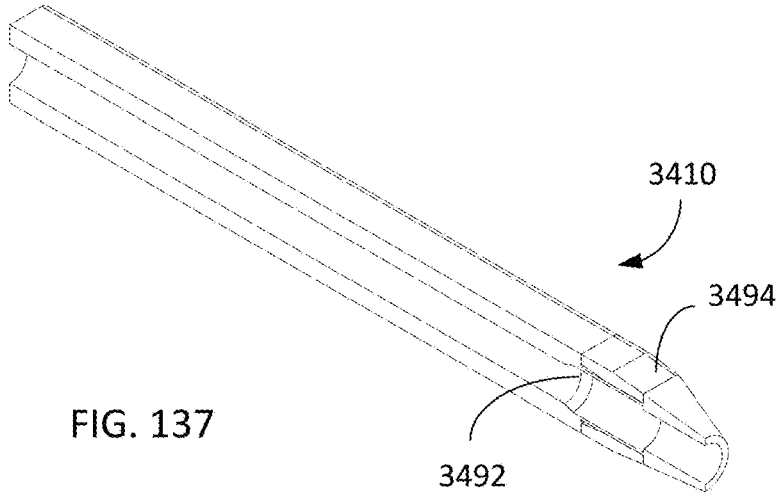
FIG. 137 is a cross-sectional view taken about line 137-137 in FIG. 136.
Figure 138:
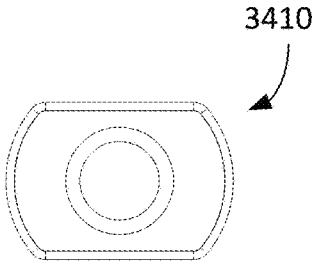
FIG. 138 is a right side view of the grip.
Figure 139:
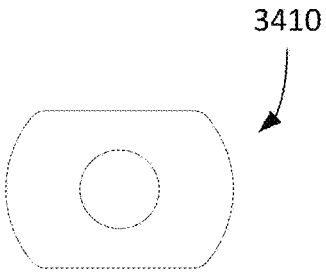
FIG. 139 is a left side view of the grip.
Figure 140:
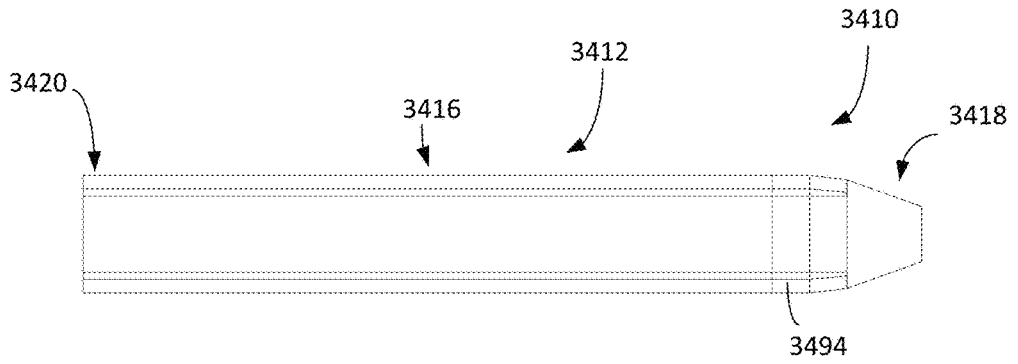
FIG. 140 is rear view of the grip.
Figure 141:
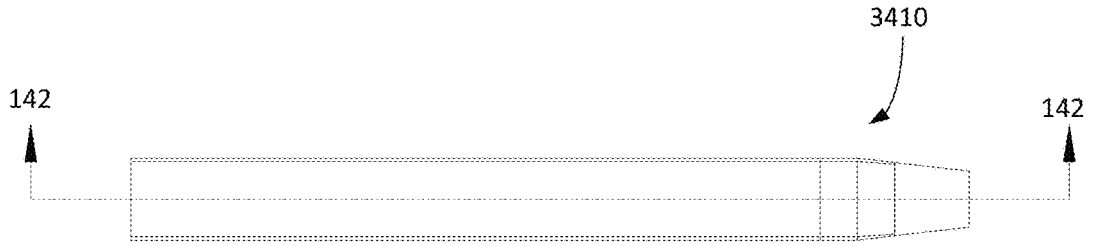
FIG. 141 is a top view of the grip.
Figure 142:
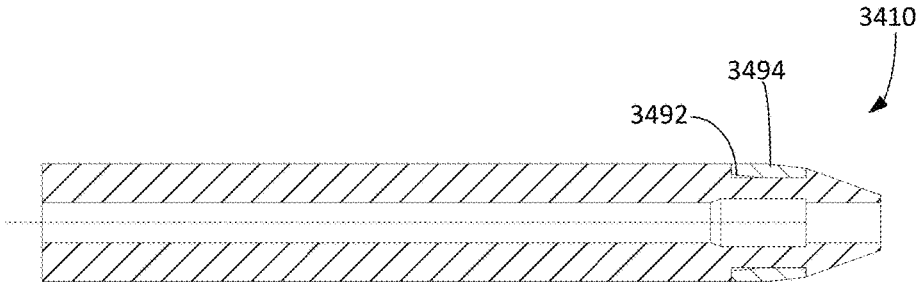
FIG. 142 is a cross-sectional view taken about line 142-142 in FIG. 141.
Figure 143:
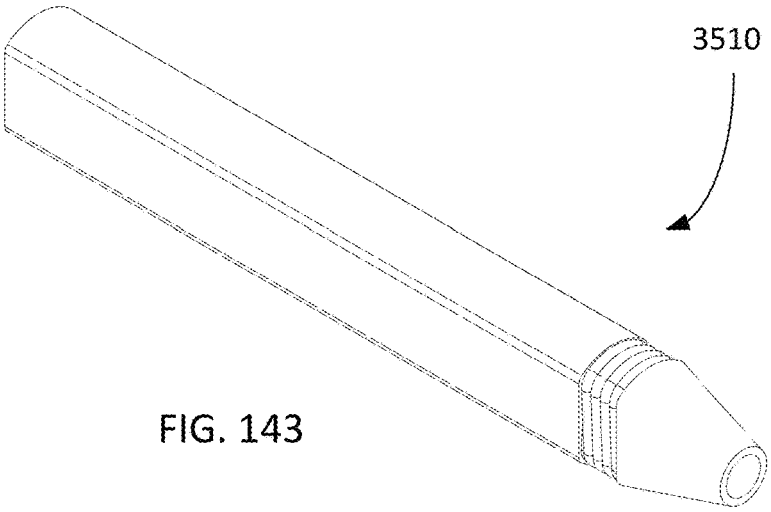
FIG. 143 is a perspective view of a further exemplary golf club grip.
Figure 144:
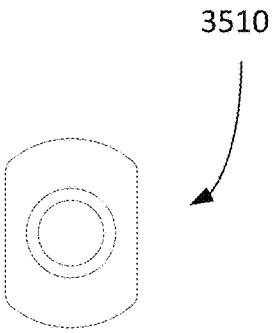
FIG. 144 is a right side view of the grip.
Figure 145:
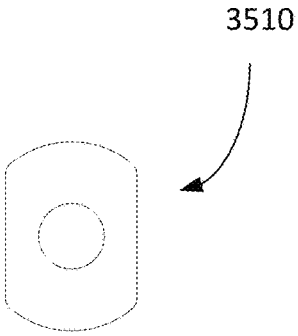
FIG. 145 is a left side view of the grip.
Figure 146:
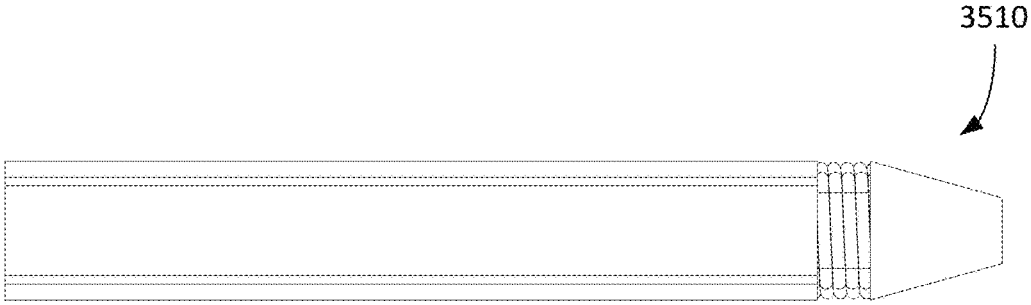
FIG. 146 is a rear view of the grip.
Figure 147:
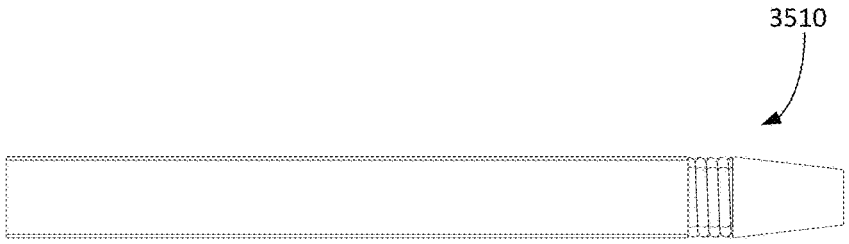
FIG. 147 is a top view of the grip.
Figure 148:
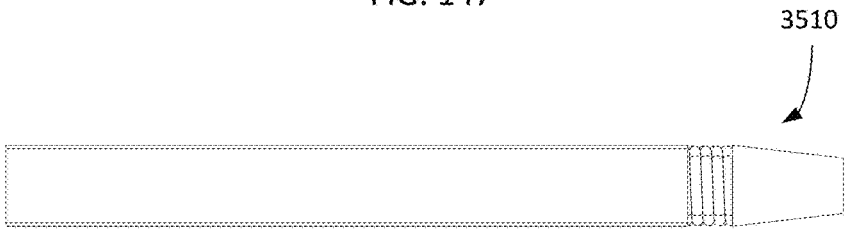
FIG. 148 is a bottom view of the grip.
Figure 149:
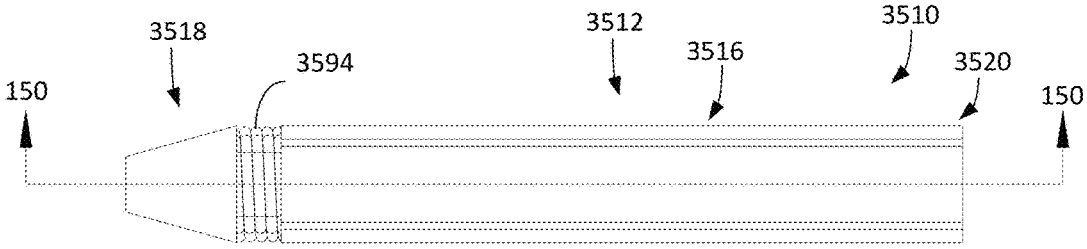
FIG. 149 is a front view of the grip.
Figure 150:
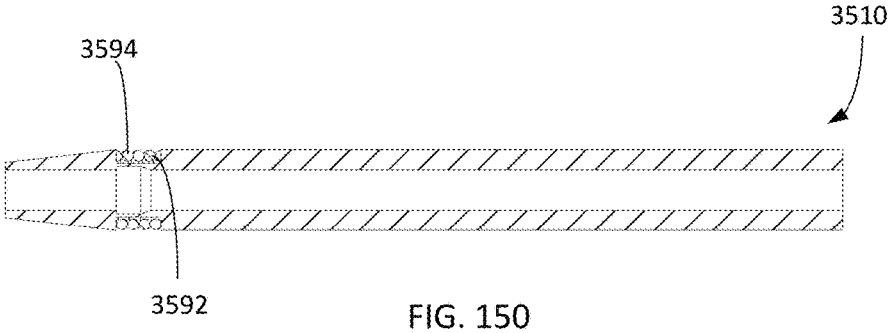
FIG. 150 is a cross-sectional view taken about line 150-150 in FIG. 149.
Figure 151:
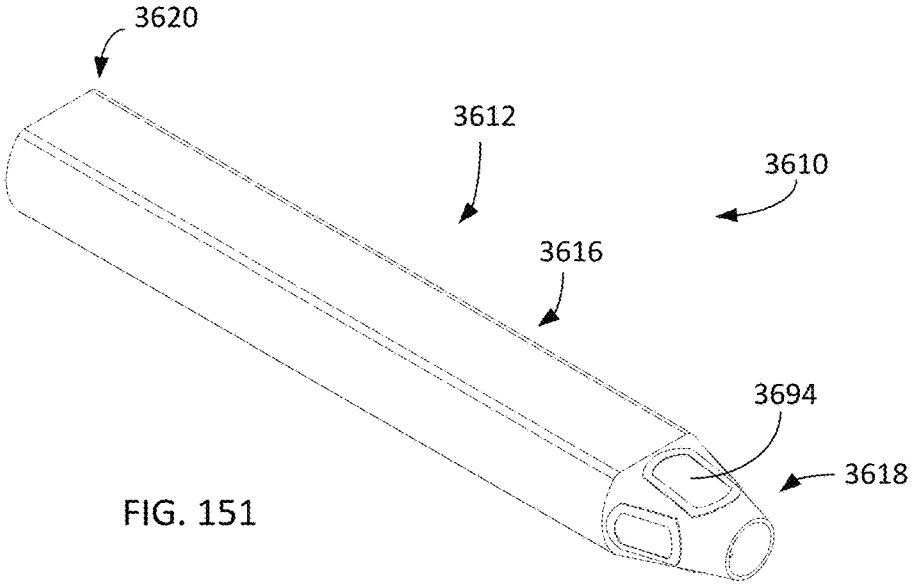
FIG. 151 is a perspective view of another exemplary golf club grip.
Figure 152:
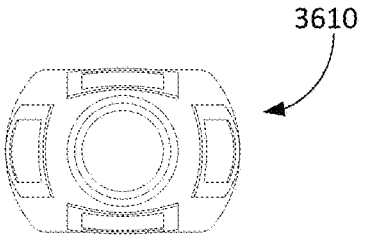
FIG. 152 is a right side view of the grip.
Figure 153:
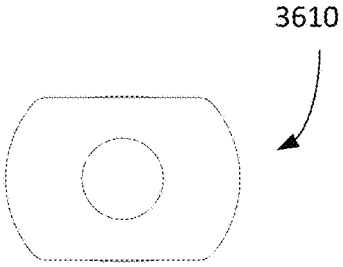
FIG. 153 is a left side view of the grip.
Figure 154:
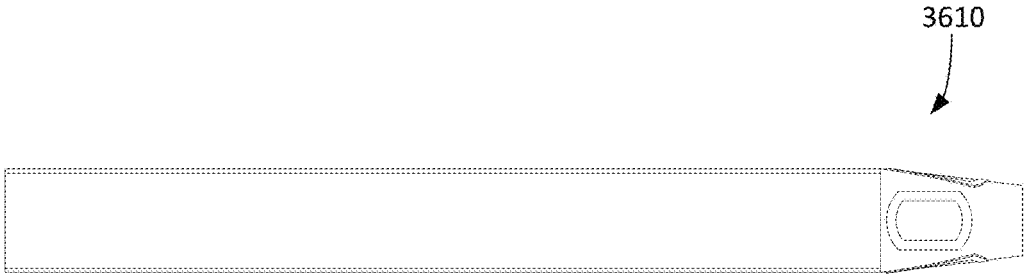
FIG. 154 is a top view of the grip.
Figure 155:
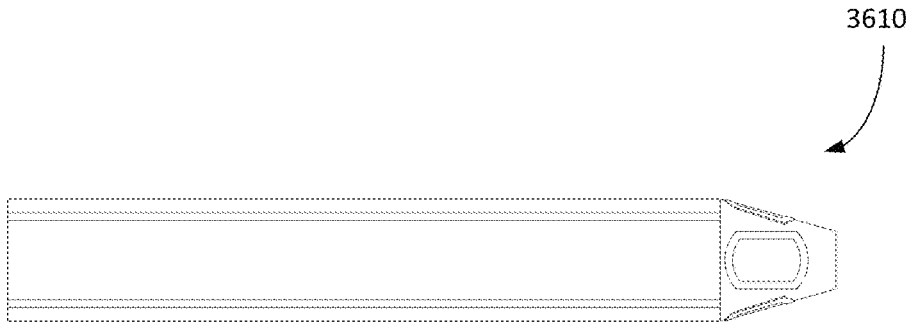
FIG. 155 is a rear view of the grip.
Figure 156:
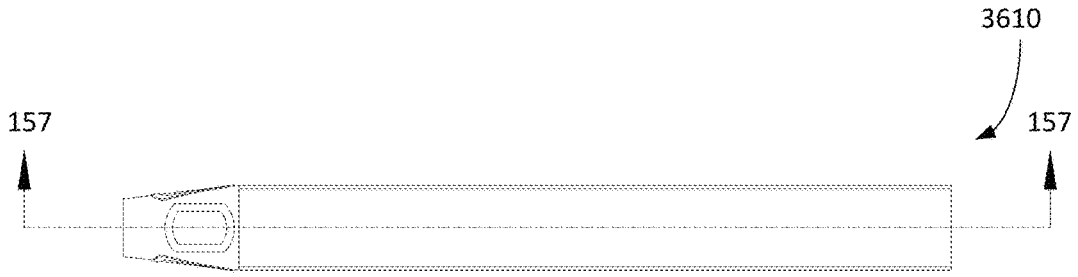
FIG. 156 is a bottom view of the grip.
Figure 157:
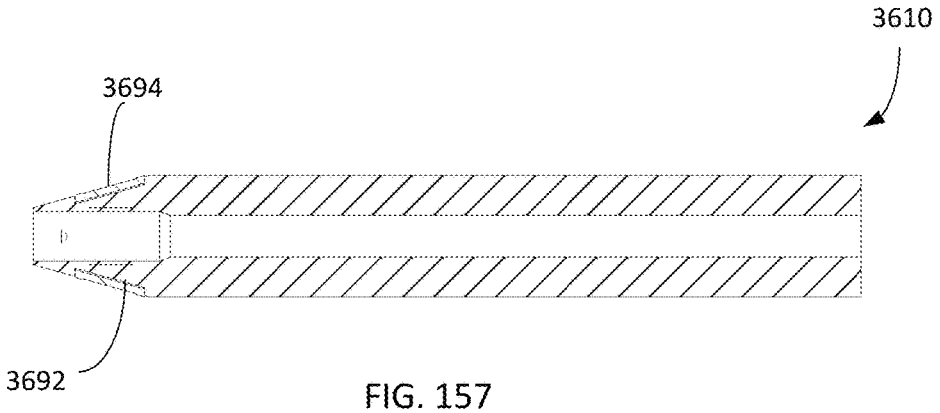
FIG. 157 is a cross-sectional view taken about line 157-157 in FIG. 156.
Figure 158:
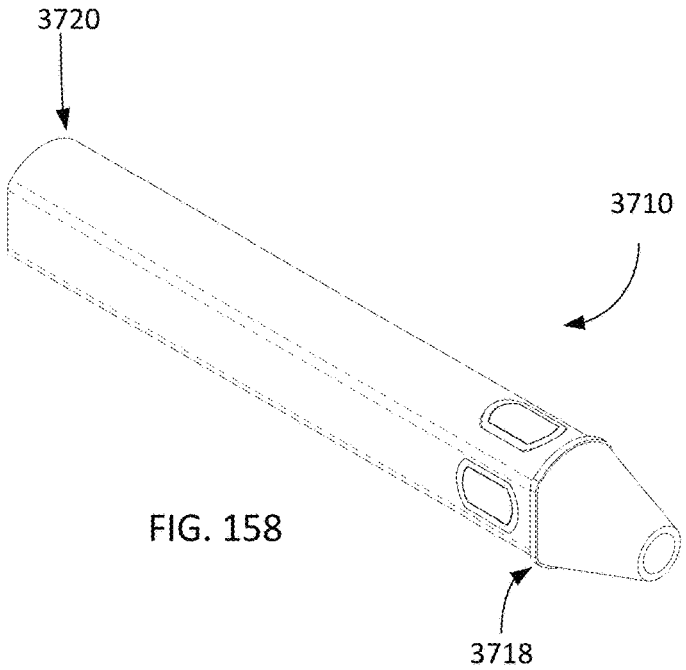
FIG. 158 is a perspective view of still another exemplary golf club grip.
Figure 159:
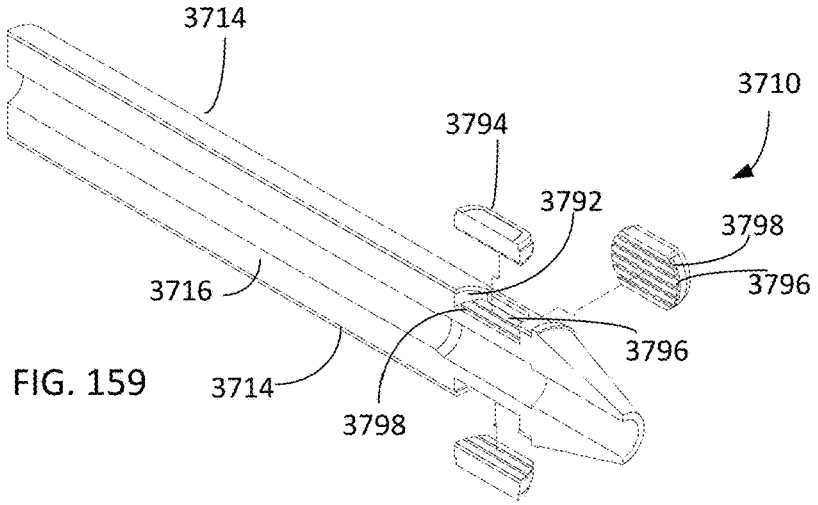
FIG. 159 is a cross-sectional view of the grip.
Figure 160:
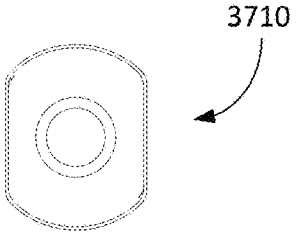
FIG. 160 is a right side view of the grip.
Figure 161:
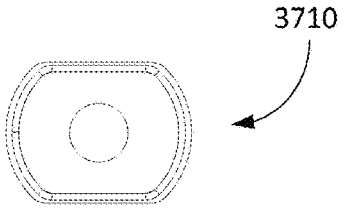
FIG. 161 is a left side view of the grip.
Figure 162:
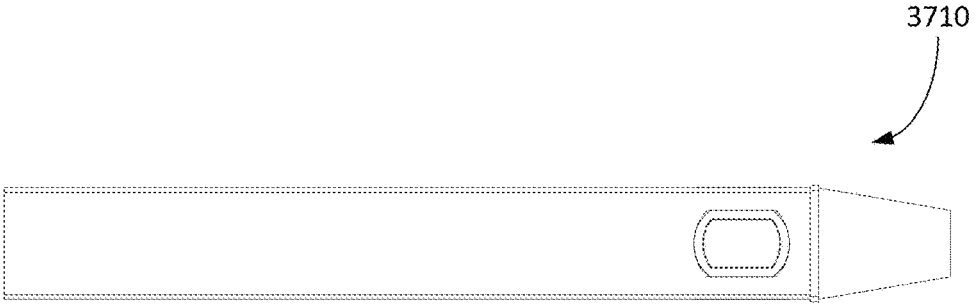
FIG. 162 is a top view of the grip.
Figure 163:
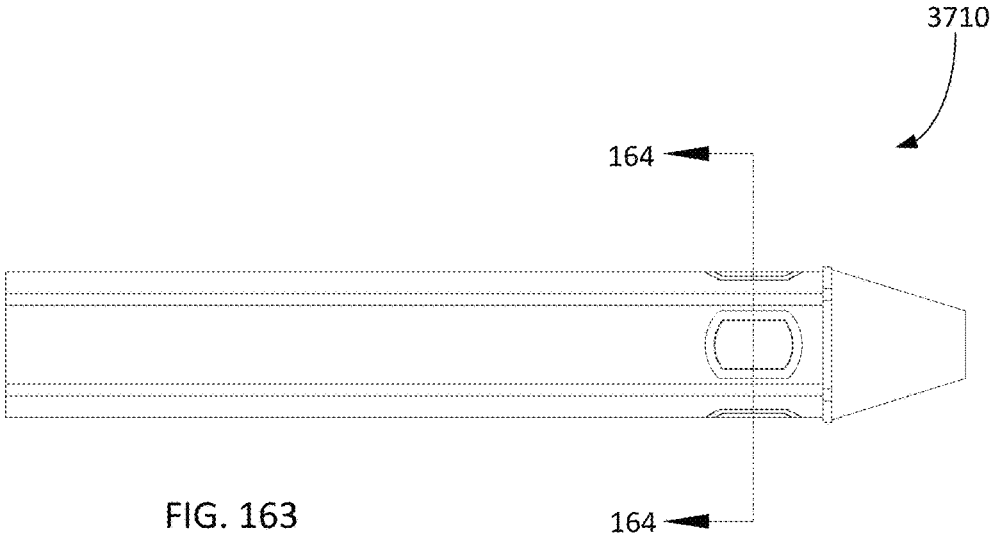
FIG. 163 is a rear view of the grip.

Turning now to FIGS. 129 and 130, an exemplary embodiment of the front portion is shown at 2818 and 2918 respectively. The front portions 2818 and 2918 are substantially the same as the above-referenced front portion 1318, and consequently the same reference numerals but indexed by 1500 and 1600 are used to denote structures corresponding to similar structures in the front portions. In addition, the foregoing description of the front portion 1318 is equally applicable to the front portions 2818 and 2918 except as noted below and illustrated in the figures.

The front portion 2818, and optionally the front portion 2918, includes an opening 2846 for receiving a suitable fastener that is received in a corresponding opening in a grip portion to secure the front portion 2818 to the grip portion. The front portions may alternatively be secured to the grip portion in any suitable manner.

Turning now to FIGS. 131-135, an exemplary embodiment of the golf club grip is shown at 3310. The golf club grip 3310 is substantially the same as the above-referenced golf club grip 10, and consequently the same reference numerals but indexed by 3300 are used to denote structures corresponding to similar structures in the grips. In addition, the foregoing description of the golf club grip 10 is equally applicable to the golf club grip 3310, except as noted below and illustrated in the figures.

The grip 3310 includes a body 3312 including a grip portion 3316, a front portion 3318, and a back portion 3320. As shown, the grip portion 3316 and back portion 3320 are formed as one piece and the front portion 3318 is formed as a separate piece that attaches to the grip portion 3316. The front portion 3318 includes one or more weights 3392, and as illustrated a plurality of weights such as metal weights, and a portion 3394 that is shown with a taper but can be provided without a taper. The number of weights can be adjusted to vary the weight of the grip.

The weights 3392 are sandwiched between the grip portion 3316 and the portion 3394 and include a larger inside diameter than the grip portion 3316. The weights 3392 and portion 3394 can each include an alignment feature 3393, in the form of a tongue, that mates with a corresponding alignment feature 3395, in the form of a groove, in the grip portion 3316 and adjacent weights 3392. The weights 3392 and portion 3394 can each also include an attachment feature 3396, in the form of an annular tongue, that mates with a corresponding attachment feature 3398, in the form of an annular groove, in the grip portion 3316 and adjacent weights 3392. The weights 3392 could be attached permanently, for example by an adhesive, or held by an attachment mechanism extending from the grip portion 3316 to the portion 3394.

Turning now to FIGS. 136-142, an exemplary embodiment of the golf club grip is shown at 3410. The golf club grip 3410 is substantially the same as the above-referenced golf club grip 10, and consequently the same reference numerals but indexed by 3400 are used to denote structures corresponding to similar structures in the grips. In addition, the foregoing description of the golf club grip 10 is equally applicable to the golf club grip 3410, except as noted below and illustrated in the figures.

The grip 3410 includes a body 3412 including a grip portion 3416, a front portion 3418, and a back portion 3420 integrally formed together. The front portion 3418 and/or the grip portion 3416 includes a recess 3492 for receiving a weight 3494, such as a substantially round weight. The weight 3494 is slid over the front portion 3418, thereby compressing the front portion, and slid until the weight 3494 is disposed in the recess 3492 and captured between ends of the recess 3492. After the weight 3494 has passed over the end of the recess, the compressed front portion 3418 returns to its uncompressed position to capture the weight 3494. The material under the weight 3494 is thinner and/or softer than the rest of the grip to allow the putter shaft to be slid through during installation. The weight may include one or more alignment features to ensure the weight is rotated to a predetermined position.

Turning now to FIGS. 143-150, an exemplary embodiment of the golf club grip is shown at 3510. The golf club grip 3510 is substantially the same as the above-referenced golf club grip 10, and consequently the same reference numerals but indexed by 3500 are used to denote structures corresponding to similar structures in the grips. In addition, the foregoing description of the golf club grip 10 is equally applicable to the golf club grip 3510, except as noted below and illustrated in the figures.

The grip 3510 includes a body 3512 including a grip portion 3516, a front portion 3518, and a back portion 3520 integrally formed together. The front portion 3518 and/or the grip portion 3516 includes a recess 3592 for receiving a weight 3594, such as a coiled weight. The weight 3594, which in its uncoiled form may be a wire, can be wrapped around the recess 3592 using multiple turns of the wire thereby building the weight up and flush to the grip. The material under the weight 3594 is thinner and/or softer than the rest of the grip to allow the putter shaft to be slid through during installation.

Turning now to FIGS. 151-157, an exemplary embodiment of the golf club grip is shown at 3610. The golf club grip 3610 is substantially the same as the above-referenced golf club grip 10, and consequently the same reference numerals but indexed by 3600 are used to denote structures corresponding to similar structures in the grips. In addition, the foregoing description of the golf club grip 10 is equally applicable to the golf club grip 3610, except as noted below and illustrated in the figures.

The grip 3610 includes a body 3612 including a grip portion 3616, a front portion 3618, and a back portion 3620 integrally formed together. The front portion 3618 may include one or more holes or recesses, and in the illustrated embodiment four recesses 3692 for receiving correspondingly sized molded weights 3694 that are substantially flush with the surface of the front portion 3618. The weights may have any suitable shape, such as the shape of a letter or a logo. In an embodiment the weights could be pushed all the way through areas where the shaft of the golf club is not present and to a predetermined depth where the shaft is present. In an embodiment, one or more of the recesses 3692 are filled with weights 3694 and one or more of the recesses 3692 are filled with a lighter weighted plug, such as a foam plug to vary the weight of the grip.

The weights could be secured in any suitable manner, such as by an adhesive, or alternatively may be molded into the grip, for example by placing the weights on the inside of a mold and then injecting the grip material into the cavity to surround the weights. The weights could incorporate features to add strength and help keep them in place.

Turning now to FIGS. 158-165, an exemplary embodiment of the golf club grip is shown at 3710. The golf club grip 3710 is substantially the same as the above-referenced golf club grip 10, and consequently the same reference numerals but indexed by 3700 are used to denote structures corresponding to similar structures in the grips. In addition, the foregoing description of the golf club grip 10 is equally applicable to the golf club grip 3710, except as noted below and illustrated in the figures.

The grip 3710 includes a body 3712 including a grip portion 3716, a front portion 3718, and a back portion 3720 integrally formed together. The grip portion 3716 may include one or more holes or recesses, and in the illustrated embodiment four recesses 3792 for receiving correspondingly sized molded weights 3794 that are substantially flush a wrap 3714 covering the grip portion 3716. The recesses 3792 are provided proximate the front portion 3718 such that the weights 3794 are in a lower third of the grip and below the hands of the golfer. The wrap 3714 is shown with openings exposing the weights 3794 but may be provided without openings, and may be flush with the front portion 3718 as shown in FIG. 198 or provided as shown.

Figure 164:
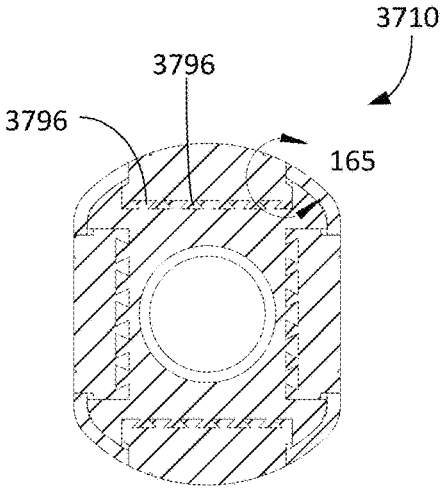
FIG. 164 is a cross-sectional view taken about line 164-164 in FIG. 163.
Figure 165:
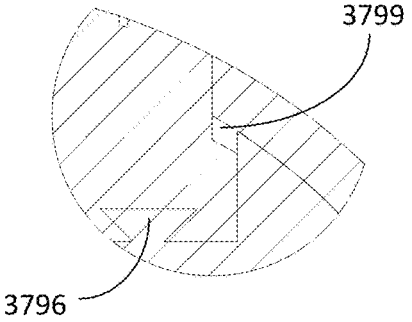
FIG. 165 is an enlarged view of detail 165 in FIG. 164.
Figure 166:
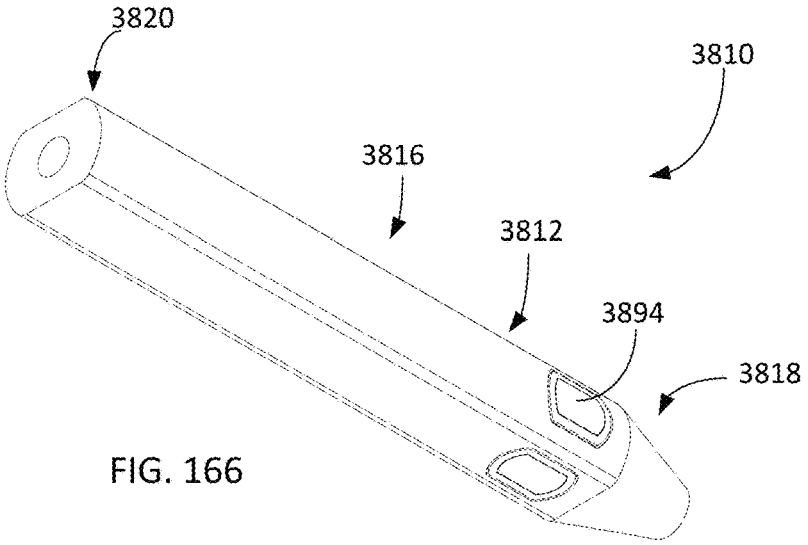
FIG. 166 is a perspective view of yet another exemplary golf club grip.
Figure 167:
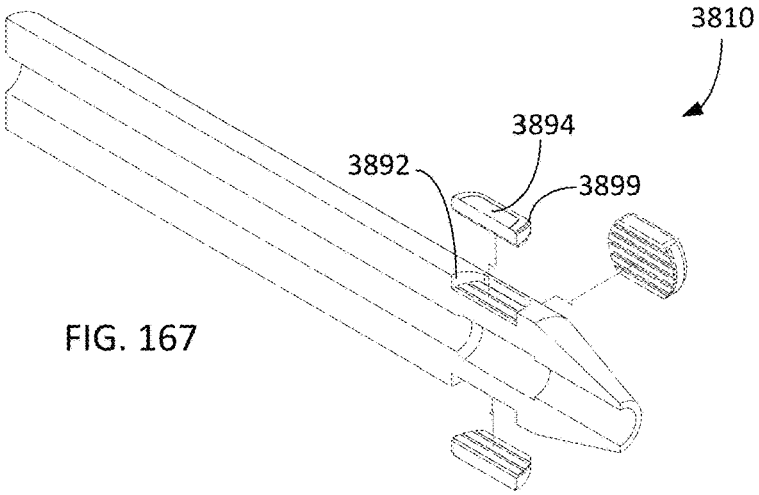
Figure 168:
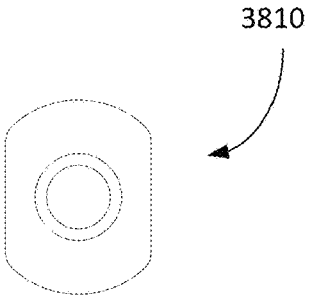
Figure 169:
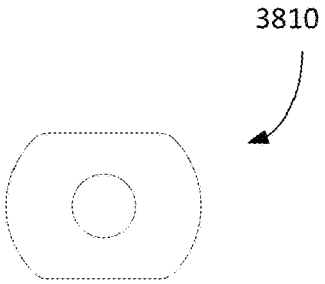
Figure 170:
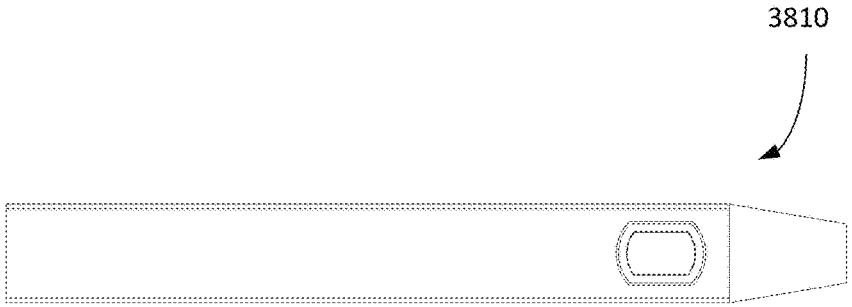
Figure 171:
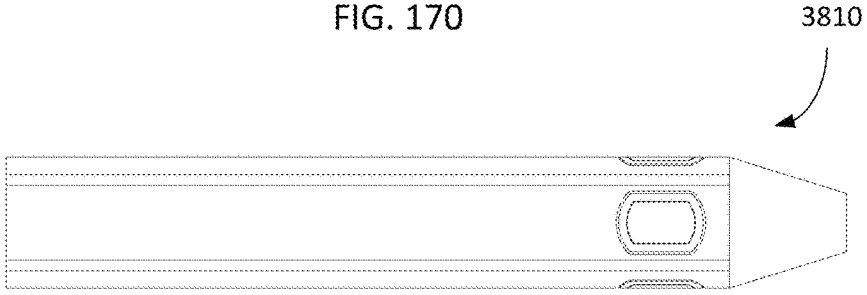
Figure 172:
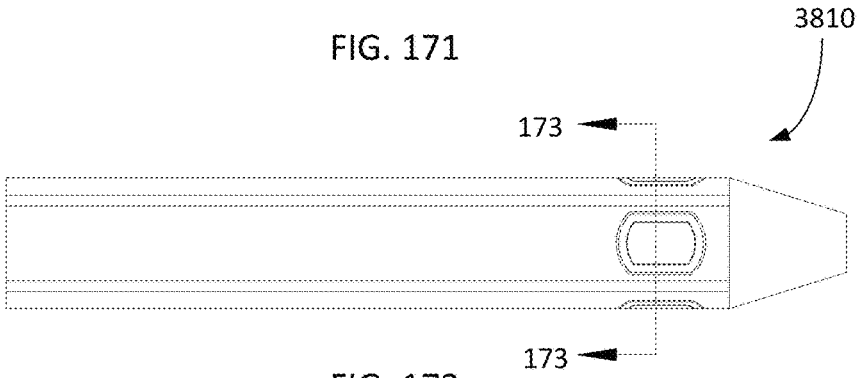
Figure 173:
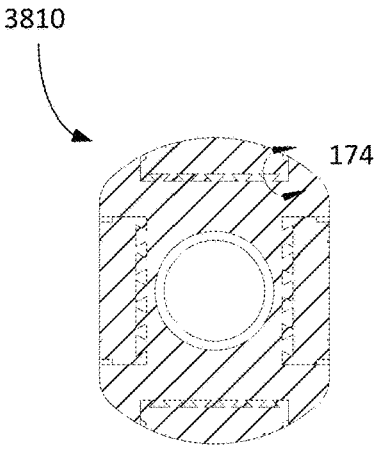
Figure 174:
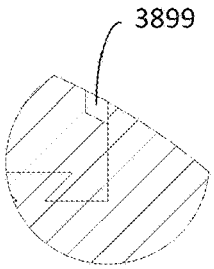
Figure 175:
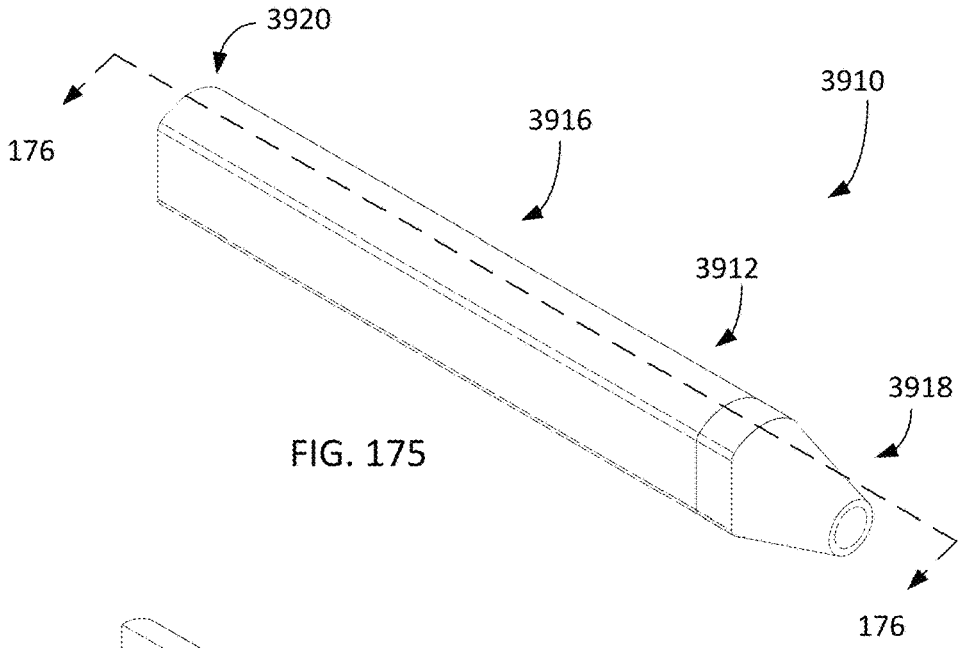
Figure 176:
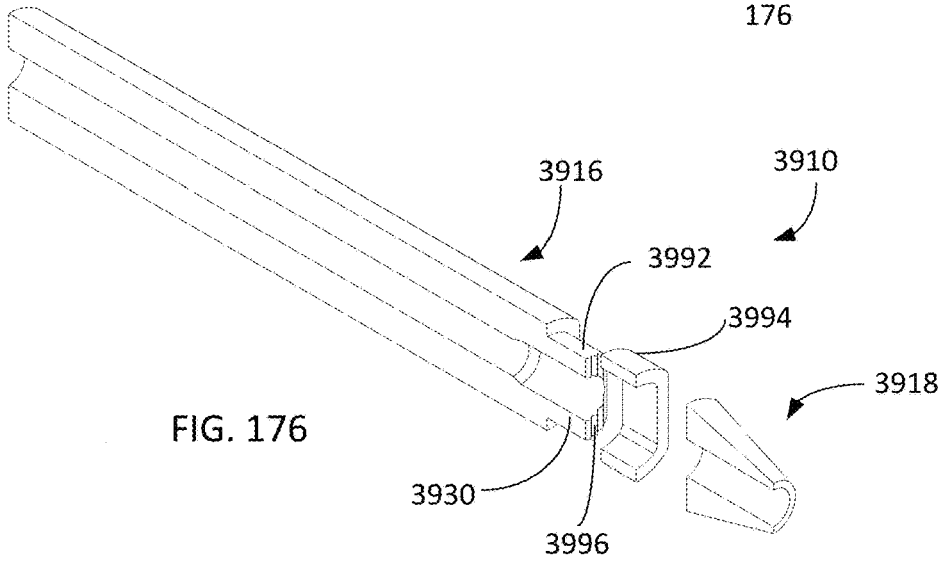
Figure 177:
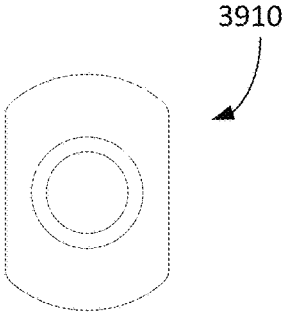
Figure 178:
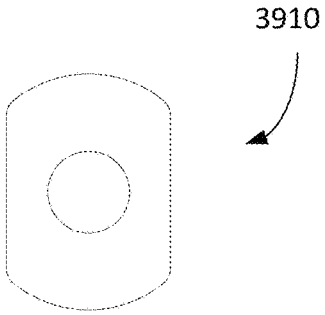

As best shown in FIGS. 164 and 165, the recesses 3792 and weights 3794 each include a plurality of spaced tapered projections 3796 running their respective length, which may be any suitable shape such as dovetail shaped, separated by correspondingly shaped notches 3798 running their respective length for mating with the projections 3796 on the other of the recesses 3792 and weights 3794. In the illustrated embodiment, the weights 3794 may be placed in the mold, for example in a window for the weight, and then the grip material injected into the cavity surrounding the weights to form the projections 3796 and notches 3798 of the recesses 3792 molded around the weights. The weights 3794 can each include a cut-out 3799 around their perimeter providing a gap between an edge of the weight and an outer surface of the grip portion 3716 to minimize or eliminate flash during molding, and the cut-out 3799 can be covered by the wrap 3714 after molding.

The weights may have any suitable shape, such as the shape of a letter or a logo. In an embodiment the weights could be pushed all the way through areas where the shaft of the golf club is not present and to a predetermined depth where the shaft is present. In an embodiment, one or more of the recesses 3792 are filled with weights 3794 and one or more of the recesses 3792 are filled with a lighter weighted plug, such as a foam plug to vary the weight of the grip.

In another embodiment, the weights could be attached to the grip after molding, for example by adhesive, and the weights may have a shaped bottom, such as a crenellation shape for mating with corresponding regions of the grip. The weights could incorporate features to add strength and help keep them in place.

Turning now to FIGS. 166-174, an exemplary embodiment of the golf club grip is shown at 3810. The golf club grip 3810 is substantially the same as the above-referenced golf club grip 3710, and consequently the same reference numerals but indexed by 100 are used to denote structures corresponding to similar structures in the grips. In addition, the foregoing description of the golf club grip 3710 is equally applicable to the golf club grip 3810, except as noted below and illustrated in the figures.

The grip 3810 includes a body 3812 including a grip portion 3816, a front portion 3818, and a back portion 3820 integrally formed together. The grip portion 3816 may include one or more holes or recesses, and in the illustrated embodiment four recesses 3892 for receiving correspondingly sized molded weights 3894 that are substantially flush with the surface of the grip portion 3816. The recesses 3892 are provided proximate the front portion 3818 such that the weights 3894 are in a lower third of the grip and below the hands of the golfer. In the illustrated embodiment, the grip does not include a wrap, and the weights 3894 include a cut-out 3899 around their perimeters providing a gap between an edge of the weight and an outer surface of the grip portion 3816 to minimize or eliminate flash during molding.

Turning now to FIGS. 175-183, an exemplary embodiment of the golf club grip is shown at 3910. The golf club grip 3910 is substantially the same as the above-referenced golf club grip 10, and consequently the same reference numerals but indexed by 3900 are used to denote structures corresponding to similar structures in the grips. In addition, the foregoing description of the golf club grip 10 is equally applicable to the golf club grip 3910, except as noted below and illustrated in the figures.

The grip 3910 includes a body 3912 including a grip portion 3916, a front portion 3918, and a back portion 3920. As shown, the grip portion 3916 and back portion 3920 are formed as one piece and the front portion 3918 is formed as a separate piece that attaches to the grip portion 3916. The grip portion 3916 includes a projection 3992 at its first end 3930 having a diameter less than a diameter of the main body of the grip portion 3916 for receiving a weight 3994 such that an outer surface of the weight 3994 is substantially flush with the main body of the grip portion 3916. The front portion 3918 is then positioned adjacent the weight 3994 such that the weight is sandwiched between the front portion 3918 and the main body of the grip portion 3916. The front portion 3918 is then welded to the projection 3992, such as by ultrasonic welding. In the illustrated embodiment, the projection 3992 includes peaks and valleys creating small areas that will melt quicker than the rest of the projection 3992 with minimal energy requirements, and the portions are pressed together until the front portion 3918 abuts the weight 3994 as shown in FIG. 181. The front portion 3918 can include a groove for receiving the end of the projection 3992 to assist in alignment, and/or may include corresponding peaks and valleys, or pins, tongues, etc.

Turning now to FIGS. 184-189, an exemplary embodiment of the golf club grip is shown at 4010. The golf club grip 4010 is substantially the same as the above-referenced golf club grip 10, and consequently the same reference numerals but indexed by 4000 are used to denote structures corresponding to similar structures in the grips. In addition, the foregoing description of the golf club grip 10 is equally applicable to the golf club grip 4010, except as noted below and illustrated in the figures.

The grip 4010 includes a body 4012 including a grip portion 4016, a front portion 4018, and a back portion 4020. As shown, the grip portion 4016 and back portion 4020 are formed as one piece and the front portion 4018 is formed as a separate piece that attaches to the grip portion 4016. The grip portion 4016 includes a projection 4092 at its first end 4030 having a diameter less than a diameter of the main body of the grip portion 4016 for receiving a weight 4094 such that an outer surface of the weight 4094 is substantially flush with the main body of the grip portion 4016. The front portion 4018 is then positioned adjacent the weight 4094 such that the weight is sandwiched between the front portion 4018 and the main body of the grip portion 4016. The front portion 4018 is then welded to the projection 4092, such as by spin welding. In the illustrated embodiment, the projection 4092 includes a tapered portion 4096 received in annular groove 4098 in the front portion 4018. These features have a weld area greater than a typical wall section of the part and provide sufficient part to part alignment. The features have a circular axis to accommodate spin welding and may have drive features to enable spinning.

Turning now to FIGS. 190-195, an exemplary embodiment of the golf club grip is shown at 4110. The golf club grip 4110 is substantially the same as the above-referenced golf club grip 10, and consequently the same reference numerals but indexed by 4100 are used to denote structures corresponding to similar structures in the grips. In addition, the foregoing description of the golf club grip 10 is equally applicable to the golf club grip 4110, except as noted below and illustrated in the figures.

The grip 4110 includes a body 4112 including a grip portion 4116, a front portion 4118, and a back portion 4120 integrally formed together. The front portion 4118, or alternatively the grip portion 4116 or the front portion 4118 and the grip portion 4116 includes a cavity or pocket 4192 into which a material, such as a high density material, such as a tungsten powder or other heavy metal is injected. In an embodiment, the cavity 4192 could be filled after molding with the high density material and an adhesive. In another embodiment, the material of the body 4112 could change in density along its length, with the lower third consisting of the front portion 4118 and a part of the grip portion 4116 and being heavier than the rest of the grip, for example with area of the front portion 4118 having the opening having the highest density.

Turning now to FIGS. 198-204, an exemplary embodiment of the golf club grip is shown at 4210. The golf club grip 4210 is substantially the same as the above-referenced golf club grip 10, and consequently the same reference numerals but indexed by 4200 are used to denote structures corresponding to similar structures in the grips. In addition, the foregoing description of the golf club grip 10 is equally applicable to the golf club grip 4210, except as noted below and illustrated in the figures.

The grip 4210 includes a body 4212 including a grip portion 4216, a front portion 4218, and a back portion 4220. The grip portion 4216 and back portion 4220 can be formed as one piece and of any suitable material, such as rubber, and the front portion 4218 is formed as a separate piece of any suitable material, such as metal, that attaches to the grip portion 4216. A wrap can be placed around the body.

The grip portion 4216 has a bore 4280 or axial passage. The bore has a first end that opens to an opening at a first end of the grip portion 4216, and a second end that is closed. The bore 4280 includes a first diameter portion 4304 substantially equal to a diameter of a shaft of a golf club and a second diameter portion 4306 larger than the first diameter portion 4304 for receiving a portion of the front portion 4218. The bore has a shoulder 4308 between the first and second diameter portions 4304 and 4306 that is abutted by the front portion, and as illustrated, has a chamfer between the second diameter portion 4306 and the first diameter portion 4304. The grip portion 4216 has a thickness T1 shown in FIG. 200 around the second diameter portion 4306 that is greater than a thickness T2 of the portion of the front portion 4218 in the bore, such as more than fifty percent greater. The grip portion 4216 also has a thickness T3 shown in FIG. 202 and at the bottom of FIG. 200 that is less than the thickness T2 near the shoulder 4308, and the thickness gradually increases towards the front portion to thickness T1. The portions are formed such that the grip portion 4216 and the front portion 4218 have the same or substantially the same outer diameter where they abut such that they are flush with one another.

The front portion 4218 is weighted to provide a weighted golf grip with the weight below the golfer's hands. The grip has a total weight, and the front portion has a weight that is greater than or equal to thirty percent of the total weight of the grip, and in an embodiment has a weight greater than or equal to forty percent of the total weight of the grip. In an embodiment, the weight of the front portion is greater than or equal to twenty-five grams and the total weight of the grip is greater than or equal to fifty-five grams.

Turning now to FIGS. 205-210, an exemplary embodiment of the golf club grip is shown at 4310. The golf club grip 4310 is substantially the same as the above-referenced golf club grip 10, and consequently the same reference numerals but indexed by 4300 are used to denote structures corresponding to similar structures in the grips. In addition, the foregoing description of the golf club grip 10 is equally applicable to the golf club grip 4310, except as noted below and illustrated in the figures.

The grip 4310 includes a body 4312 including a grip portion 4316, a front portion 4318, and a back portion 4320. The grip portion 4316 and back portion 4320 can be formed as one piece and of any suitable material, such as rubber, and the front portion 4318 is formed as a separate piece of any suitable material, such as metal, that attaches to the grip portion 4316. A wrap can be placed around the body.

Turning now to FIGS. 211-214 an exemplary embodiment of the golf club grip is shown at 4410. The golf club grip 4410 is substantially the same as the above-referenced golf club grip 10, and consequently the same reference numerals but indexed by 4400 are used to denote structures corresponding to similar structures in the grips. In addition, the foregoing description of the golf club grip 10 is equally applicable to the golf club grip 4410, except as noted below and illustrated in the figures.

The grip includes a body 4412 and a wrap 4414 surrounding a portion of the body. The body 4412 including a grip portion 4416, a front portion 4418, and a back portion 4420. The grip portion 4416, front portion 4418, and back portion 20 can be formed as one piece and of any suitable material such as EVA foam injected into a mold. Alternatively, the grip portion and back portion can be formed as one piece and the front portion formed as a separate piece that is weighted as described above regarding FIG. 1. A wrap 4414 can be placed around the body.

The wrap 4414 is made of a suitable rubber, such as natural, synthetic, thermoplastic, etc., and as illustrated is a seamless rubber sleeve attached in any suitable manner, such as stretching, rolling, heat shrinking, sliding, sliding onto a tube larger than the core and then slid off the tube onto the core, etc. As shown the wrap has a non-circular geometry, such as a geometry that is substantially the same as the geometry of the grip portion 4416 when the wrap is unattached from the grip portion so that when the wrap is attached to the grip portion, the shape of the grip portion is not distorted by the wrap. An inside diameter of the sleeve is slightly smaller than the perimeter of the grip portion 4416. The grip provides a golfer an oversized putter grip that is lightweight due to the material of the core and with the same feel as a traditional rubber grip. For example, the grip provides a tacky non-slip surface. The rubber sleeve may be made in any suitable manner, such as by injection molding, and may include grooves for receiving colored rubber portions.

It will be appreciated that the above described weights may apply to grips having both foam and rubber cores. It will be appreciated that the above described grips and portions of grips, may be formed in suitable manners, such as by molding, additive manufacturing, etc. In an embodiment, the front portions may be 3-D printed directly onto a grip portion. It will also be appreciated that a variable density material can be used during molding, for example to create the weighted front portions, for example by increasing/decreasing material porosity, using multiple materials, creating pockets within molded material, etc. It will further be appreciated that powdered or small pieces of metal could be embedded in the grips during molding to provide weight. For example, weights could be placed on the inside of a mold, and the grip material injected into the remaining cavity to surround the weights and hold them in place.

A method for installing a golf club grip on a shaft of a golf club includes attaching one of the above described front portions to a grip portion between the grip portion and a head of the golf club, either before or after the grip portion has been attached to the shaft, thereby effectively increasing the weight of the head of the golf club. A method for installing a weighted front portion, otherwise referred to as a grip attachment, onto a golf club having a golf club grip installed on a shaft of the club includes attaching the front portion to the grip between the grip and a head of the golf club. In an embodiment the front portion has a weight greater than or equal to eighty percent of the weight of the golf club grip. In another embodiment, the front portion has a weight greater than or equal to one hundred percent of the weight of the golf club grip.

The above provides a method for mitigating inconsistencies in a putter swing, such as minimizing directional and acceleration inconsistencies is provided. The method includes trisecting a putter grip into a lower third, a middle third, and an upper third, where the upper third forms a butt end of a putter and the lower third is between a head of the putter and the middle and upper thirds, and incorporating a metallic weight into the lower third of the putter grip such that a weight of the lower third of the putter grip is greater than a combined weight of the middle and upper thirds. The putter grip can include a grip with an integral front portion or a front portion attached to a grip portion as discussed above. Examples of the grips are shown in FIGS. 196 and 197 with the lower third L1, middle third M1, and upper third U1 illustrated, or with the lower third L2, middle third M2, and upper third U2 illustrated.

Although certain embodiments have been shown and described, it is understood that equivalents and modifications falling within the scope of the appended claims will occur to others who are skilled in the art upon the reading and understanding of this specification.

What is claimed is:

1. A grip for a golf club including:

a grip portion having first and second ends and a bore extending longitudinally through the grip portion for receiving a shaft of the golf club at the first end;

a back portion adjacent to the second end of the grip portion; and a front portion adjacent to the grip portion at the first end, the front portion having first and second ends and a bore extending longitudinally through the front portion such that the shaft of the golf club is configured to extend through the bore and into the bore of the grip portion, wherein a total weight of the grip is a first weight, and wherein the front portion is a second weight that is greater than or equal to thirty percent of the first weight, wherein the front portion includes a body defining the bore and a spacer disposed in the bore at the first end, the spacer being configured to abut an outer surface of the shaft, and wherein the body includes a first portion disposed in the bore of the grip portion and a second portion that abuts an end face of the grip portion at the first end and tapers away from the first end.

2. The grip according to claim 1, wherein the bore of the front portion has a first diameter portion and a second diameter portion larger than the first diameter portion, and wherein the spacer is disposed in the second diameter portion.

3. The grip according to claim 2, wherein the front portion includes a shoulder between the first and second diameter portions that is abutted by the spacer.

4. The grip according to claim 1, wherein the body of the front portion includes one or more slots extending longitudinally from the second end towards the first end, and wherein the slots extend through a wall of the body into the bore.

5. The grip according to claim 1, wherein the spacer is made of a compressible material configured to surround the shaft and seal to the shaft to prevent fluid and/or debris from entering the bore.

6. The grip according to claim 1, wherein the bore of the grip portion has a first diameter portion and a second diameter portion larger than the first diameter portion, and wherein the first portion of the body of the front portion is disposed in the second diameter portion of the grip portion.

7. The grip according to claim 6, wherein the grip portion includes an internal shoulder between the first and second diameter portions that is abutted by the first portion of the body of the front portion.

8. The grip according to claim 1, wherein the second weight is greater than or equal to fifty percent of the first weight.

9. A grip for a golf club including:

a grip portion having first and second ends and a bore extending longitudinally through the grip portion for receiving a shaft of the golf club at the first end;

a back portion adjacent to the second end of the grip portion; and a front portion adjacent to the grip portion at the first end, the front portion having first and second ends and a bore extending longitudinally through the front portion such that the shaft of the golf club is configured to extend through the bore and into the bore of the grip portion, wherein a total weight of the grip is a first weight, and wherein the front portion is a second weight that is greater than or equal to thirty percent of the first weight, and wherein the second weight is greater than or equal to seventy-five grams.

10. The grip according to claim 9, wherein the front portion includes a body defining the bore and a spacer disposed in the bore at the first end, the spacer being configured to abut an outer surface of the shaft.

11. The grip according to claim 10, wherein the bore of the front portion has a first diameter portion and a second diameter portion larger than the first diameter portion, and wherein the spacer is disposed in the second diameter portion.

12. The grip according to claim 11, wherein the front portion includes a shoulder between the first and second diameter portions that is abutted by the spacer.

13. The grip according to claim 10, wherein the body of the front portion includes one or more slots extending longitudinally from the second end towards the first end, and wherein the slots extend through a wall of the body into the bore.

14. The grip according to claim 10, wherein the spacer is made of a compressible material configured to surround the shaft and seal to the shaft to prevent fluid and/or debris from entering the bore.

15. The grip according to claim 9, wherein the body includes a first portion disposed in the bore of the grip portion and a second portion that abuts an end face of the grip portion at the first end and tapers away from the first end.

16. The grip according to claim 15, wherein the bore of the grip portion has a first diameter portion and a second diameter portion larger than the first diameter portion, and wherein the first portion of the body of the front portion is disposed in the second diameter portion of the grip portion.

17. The grip according to claim 16, wherein the grip portion includes an internal shoulder between the first and second diameter portions that is abutted by the first portion of the body of the front portion.

18. A grip for a golf club including:

a grip portion defining an area for hands of a golfer to grip during use; and a front portion between the grip portion and a head of the golf club, wherein the grip portion and front portion define a length of the grip, wherein the length includes a lower third, an upper third, and a middle third between the lower third and the upper third, where the lower third is between the head of the golf club and the middle and upper thirds, and wherein a weight of the lower third of the grip is greater than or equal to eighty percent of a combined weight of the middle and upper thirds of the grip.

19. The grip according to claim 18, wherein the weight of the lower third of the grip is greater than or equal to the combined weight of the middle and upper thirds of the grip.

* * * * *